US007919913B2

(12) United States Patent
Wii

(10) Patent No.: US 7,919,913 B2
(45) Date of Patent: Apr. 5, 2011

(54) LIGHT ILLUMINATING ELEMENT

(76) Inventor: Jenn-Wei Wii, Taipei (TW)

( * ) Notice: Subject to any disclaimer, the term of this patent is extended or adjusted under 35 U.S.C. 154(b) by 343 days.

(21) Appl. No.: 12/046,971

(22) Filed: Mar. 12, 2008

(65) Prior Publication Data

US 2008/0224068 A1 Sep. 18, 2008

(30) Foreign Application Priority Data

Mar. 14, 2007 (TW) ..... 96108693 A

(51) Int. Cl.
*H01J 1/62* (2006.01)

(52) U.S. Cl. ..... 313/489; 313/112; 313/485; 313/492

(58) Field of Classification Search ..... 313/112, 313/161, 485, 488, 489, 492, 493, 635
See application file for complete search history.

(56) References Cited

U.S. PATENT DOCUMENTS

| | | | | |
|---|---|---|---|---|
| 3,624,444 | A * | 11/1971 | Berthold et al. | 313/161 |
| 5,059,860 | A | 10/1991 | Sato et al. | |
| 5,509,841 | A | 4/1996 | Winsor | |
| 5,646,472 | A | 7/1997 | Horikoshi | |
| 5,798,608 | A * | 8/1998 | Shaw | 313/489 |
| 5,869,927 | A * | 2/1999 | Matsuo et al. | 313/485 |
| 2003/0094890 | A1 | 5/2003 | Gordin | |
| 2004/0184256 | A1 | 9/2004 | Blanchard | |
| 2005/0218810 | A1 | 10/2005 | Kwok et al. | |
| 2006/0238138 | A1 | 10/2006 | Quazi | |
| 2007/0069615 | A1 * | 3/2007 | Ha et al. | 313/112 |
| 2007/0121024 | A1 | 5/2007 | Lim et al. | |

FOREIGN PATENT DOCUMENTS

| | | | |
|---|---|---|---|
| CN | 1742383 | | 1/2006 |
| CN | 1836339 | A | 9/2006 |
| CN | 2929954 | Y | 8/2007 |
| CN | 200956372 | Y | 11/2007 |
| CN | 200983356 | Y | 11/2007 |
| GB | 1307141 | | 2/1973 |
| JP | 61179053 | | 8/1986 |
| JP | 04095338 | | 3/1992 |

(Continued)

OTHER PUBLICATIONS

European Search Report dated May 3, 2010 for 1970939, which is a counterpart European application that cites US2004184256, GB1307141, WO0002231, JP08162069, JP04095338, US5509841, US5798608, and JP61179053.

*Primary Examiner* — Nimeshkumar D Patel
*Assistant Examiner* — Mary Ellen Bowman
(74) *Attorney, Agent, or Firm* — WPAT, P.C.; Anthony King

(57) ABSTRACT

A light illuminating element including a transparent closed casing, an exciting gas, a first exciting coating, and a first dielectric multi-layer long-pass filter is provided. The transparent closed casing has a first inner side, a second inner side, a first outer side corresponding to the first inner side, and a second outer side corresponding to the second inner side. The exciting gas is disposed inside the transparent closed casing, and suitable for providing an ultraviolet light. The first exciting coating is disposed on the first inner side or the first outer side, and is suitable for absorbing the ultraviolet light to provide a visible light. The first dielectric multi-layer long-pass filter is disposed on the second inner side or the second outer side, and suitable for reflecting the ultraviolet light and allowing the visible light to pass through.

33 Claims, 48 Drawing Sheets

300a

FOREIGN PATENT DOCUMENTS

| | | | |
|---|---|---|---|
| JP | 08162069 | | 6/1996 |
| JP | 10-149708 | | 6/1998 |
| JP | 2001-243821 | A | 9/2001 |
| JP | 2003-281901 | A | 10/2003 |
| JP | 2006-310167 | A | 9/2006 |
| JP | 2007157410 | | 6/2007 |
| WO | WO00/02231 | | 1/2000 |

* cited by examiner

300b

300a

300d

300c

400a

400c

400b

500a

700a

900b

900a

900c

900d

900e

900f

900g

900h

900i

900j

1000b

1000c

1000c

1000d

1000d

1000e

1000f

1200a

1300b

1300a

1300d

1300c

1300d

1400a

1400d

1400e

1400f

1400g

1500a

LIGHT ILLUMINATING ELEMENT

BACKGROUND OF THE INVENTION

1. Field of the Invention

The present invention relates to an illuminating element, more particularly to, an illuminating element with a dielectric optical long-wave multi-layer filter, hereinafter referred to as "wide AOI reflectance LPF".

2. Description of the Related Art

With rapid advance of manufacturing, illuminating elements such as sun lamps, bulbs, and fluorescent lamps are largely applied to daily life. Nowadays how to enhance the illuminating efficiency and optical uniformity of illuminating elements is a major goal for research and development.

Refer to FIG. 1 as a sectional view of one of the conventional illuminating elements, and FIG. 1A is the locally zoomed view. As can be seen, the conventional illuminating element 100 comprises a transparent closed tube 110, mercurial gas (Hg) 120 and fluorescent film 130, wherein mercurial gas 120 is disposed within transparent closed tube 110, and a fluorescent film 130 is applied to the inner side 112 of the transparent closed tube 110. Additionally, said fluorescent film 130 is stacked by a plurality of dot-type fluorescent particles, and fluorescent film 130 can be further sectionalized to be top fluorescent film 132 and bottom fluorescent film 134.

After mercurial gas 120 is stimulated by high voltage, said mercurial gas 120 will emit ultraviolet light and illuminating on said fluorescent film 130, and the fluorescent particles 130*a* on said fluorescent film 130 will emit visible light after 130*a* is stimulated by ultraviolet light 122, and visible light 124 will pass through transparent closed tube 110 and illuminating all around.

However; the energy of the ultraviolet light 122 will decay as passing said fluorescent film 130, in such a way the fluorescent particles 130*a'* at the top of the fluorescent film 132 and the fluorescent particle 130*a"* at the bottom of fluorescent film 134 are stimulated in different scale. Thus, the fluorescent particle 130*a'* and 130*a"* will emit different-scale light as 124', 124" such that visible light 124" is overall darker than visible light 124'.

Also, because said fluorescent film 130 is stacked by crystallized tiny fluorescent particle 130*a*, more or less ultraviolet light will permeate through the tiny apertures between fluorescent particles 130*a* therefore some waste will be introduced and energy efficiency will be reduced.

In addition, as said fluorescent film 130 is not a fine transparent body, visible light emitted from said fluorescent particle 130*a'* must permeate through bottom fluorescent film 134, in order to illuminate outside. In this way the brightness of visible light 124' will be reduced. Therefore, if we can adjust the thickness of fluorescent film 130 and said ultraviolet light 122 is amply absorbed, and the illumination efficiency can be enhanced.

FIG. 1B is another locally zoomed view of another conventional illuminating element. Please refer to FIG. 1B and FIG. 1A. A illuminating element 100*a* in FIG. 1B and a illuminating element 100 in FIG. 1A are ditto but their difference is the thickness of the fluorescent film 130' of the illuminating element 100*a* is less than that of the fluorescent film 130 of illuminating element 100. While coating for fluorescent film 130', due to the thinner fluorescent film 130', the transparency will be enhanced but it will also suffer from the incomplete stacking and some areas are not fully covered.

Correspondingly, a large portion of the ultraviolet light 122' will directly punch through fluorescent film 130 to be wasted and leads to inferior brightness. If at this time the wasted ultraviolet light can be reflected for utilization, then the better pervious to light (fluorescent film 130') and better utilization allow the illuminating efficiency to be greatly improved.

FIG. 2 is another sectional view of conventional illuminating element. In FIG. 2 a conventional illuminating element 200 comprises transparent closed tube 210, mercurial gas 220, fluorescent film 230 and reflecting film 240, wherein mercurial gas 220 is disposed in transparent closed tube 210. The transparent closed tube 210 is partitioned to a bottom inner side 212 and an upper inner side 214. The reflecting film 240 is coated on said bottom inner side 212 and fluorescent film 230 is coated on the reflecting film 240.

While mercurial gas 220 emitting ultraviolet light 222 (222') and illuminating on fluorescent film 230, 230 will be stimulated to emit visible light 224. A part of visible light 224' can directly pass through said upper inner side 214 and the transparent closed tube 210 to shine the outside, and some other part of visible light 224" will be reflected by the reflecting film 240 and pass through the transparent closed tube 210.

Despite the major illuminating by the surface of fluorescent 230 for the illuminating element 200, some part of visible light 224' can directly illuminate the external world without passing through the fluorescent film 230 such that the entire brightness of the illuminating element 200 is slightly enhanced. However; due to the semicircle coating of fluorescent film 230, some upward ultraviolet 222" cannot illuminate the fluorescent film 230 for radiating and this situation caused the energy lose and reduced the energy valid efficiency for the illuminating element 200.

SUMMARY OF THE INVENTION

In view of the disadvantages of prior art, the primary object of the present invention relates to provide an illuminating element, with better illuminating efficiency and better brightness uniformity.

According to one aspect of the present invention, one skilled in the art can achieve the aforesaid goal by providing an illuminating element, comprising a transparent closed casing, an exciting (electroluminescent) illuminating gas, a first exciting coating, and a first dielectric multi-layer long-pass filter. The transparent closed casing has a corresponding first inner side and a first outer side and a corresponding second inner side and a second outer side. And the exciting illuminating gas is disposed in the transparent closed casing, and suitable for providing ultraviolet light. An exciting coating is disposed over the first inner side. And a first dielectric multi-layer long-pass filter is disposed over said second inner side, wherein said first exciting coating is suitable for absorbing ultraviolet light to provide visible light, and the first dielectric multi-layer long-pass filter is suitable for reflecting ultraviolet and allows visible light passing through.

According to another aspect of the present invention, the aforesaid illuminating element further comprises a second exciting coating, said second exciting coating is disposed over said first dielectric multi-layer long-pass filter or said second inner side, and said second exciting coating is closer to the exciting illuminating gas than the first dielectric multi-layer long-pass filter.

According to another aspect of the present invention, the aforesaid illuminating element further comprises a second dielectric optical film, said second dielectric optical film is disposed over the first exciting coating or first outer side, and first exciting coating is closer to the exciting illuminating gas than said second dielectric optical multi-layer filter.

According to another aspect of the present invention, the aforesaid illuminating element further comprises a first reflecting film, said first reflecting film is disposed over said first exciting coating, first outer side or second dielectric optical multi-layer filter, and the first exciting coating is closer to said exciting illuminating gas than the first reflecting film, and said second dielectric optical multi-layer filter is closer to the exciting illuminating gas than the first reflecting film.

According to another aspect of the present invention, the aforesaid illuminating element further comprises a transparent closed outer mask, and a transparent closed casing is disposed within said the transparent closed outer mask, and the transparent closed outer mask having a corresponding third inner side and a third outer side, and the third inner side and first inner side locate at the same side.

According to another aspect of the present invention, the aforesaid illuminating element further comprises a second reflecting film, said second reflecting film is disposed over said third inner side or said third outer side.

To sum up the aforementioned, for the illuminating element disclosed in the present invention, as the dielectric optical multi-layer film can reflect said ultraviolet light to the transparent closed casing such that the exciting coating is illuminated to emit visible light thus the illuminating efficiency and energy utility for the illuminating element can be greatly enhanced. Additionally, the illuminating element in the present invention has a better brightness due to the superficial-illuminating of the film.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention and wherein:

FIGS. 10D~10F are the 3-D perspective views of FIG. 10C and FIG. 10E respectively;

DESCRIPTION OF THE EXEMPLARY EMBODIMENTS

Figure 1:
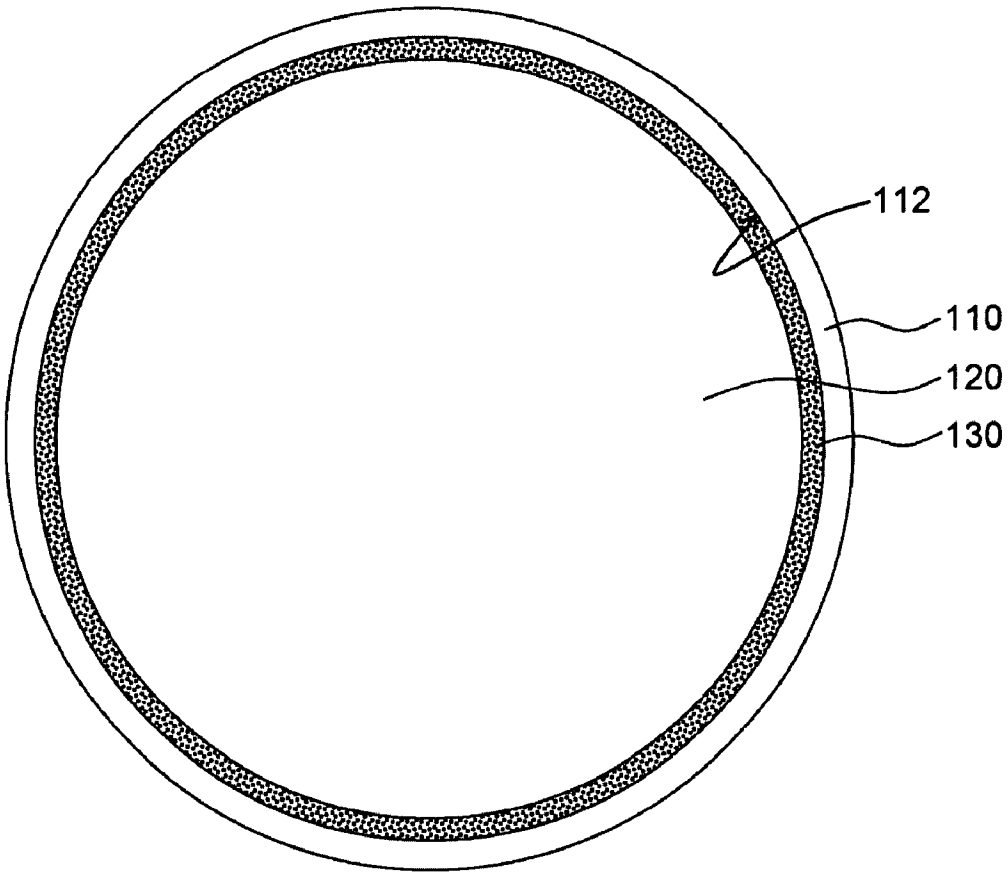
FIG.1 (Prior Art)
FIG. 1 is a sectional view of a conventional illuminating element.

For your esteemed members of reviewing committee to further understand and recognize the fulfilled functions and structural characteristics of the invention, several exemplary embodiments cooperating with detailed description are presented as the follows.

First Embodiment

FIGS. 3A~3D are four sectional views according to the first embodiment of the present invention. Please refer to FIGS. 3A~3D, the illuminating element 300*a*, 300*b*, 300*c* and 300*d* are ditto. Hereby we firstly describe illuminating element 300*a*. The illuminating element 300*a* comprises a transparent closed casing 310, an exciting illuminating gas 320, a first exciting coating 330, and a first dielectric multi-layer long-pass filter 340. Said casing 310 has a corresponding first inner side 312 and a first outer side 314 as well as a corresponding second inner side 316 and a second outer side 318. The exciting illuminating gas 320, however, is disposed within said transparent closed casing 310 and suitable for providing an ultraviolet light 322.

Also, a first exciting coating 330 is disposed over said first inner side 312, and said first dielectric multi-layer long-pass filter 340 is disposed over said second inner side 316, wherein said first exciting coating 330 is suitable for absorbing the ultraviolet light 322 to provide visible light 324, and said first dielectric multi-layer long-pass filter 340 is suitable for said reflecting ultraviolet light 322 and allows said visible light 324 pass through.

Specifically, when said high-voltage electrons hits exciting illuminating gas 320, said exciting illuminating gas 320 will emit ultraviolet light 322, and some of ultraviolet light 322' will shine said first exciting coating 330. When said first exciting coating 330 was stimulated by light 322' it will emit visible light 324', and said 324' can pass through said first dielectric multi-layer long-pass filter 340 and illuminate the exterior side.

In addition, some of ultraviolet light 322" will illuminate said first dielectric multi-layer long-pass filter 340, and said first dielectric multi-layer long-pass filter 340 will reflect ultraviolet light 322" and allow ultraviolet light 322' eventually illuminating said first exciting coating 330. Thus, the ultraviolet light 322" will stimulate the first exciting coating 330 to emit said visible light 322" to illuminate the exterior side.

Because it is fully utilized in the present invention that said ultraviolet light 322 illuminates said first exciting coating 330 to emit said visible light 324, the illuminating element 300*a* has a better illuminating efficiency and energy utilization. In addition, for the illuminating element 300*a*, the superficial illuminating of said film 330 dominates therefore the brightness of the entirety can be enhanced.

In the present embodiment, for example, said first dielectric multi-layer long-pass filter is made up by repeatedly stacking of the dielectric materials of different reflectance. Correspondingly the present invention adjusts the thickness of individual dielectric material (for example, $\lambda/4$, $\lambda$ is light wavelength, or other ratio of $\lambda/a$, "a" can be within the range of 1 to 100) and chooses the dielectric material of appropriate reflectance can enable said first dielectric multi-layer long-pass filter 340 to reflect the light wave of specific waveband and allows the light wave of specific waveband pass though.

As the mentioned above, said first dielectric multi-layer long-pass filter 340 can be represented by one of the cut-off filters, that is, long-pass filter, wherein said first dielectric multi-layer long-pass filter 340 highly reflects ultraviolet light (specific waveband of the wavelength less than 380 nm) and allows visible light (380 nm~780 nm or 400 nm~800 nm) passing through.

A specific Angle of Incidence between ultraviolet light and said first dielectric multi-layer long-pass filter 340 ranged within 0° to 90° as high reflectance. Therefore, the operational angle between ultraviolet light and said first dielectric multi-layer long-pass filter 340 or the same allowing visible light passing through is the bigger the better Overall speaking, the operational angle of the interference filter is relatively small. The operational angle of the illuminating source at 0° incidence is at most ±0° to 15°. In order to achieve the goal of large operational angle, the long-wave filter of different cut-off bands can be of superposition to extend the refractive (cut-off) band, from 0° (vertical incidence) to 15°, 30°, 45°, and 60° etc. Later a Blue Shift will be introduced, that is, the cut-on point will be moved toward the short wave and the curved line is not steep accordingly, however, the long-wave filter of high-refractive stop band of AOI within 0°~90° (at 253.7 nm) can be made as the starting point locates within 380 nm and 400 nm and the operational point (such as mercury) locates within 253.7 nm and 380 nm/400 nm, wherein the high refractive material for coating is dominated by $HfO_2$, Hafnium Dioxide and low refractive material for coating is dominated by $SiO_2$ and $MgF_2$ or other materials can be also used and all the aforementioned can be reasoned by the skilled person without redundant wordings. Furthermore, $LaF_2$, and $MgF_3$ can be chosen for the 184.9 nm-wide AoI reflectance long-wave filter and stack with 253.7 nm LPF together. Namely, if necessary the secondary ultraviolet light can also be reflected in wide AoI.

In addition, the visible light can be of high transmission (and AR is at another side) and the angle of transmission of the visible light (the wave length is selected from the range within 380 nm and 780 nm or within 400 nm~800 nm) can also achieve ±0° to 60° because the out-going beam angle of inner side inside the circular tube is smaller than 90° by a multitude.

Furthermore, said first dielectric multi-layer long-pass filter 340 can further be an omni-directional coating, such as omni-directional long-wave pass filter.

In the first embodiment, said first exciting coating 330 is exemplarily a fluorescent film, however, the present invention does not limit the species of film 330. For example, said first exciting coating 330 can be constituted with phosphorescence film or other appropriate exciting materials.

In addition, said first exciting coating 330 can simultaneously comprise some red, green, and blue tri-phosphors. While said first exciting coating 330 is stimulated by ultraviolet light 322, it will emit correspondingly red light, green light, and blue light and mixes up said red, green and blue light to be a uniformed white light. However, said first exciting coating 330 can be also constituted by single sortfluorescent particles to emit homogeneous visible light or collocate heterogeneous fluorescent particles for the visible light in various colors.

Figure 1B:
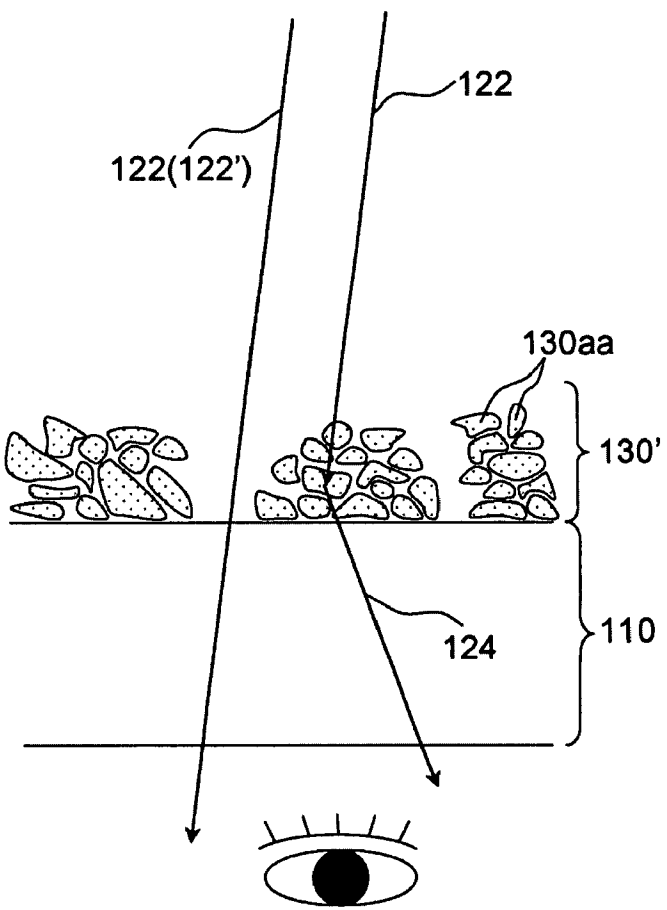
FIG. 1B (Prior Art)
FIG. 1B is a locally enlarged view for another conventional illuminating element.
Figure 1A:
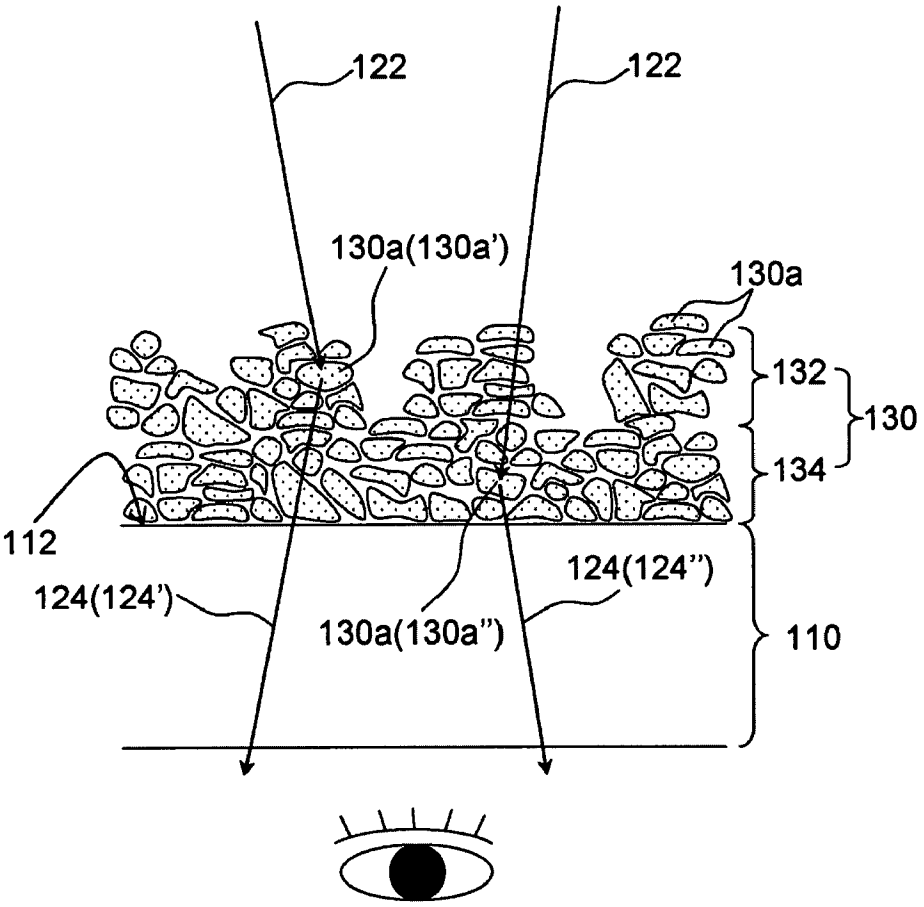
FIG. 1A (Prior Art)
FIG. 1A is a locally enlarged view for FIG. 1.

What is noteworthy is, the present invention does not delimit the thickness of film 330. For example, film 330 can be as thick as disclosed in FIG. 1A as film 130, or can be as thin as disclosed in FIG. 1B as fluorescent film 130'. A different ultraviolet light strength will be corresponding to an optimal fluorescent film thickness. The average thickness of an ordinary conventional 360° spheral fluorescent film, for example as the low-pressured mercury lamp, is within 15 μm~30 μm, however, the average thickness of the single-sided fluorescent film can be within 40 μm~2 mm, thus ultraviolet light can be fully absorbed economically.

To be continued with the aforesaid, the conventional low-pressure mercury lamp manufacturer is working on the trade-off of maximum light output of the lamp tube between the thin thickness of the coated fluorescent and full absorption of ultraviolet light. Nowadays, even for the best daylight lamp, as long as the user picks up the un-electrified daylight lamp to be disposed between the users' eyes and the illuminating source on the ceiling and the user can know how this to be in-the-light, and the transparency for the visible light is still pretty bad even though the thickness of the fluorescent film coating is already as thin as 15 μm~30 μm in average. The trade-off approach achieving the transparency increase of the fluorescent layer without completely absorbing the ultraviolet light is inevitable. Now the present invention provides an element can soundly absorb the ultraviolet light with high transparency, namely the superficially illuminating fluorescent structure wherein the thickness of said fluorescent layer can be thick enough to amply absorb the ultraviolet light and the thickness can be enhanced from 15 μm~30 μm to 40 μm~2 mm to accommodate the different ultraviolet strength.

Figure 2:
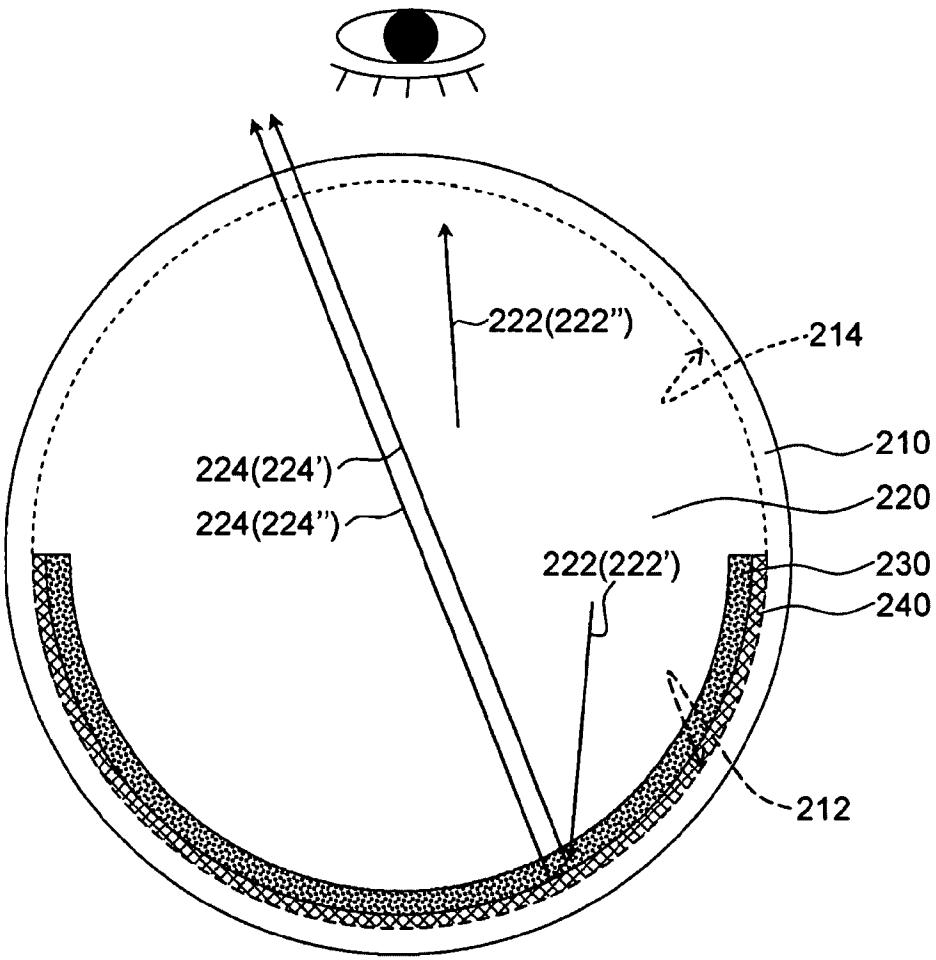
FIG.2 (Prior Art)
FIG. 2 is a sectional view of another conventional illuminating element.

In the present embodiment, said exciting illuminating gas 320, is exemplarily mercurial gas, and the principal waveband for mercurial gas to emit purple light is 253.7 nm, and the secondary wavelength is 184.9 nm as approximately ½ of the principal wavelength such that the high refractive wavelength for purple light can cover the range from 250 nm to 380 or 400 nm and the long-wave filter coating film allowing the visible light which ranges from 380 nm to 780 nm or 400 nm to 800 nm passing through can be applied to this. In addition, if the high refractive material as $HfO_2$ and the low reflectance material as $SiO_2$ or $MgF_2$ and $Na_3AlF_6$ are collocated then the omni-directional long-wave reflectance filter as depicted in FIGS. 2E~2G can be completed.

Figure 3B:
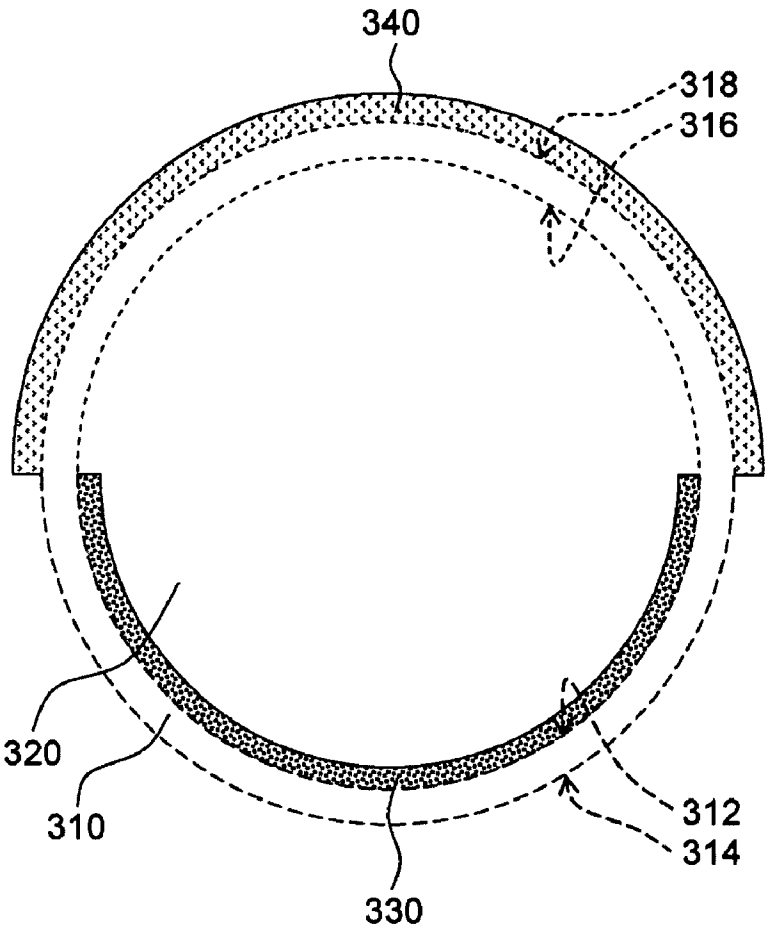
FIGS. 3A~3D are four sectional views according to the first embodiment of the present invention.
Figure 3A:
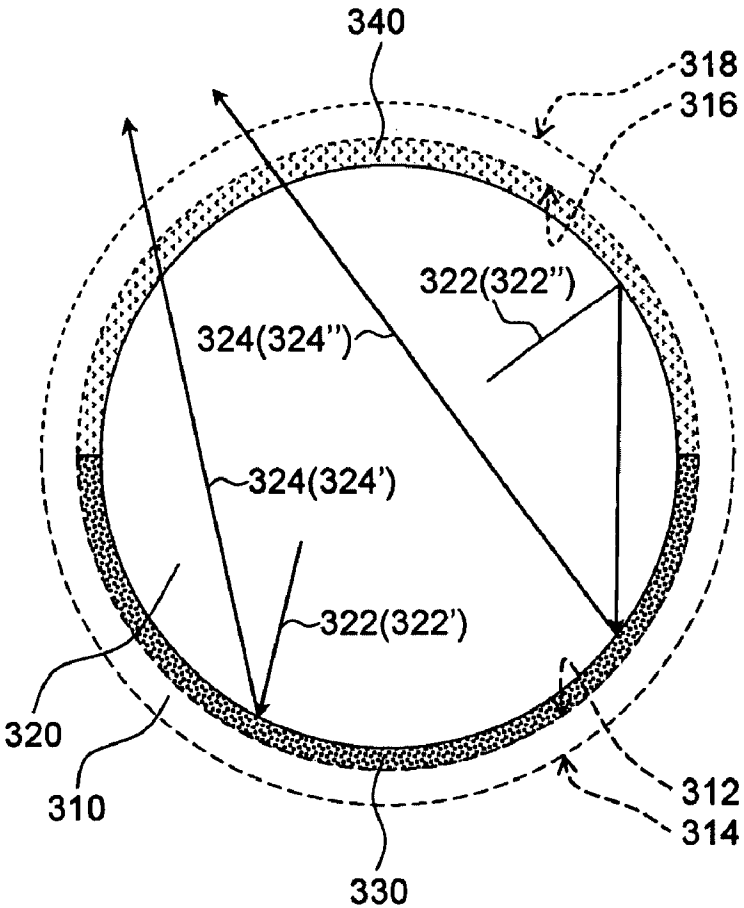
Figure 3D:
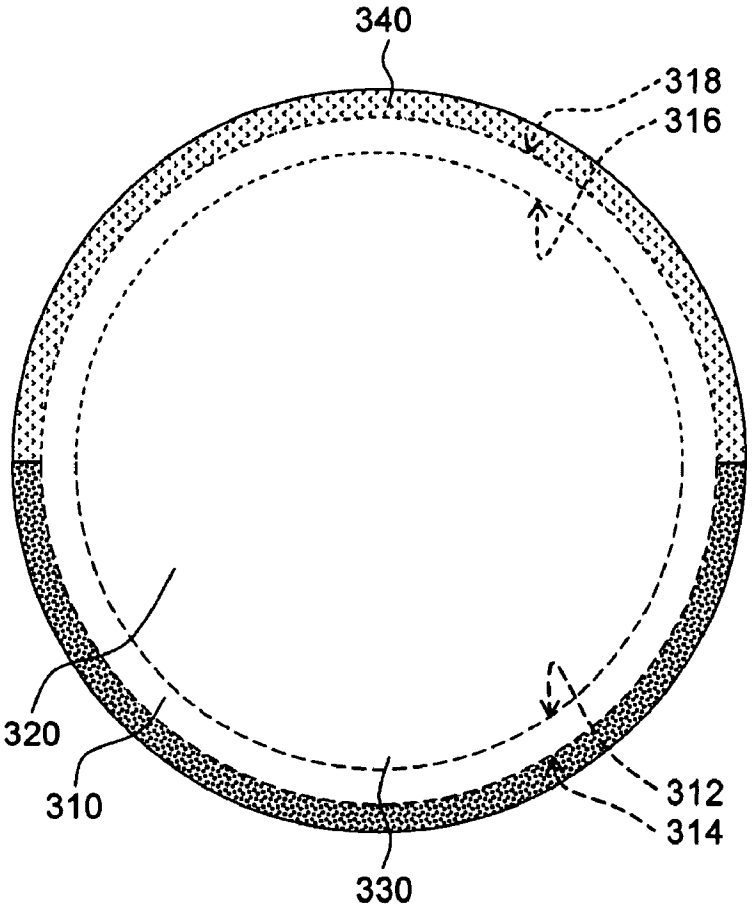
Figure 3C:
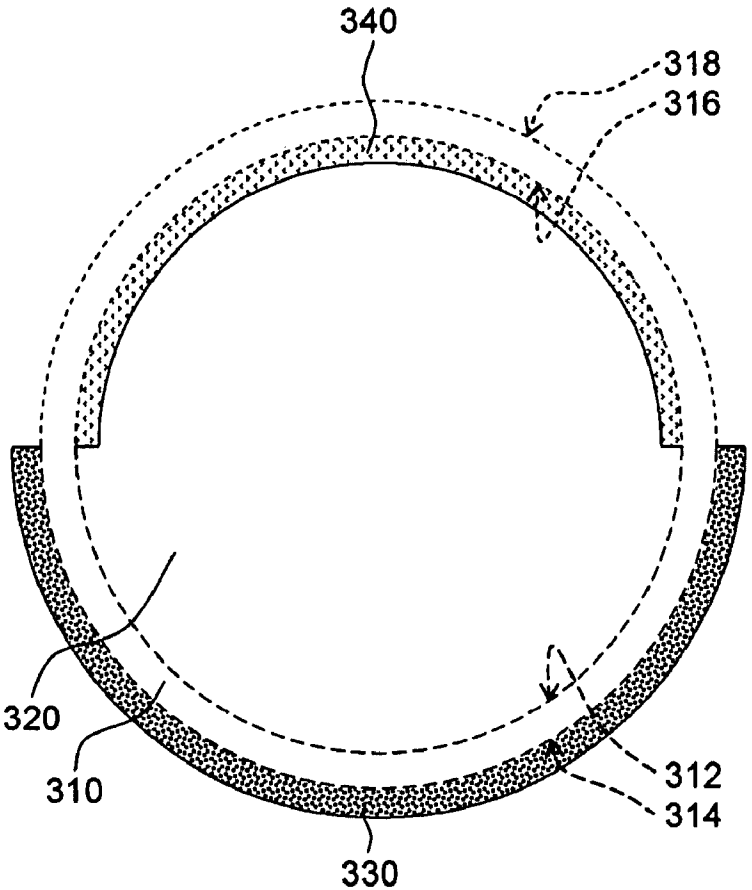
Figure 3E:
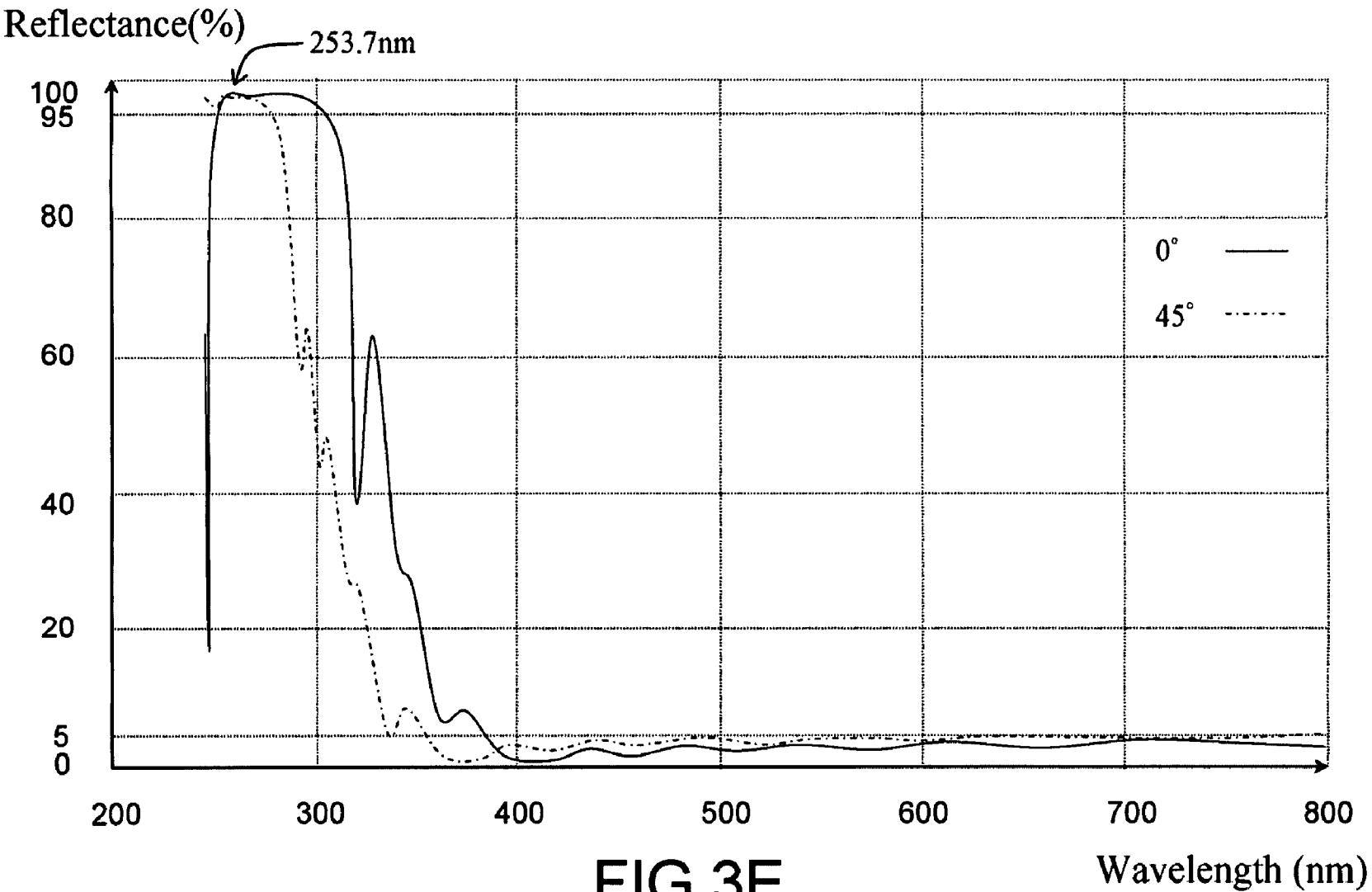
FIGS. 3E~3F are the experimental simulation diagrams of the reflective efficiency of dielectric long-wave optical multi-layer film according to the different wavelengths of first embodiment of the present invention.
Figure 3F:
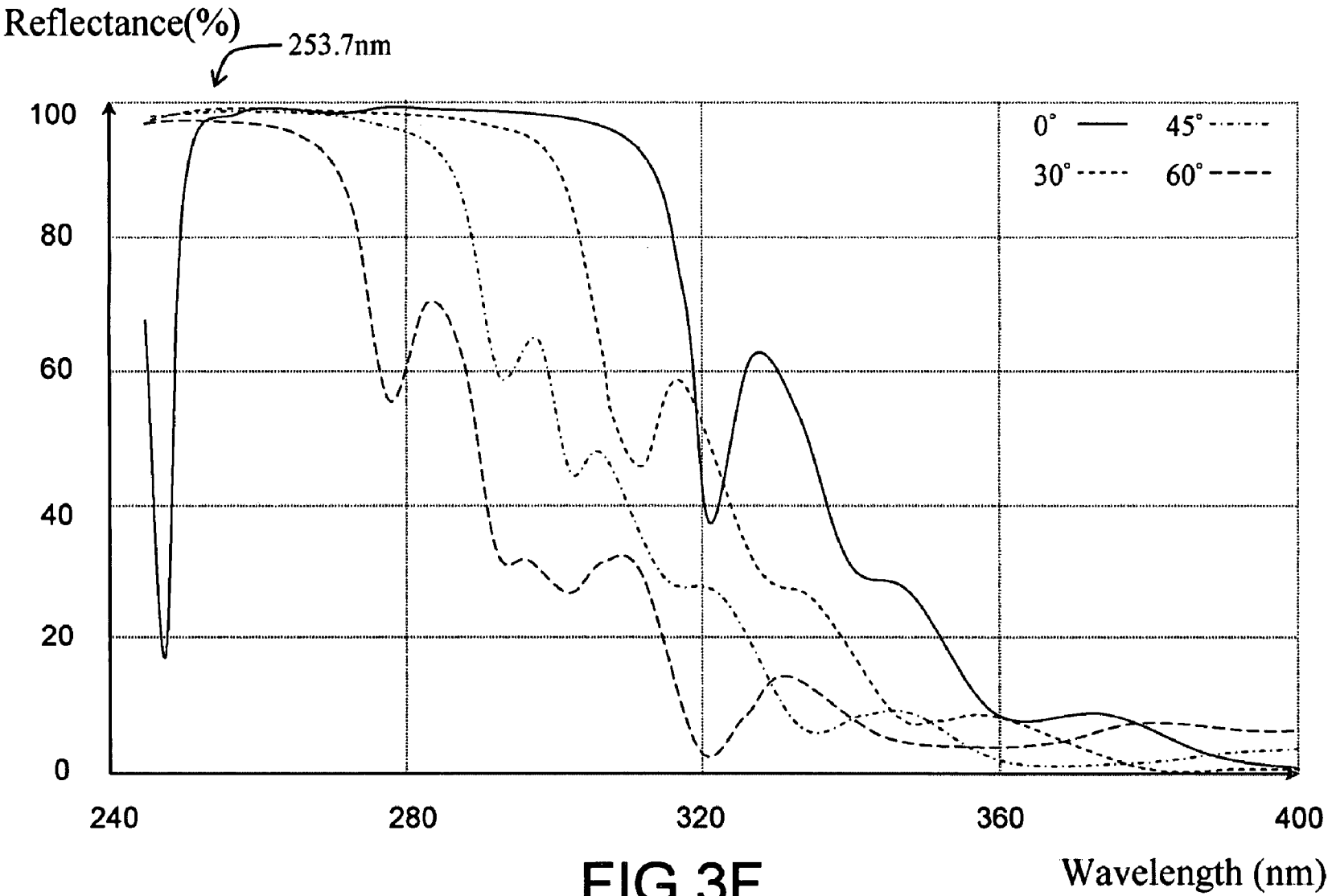
Figure 3G:
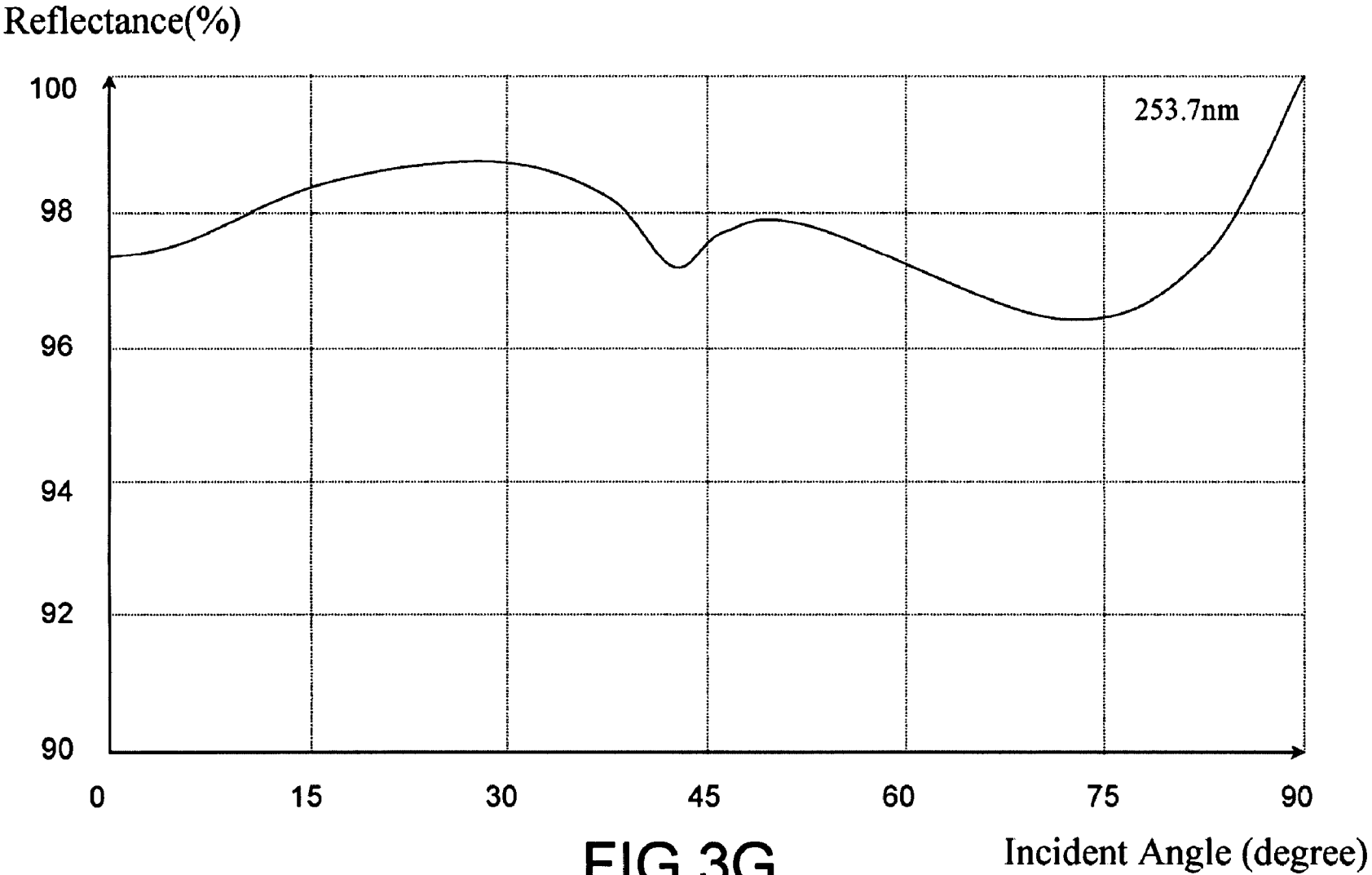
FIG. 3G is the experimental simulation diagram of the reflective efficiency of dielectric long-wave optical multi-layer film according to the different angle of incidence with respect to the wavelength equivalent to 253.7 nm in the first embodiment of the present invention.

Exemplarily, FIGS. 3E~3F are the experimental simulation diagrams of the reflective efficiency of first dielectric long-wave optical multi-layer film according to the different wavelengths of first embodiment of the present invention, and FIG. 3G is the experimental simulation diagram of the reflective efficiency of first dielectric long-wave optical multi-layer film according to the wavelength to be 253.7 nm of first embodiment of the present invention, wherein said first dielectric long-wave optical multi-layer film is the structure of the mutually stacked film of said $HfO_2$ and $SiO_2$.

Please refer to FIG. 3E and FIG. 3F, for either the AoI of the illuminating source is zero degree (Vertical incidence) or the AoI of the illuminating source is thirty, forty-five, or sixty degrees with respect to said first dielectric long-wave optical multi-layer filter 340, said the reflectance of the visible light 324 is approximately below 5% (namely the transmittance is more than 95%), and the reflectance of said ultraviolet light 322 (wavelength is smaller than 380 nm) will increase abruptly particularly when the waveband (the principal waveband of mercury) equals to 253.7 nm, its reflectance (AoI=0 to 90 degrees) will be as high as 95%.

Thus, said first dielectric long-wave optical multi-layer filter 340 is of wide reflectance angle, namely the characteristics of said first dielectric long-wave optical multi-layer filter 340 reflecting ultraviolet light 322 and allowing visible light 322 pass does not delimit the vertical incidence, and the efficiency of the illuminating element 300*a* can also greatly enhanced at high incidence for this superior characteristics.

Because of exciting illuminating gas 320 to be mercury, and the principal waveband of the purple light emitted by said mercurial gas is 253.7 nm (approximately 80% of the total energy), hereby FIG. 3G is specified particularly in the example of the illuminating source of 253.7 nm wavelength. Please refer to FIG. 3G for any AoI of the 253.7 nm wavelength ultraviolet light with respect to said first dielectric long-wave optical multi-layer filter 340, its average reflectance is above approximately 97%. As a result, the assembly of mutually stacked thin firm of the allocation of Hg and HfO2/SiO2 can greatly enhance the efficiency of said illuminating element 300*a*.

The present invention does not delimit the manner for coating such as the ultraviolet reflecting mirror, or the AR coating for visible light transmittance enhancement or of the interference dielectric coating. A manner for as long as the ultraviolet light can be reflected and visible light can be passing through will not be treated departing from the scope and spirit of the present invention. Besides, so-called ultraviolet light is not only referring to a single wavelength but also in the case of superposition of varied-wavelength reflecting zones or the reflecting film for increased angle.

The present invention does not nevertheless delimit the species of exciting illuminating gas 320. For example, said exciting illuminating gas 320 can be constituted with He, Ne, Xe, or other species of appropriate gas. If said exciting illuminating gas 320 is the hybrid gas of Ne and Xe, the principal waveband of emitted purple light 322 is 147 nm, and secondary waveband extends to 173 nm. Thus, the range of the waveband for purple external light source is approximately between 140 nm and 200 nm and allows the visible light ranged between 380 nm and 780 nm passing through.

In addition, exemplarily said casing 310 is composed with glass, quartz glass, transparent ultraviolet light material, or other transparent material and hereby the present invention does not delimit thereto.

Please further refer to FIGS. 3A~3D, illuminating elements 300*b*, 300*c*, 300*d*, and 300*a* are ditto. The difference between film 330 and film 340 is their different disposition. In FIG. 3B, said first exciting coating 330 is disposed over first inner side 312, and film 340 is disposed over said second outer side 318. In FIG. 3C, said first exciting coating 330 is disposed over said first outer side 314 and said first dielectric multi-layer long-pass filter 340 is disposed over said second dinner side 316. In FIG. 3D, said first exciting coating 330 is disposed over said first outer side 314, and said first dielectric multi-layer long-pass filter 340 is disposed over said second outer side 318.

Similar to the aforementioned causes, illuminating elements 300*b*, 300*c*, and 300*d* also have a better illuminating efficiency and energy utilization. One skilled in the art can base upon the actual demand to adjust the disposed position and area ratios for film 330 and film 340 without departing from the present invention.

For further enhance the optical characteristics of said illuminating elements, the present invention further makes improvement upon the aforementioned illuminating element 300*a*, 300*b*, 300*c* and 300*d*. A detailed description will be further supplemented together with the drawings as the follows. In addition, for convenience the elements of the identical function will still follow the same symbols.

Second Embodiment

Figure 4A:
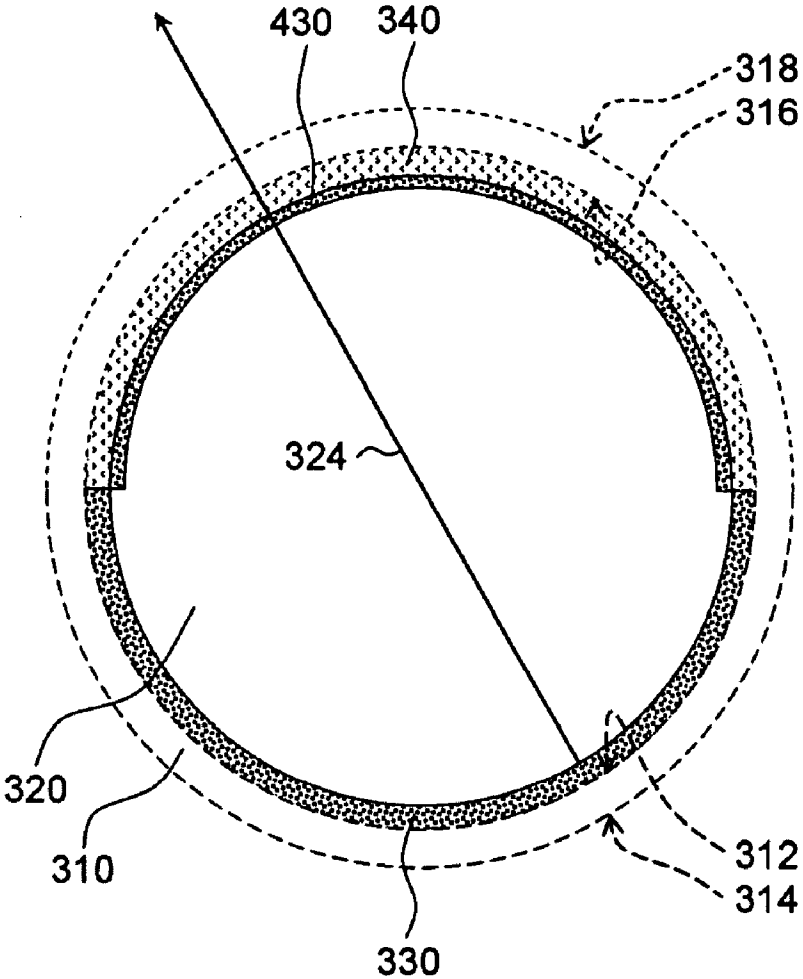
FIGS. 4A~4C are three sectional views according to the second embodiment of the present invention.

FIG. 4A is a sectional view of the illuminating element according to the second embodiment of the present invention. Please refer to FIG. 4A; the illuminating element 400*a* in the present embodiment and 300*a* in the previous embodiment are ditto. Their difference is that said illuminating element 400*a* further comprises a second exciting coating 430, and said second exciting coating 430 is disposed over said first dielectric multi-layer long-pass filter 340 and said second exciting coating 430 is closer to said exciting illuminating gas 320 than said first dielectric multi-layer long-pass filter 340. Specifically, said first dielectric multi-layer long-pass filter 340 is disposed within said second exciting coating 430 and said second inner side 314.

To be continued with the aforementioned, said second exciting coating 430 and film 330 can be made of the same material to further enhance the illuminating brightness of said illuminating element 400*a*. In the present embodiment, said second exciting coating 430 is thinner than film 330 such that during the process for visible light 324 passing through film 430 the energy lose can be avoid. However, the present invention does not delimit the thickness of said second exciting coating 430, and the thickness of film 330 and the thickness of film 430 are further determined according to the actual demand.

What is noteworthy is, the concept of extra film 430 is not only for illuminating element 300*a* (as depicted as FIG. 3A), similarly, it is also suitable for improved illuminating element 300*b*, 300*c*, and 300*d* (as depicted as FIGS. 3B, 3C, and 3D). Hereby the present invention will further illustrate element 300*b* and one skilled in the art can reference upon said description and further associate with 300*c* and 300*d*.

Figure 4C:
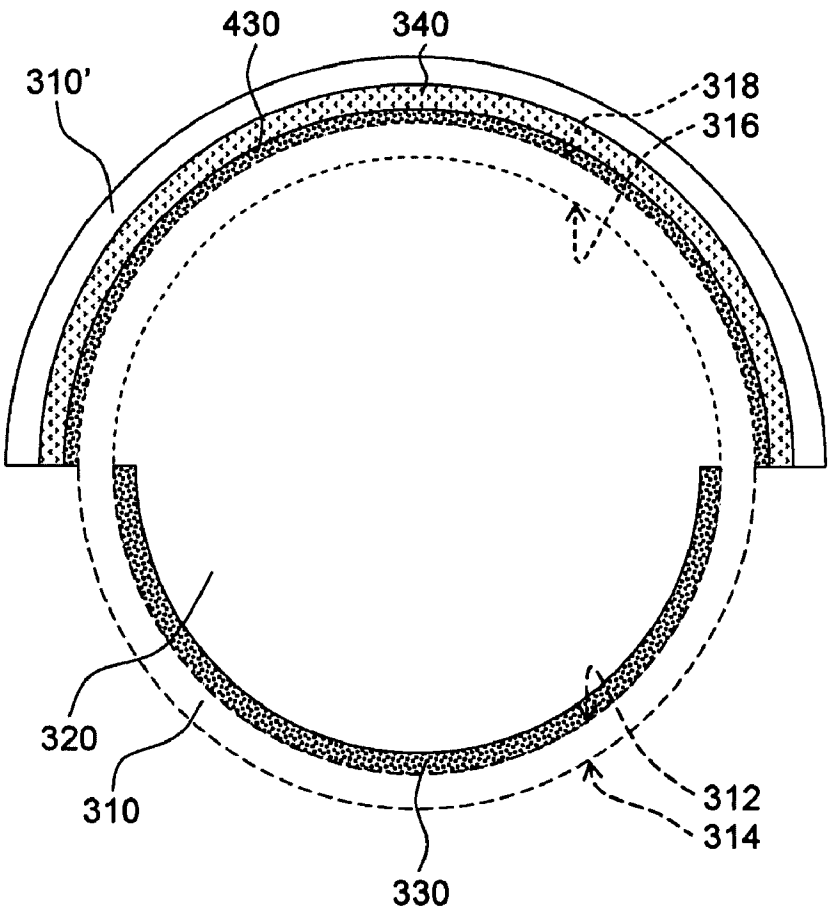
Figure 4B:
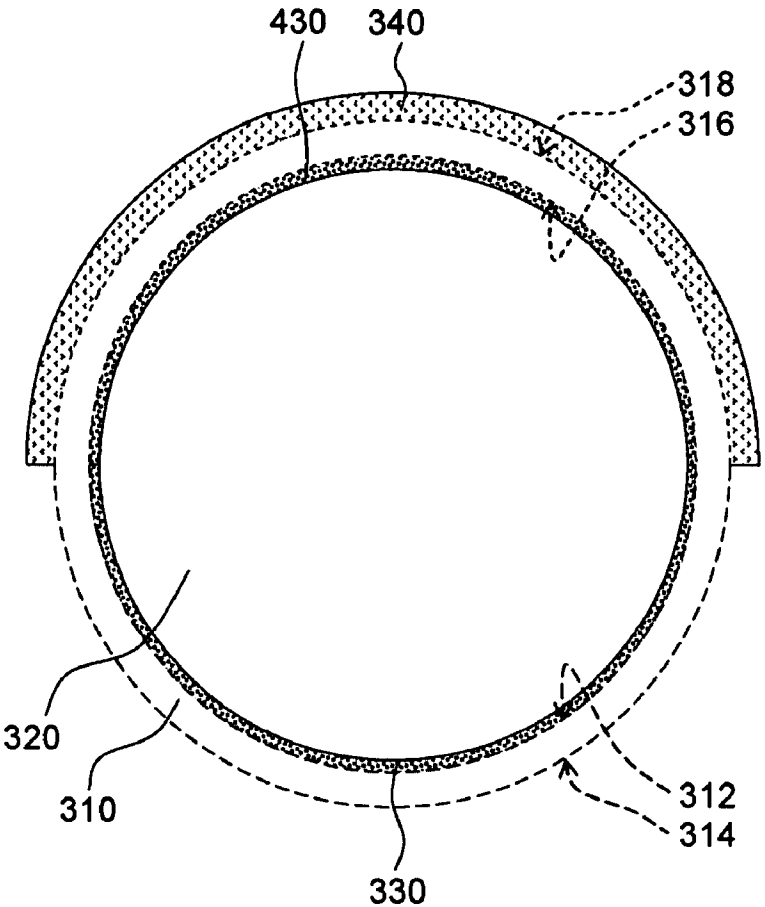

FIGS. 4B~4C are another two sectional views of the illuminating element according to the second embodiment of the present invention. Please refer to FIGS. 4B~4C, element 400*b* and element 400*c* and element 300*b* (as depicted in FIG. 3B) are ditto but the different between them is that element 400*b* and 400*c* further comprises the film 430.

In FIG. 4B, said second exciting coating 430 is disposed over said second inner side 316, and film 430 is closer to gas 320 than film 340. Additionally, the thickness of film 330 over said illuminating element 400*b* and the thickness said second exciting coating 430, are identical such that a better illuminating quality can be achieved.

In FIG. 4C, said second exciting coating 430 is disposed over said first dielectric multi-layer long-pass filter 340. Specifically speaking, said second exciting coating 430 is disposed within said first dielectric multi-layer long-pass filter 340 and said second outer side 318.

What is noteworthy is, particularly during the manufacturing process of said illuminating element 400*c*, said first dielectric multi-layer long-pass filter 340 can be firstly coated on an independent transparent glass piece 310', and said second exciting coating 430 takes shape on said second outer side 318 and said first dielectric multi-layer long-pass filter 340 keeps against said second exciting coating 430. One skilled in the art can easily comprehend and hereby no extra wordings will be given.

Third Embodiment

Figure 5A:
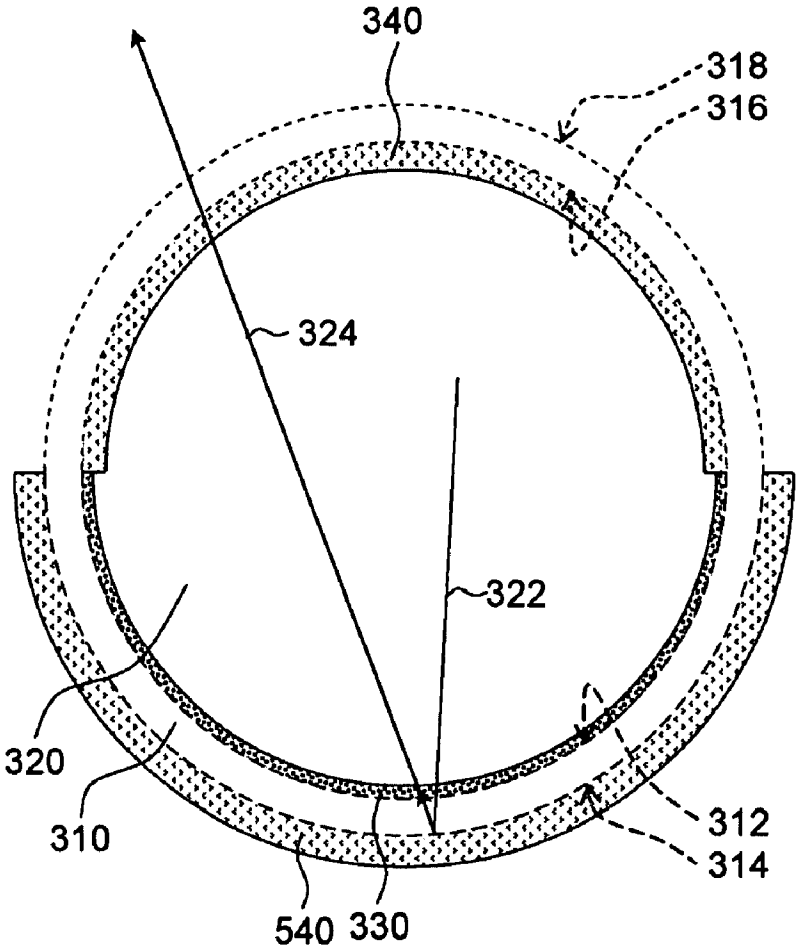
FIGS. 5A~5C are three sectional views according to the third embodiment of the present invention.

FIG. 5A is the sectional view of one of the illuminating element according to the third embodiment in the present invention. Please refer to FIG. 5A, the illuminating element 500*a* in the present embodiment and said illuminating element 300*a* (as depicted in FIG. 3A) of the previous embodiment are ditto but said illuminating element 500*a* further comprises a second dielectric optical multi-layer filter 540, and said second dielectric optical multi-layer filter 540 is disposed over said first outer side 314, and said first exciting coating 330 is closer to said exciting illuminating gas 320 than said second dielectric optical multi-layer filter 540.

To be continued with the aforementioned, said second dielectric optical multi-layer filter 540 and said first dielectric multi-layer long-pass filter 340 can be of the same material. After said ultraviolet light 322 passing through said first exciting coating 330, said light 322 can be reflected via said second dielectric optical multi-layer filter 540 to said first exciting coating 330, or again reflected to said first exciting coating 330 via said first dielectric multi-layer long-pass filter 340 to stimulate said first exciting coating 330 to emit said visible light 324.

What is noteworthy is, the concept for adding film 540 in the present embodiment does not delimit to the element 300*a* (as depicted in FIG. 3A), and the improved configuration of said illuminating element 300*a*, 300*c* (as depicted in FIG. 3A, 300C) will be further illustrated.

Figure 5C:
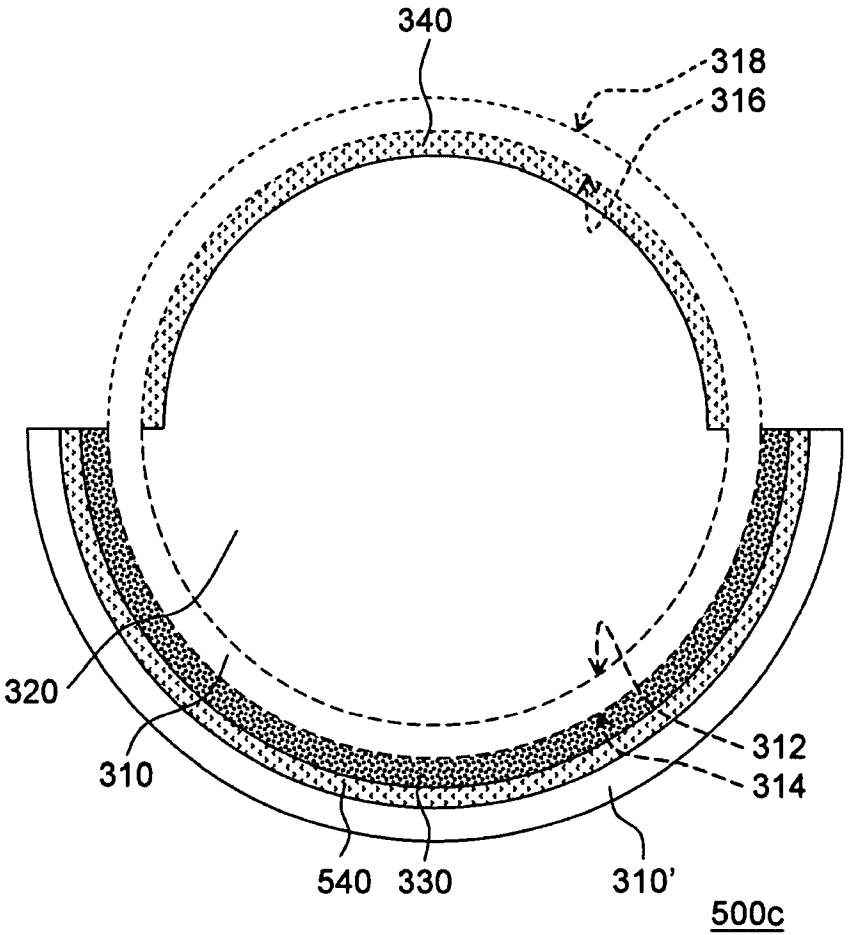
Figure 5B:
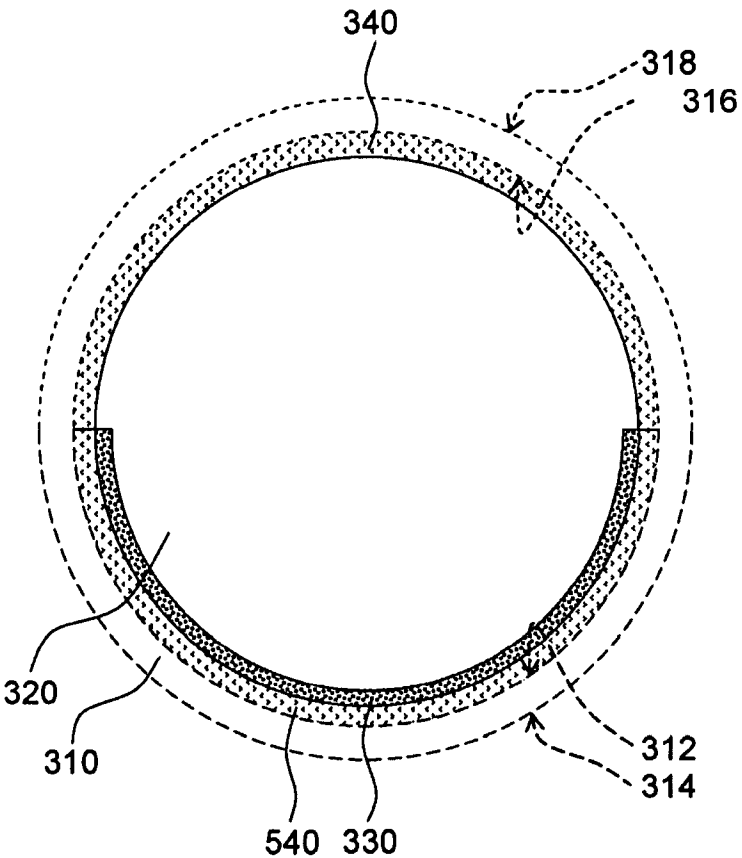

FIGS. 5B~5C are another two sectional views of the third embodiment according to the present invention. Please refer to FIGS. 5B~5C, said illuminating element 500*b* in the present embodiment and said illuminating element 300*a* (as depicted in FIG. 3A) in the previous embodiment are ditto, and said illuminating element 500*c* and said illuminating element 300*c* (as depicted in FIG. 3C) in the previous embodiment are ditto. Their difference, however; is that said illuminating element 500*b* and said illuminating element 500*c* further comprise said second dielectric optical multi-layer filter 540, wherein said second dielectric optical multi-layer filter 540 is disposed over said first exciting coating 330, and said first exciting coating 330 is closer to said exciting illuminating gas 320 than said second dielectric optical multi-layer filter 540.

Specifically, in FIG. 5B, said second dielectric optical multi-layer filter 540 is disposed within said first exciting coating 330 and said first inner side 312. In FIG. 5C, said first exciting coating 330 is disposed within said second dielectric optical multi-layer filter 540 and said first outer side 314.

Similar to the aforementioned causes, particularly during the manufacturing process of said illuminating element 500*c*, said second dielectric optical multi-layer filter 540 can be firstly coated on an independent transparent glass piece 310', and said first exciting coating 330 takes shape on said first outer side 314 and said second dielectric optical multi-layer filter 540 keeps against said first exciting coating 330.

The aforementioned already illustrated said 500*a*, 500*b*, and 500*c* as an example by supplementing said second dielectric optical multi-layer filter 540, and suggested one skilled in the art can apply the concept according to the present embodiment to all illuminating elements with said first and said second embodiments such that no extra wordings will be mentioned hereby.

To further enhance the optical characteristics of said illuminating elements, the present invention further makes improvements on all of the illuminating elements for all previous embodiments. The further illustrations will be accompanied with the drawings as the follows.

Fourth Embodiment

Figure 6A:
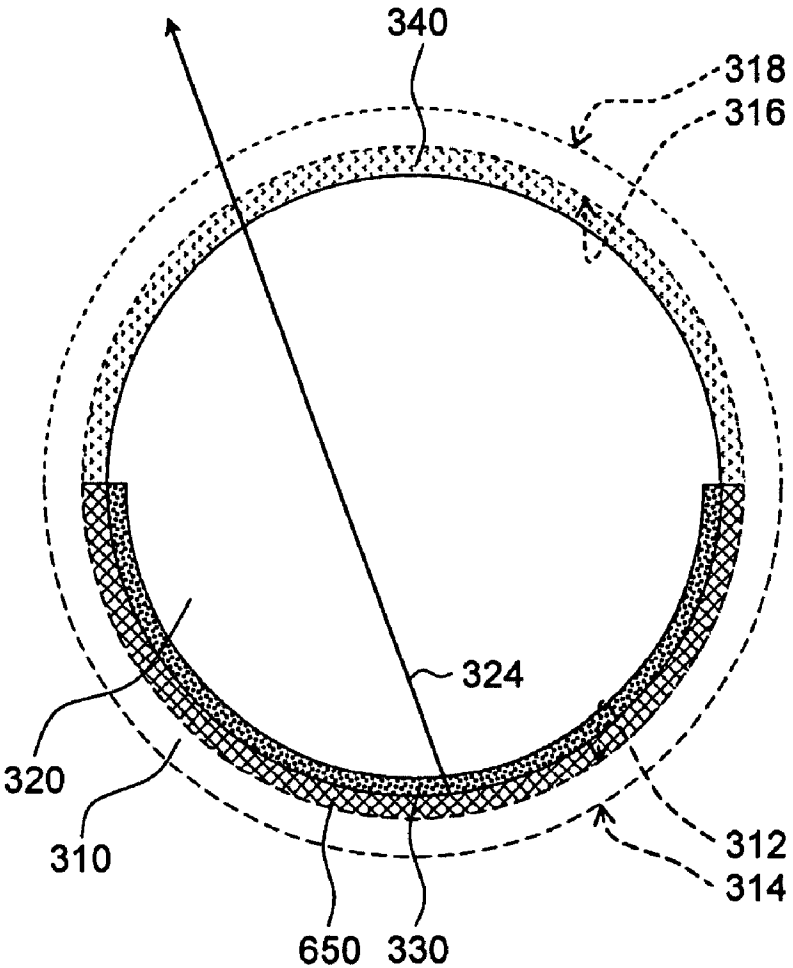
FIGS. 6A~6D are four sectional views according to the fourth embodiment of the present invention.

FIG. 6A is a sectional view according to the fourth embodiment of the present invention. Please refer to FIG. 6A, an illuminating element 600*a* in the present embodiment and said illuminating element 300*a* (as depicted in FIG. 3A) are ditto, but the difference is that said illuminating element 600*a* further comprise a first reflecting film 650, and said first reflecting film 650 is disposed over said first exciting coating 330, and said first exciting coating 330 is closed to said exciting illuminating gas 320 than said first reflecting film 650. Specifically, said first reflecting film 650 is disposed within said first exciting coating 330 and said first inner side 312.

To be continued with the aforementioned, some part of visible light 324 emitted from said first exciting coating 330 is illuminating downward, and said first reflecting film 650 reflect upwardly said visible light 324 and ultraviolet light (not depicted in the drawings) such that said light 324 pass through said first dielectric multi-layer long-pass filter 340 and illuminates the exterior side. Thus, the present invention further soundly utilize said visible light 324 to illuminate the exterior side in such a way the illuminating efficiency of said illuminating element 600*a* can be further enhanced.

In the present embodiment said first reflecting film 650 is exemplarily made of aluminum, and said first reflecting film 650 can reflect visible light as well as ultraviolet light. However, the present invention does not delimit the material species of said first reflecting film 650 and said first reflecting film 650 can solely reflect visible light or ultraviolet light.

What is noteworthy is that the concept of supplementing film 650 does not delimit to said illuminating element 300*a* (as depicted in FIG. 3A). Hereby the present invention will further specify the improved configuration together with the corresponding drawings for said illuminating element (as depicted in FIGS. 3A, 3C).

Figure 6C:
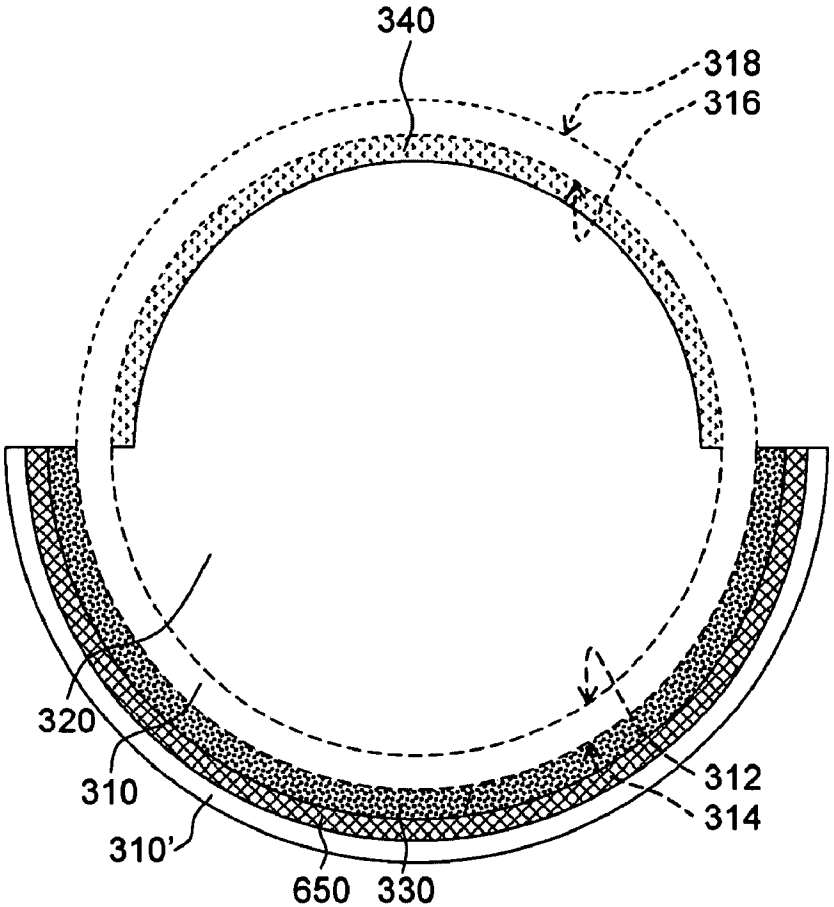
Figure 6B:
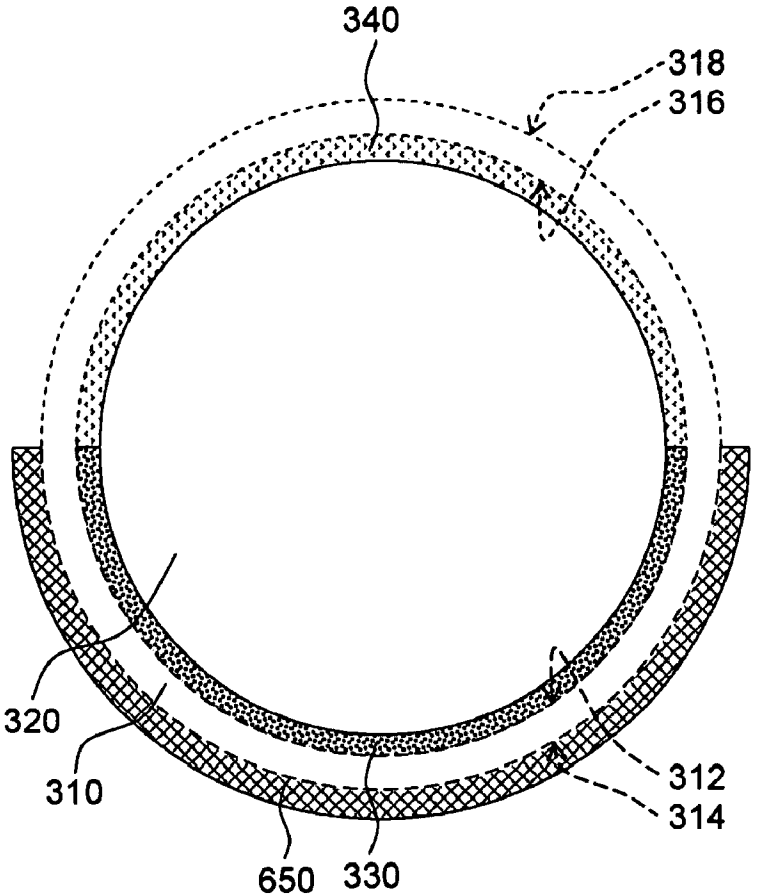

FIGS. 6B~6C are another two sectional views according to the fourth embodiment of the present invention. Please refer to FIGS. 6B~6C, said illuminating element 600*b* disclosed in the present embodiment and said illuminating element 300*a* (as depicted in FIG. 3A) in the previous embodiment are ditto, but their difference is that said illuminating element 600*b*, 600*c* further comprise said first reflecting film 650.

In FIG. 6B, said first reflecting film 650 is disposed over said first outer side 314 and said first exciting coating 330 is closer to gas 3 than said first reflecting film 650.

In FIG. 6C, said first reflecting film 650 is disposed over said side 330. Specifically, said first exciting coating 330 is disposed within said first reflecting film 650 and said first outer side 314.

As disclosed in the aforesaid, during the manufacturing process of said illuminating element 600*c*, said first reflecting film 650 can be firstly coated on an independent transparent glass piece 310', and said first exciting coating 330 takes shape on said first outer side 314 and said first reflecting film 650 keeps against said 330.

The previous specification already suggests said illuminating element 600*a*, 600*b*, 600*c* to describe the concept of adding said first reflecting film 650 in the fourth embodiment and one skilled in the art can refer to the aforesaid to carry out and can extend the concept to said illuminating elements disclosed in said first, second and third embodiment. Hereby we will instantiate another example to specify how said second dielectric optical multi-layer filter 540 in the third embodiment and said first reflecting film 650 in fourth embodiment can be combined as the follows without redundant wordings on the rest.

Figure 6D:
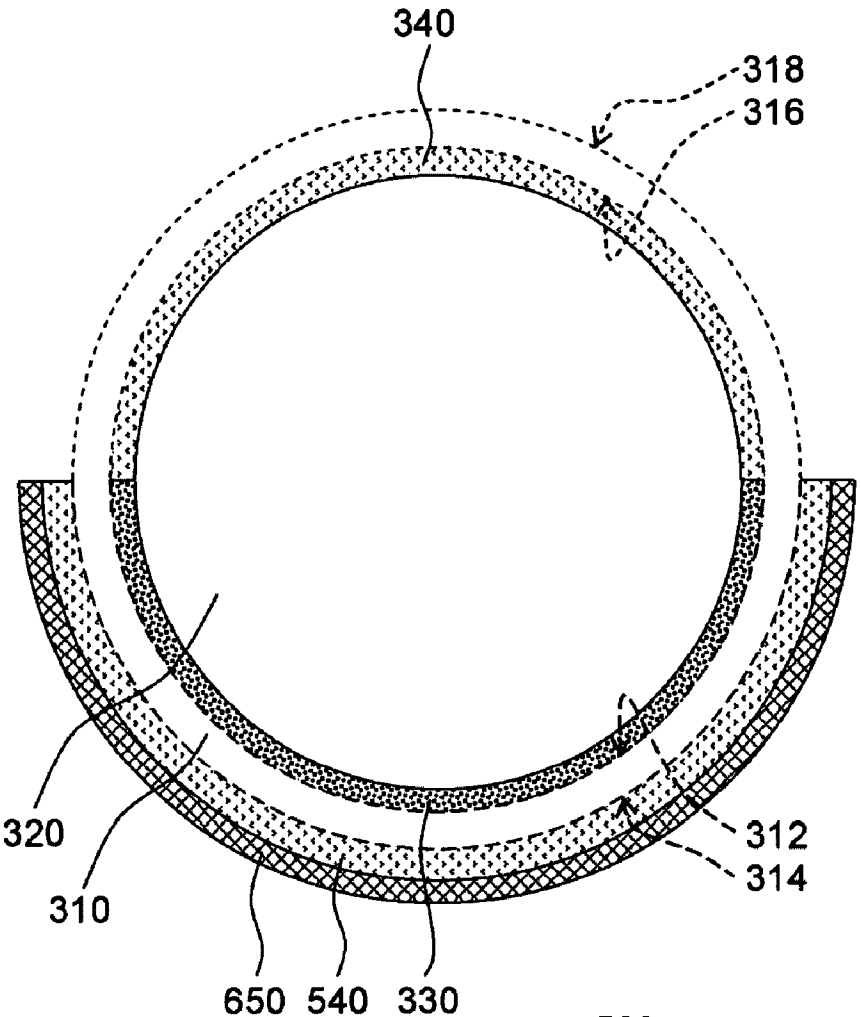

FIG. 6D is still another sectional view according to the fourth embodiment of the present invention. Please refer to FIG. 6D, said illuminating element 600*d* disclosed in the present embodiment and 500*a* (as depicted in FIG. 5A) in the previous embodiment are ditto but 600*d* further comprise said first reflecting film 650, and said 650 is disposed over said second dielectric optical multi-layer filter 540, and said second dielectric optical multi-layer filter 540 is closer to gas 320 than said first reflecting film 650. Specifically, said second dielectric optical multi-layer filter 540 is disposed within said first reflecting film 650 and said first outer side 314.

What is emphasized is, as said illuminating element 600*d* simultaneously comprises said second dielectric optical multi-layer filter 540 and said first reflecting film 650, the corresponding position of said first exciting coating 330 and said second dielectric optical multi-layer filter 540 for said first inner side 312 and side 314 are not delimited by the present invention thereto.

In other word, the limitation disclosed in the present invention is to request said first exciting coating 330 is closed to said exciting illuminating gas 320 than said second dielectric optical multi-layer filter 540, and said second dielectric optical multi-layer filter 540 is closer to said exciting illuminating gas 320 than said first reflecting film 650. One skilled in the art can easily comprehend the configuration and nothing extra will be further mentioned.

In many of the previous embodiment, the present invention can further introduce a transparent closed outer mask to surround said transparent closed casing, hereby a more detailed description will be given accompanied with the drawings.

Figure 7A:
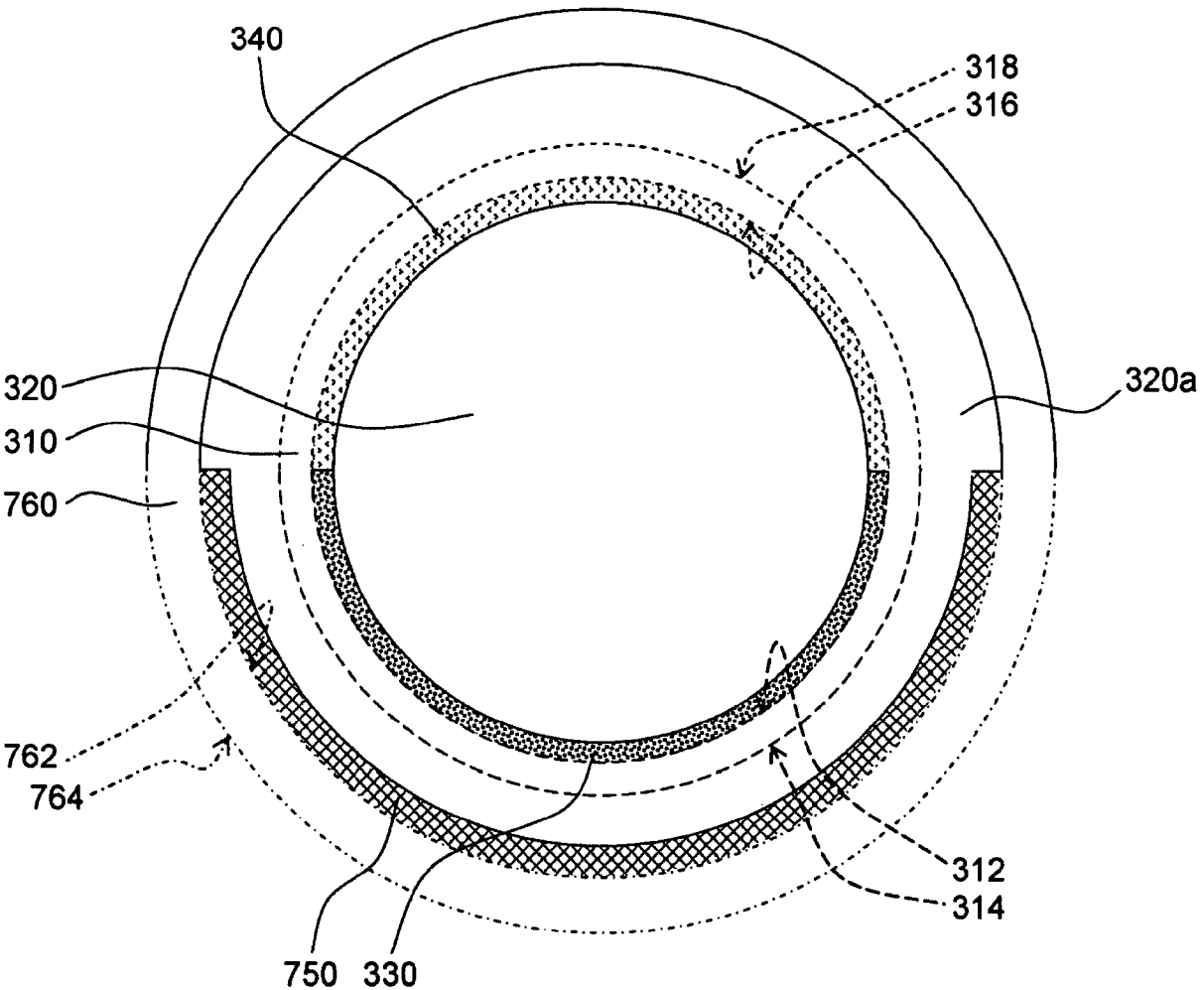
FIG. 7A is one of the sectional views according to the fifth embodiment of the present invention.

FIG. 7A is a sectional view of the illuminating element according to the fifth embodiment of the present invention. Please refer to FIG. 7A; an illuminating element 700*a* in the present embodiment and 300*a* (as depicted in FIG. 3A) in the previous embodiment are ditto. Their difference is that said illuminating element 700*a* further comprises a transparent closed outer mask 760, and said casing 310 is disposed inside said transparent closed outer mask 760, wherein said transparent closed outer mask 760 can protect said casing 310 from external collision thus the corresponding damage to said illuminating element 700*a* can be alleviated.

In addition, if said casing 310 is a glass pervious to ultraviolet light (such as quartz glass), its thermal expansion index is usually lower, however, the same for ordinary glass package metal is higher. The stamina for ordinary quartz tube is shorter because the expansion index difference will lead to leakage. To overcome the drawback introduced by index difference, skilled person usually uses high expansion index glass to be for said transparent closed outer mask 760 such that its duration is longer.

The aforementioned already introduced the concept of supplementing said transparent closed outer mask 760 by said illuminating element 700*a* as an example in the fifth embodiment, one skilled in the art can refer to the previous description of the present invention to be applied to all illuminating elements disclosed in first to fourth embodiments and no extra wordings will be spent.

Turning up to again FIG. 7A, said transparent closed outer mask 760 further comprises a corresponding third inner side 762 and third outer side 764, wherein said third outer side 762 located at the same side with said first inner side 312. Additionally, said illuminating element 700*a* further comprises a second reflecting film 750, and said second reflecting film 650 is disposed over said third inner side 762. Also, said second reflecting film 650 can also be disposed over said outer side 764, it is up to the actual demand during the design.

Also, for said transparent closed outer mask 760, the similar concept of film 540 in the third embodiment of the present invention also can be applied to said transparent closed outer mask 760. One skilled in the art can easily derive further variations and nothing else will be redundantly mentioned thereto.

Figure 7B:
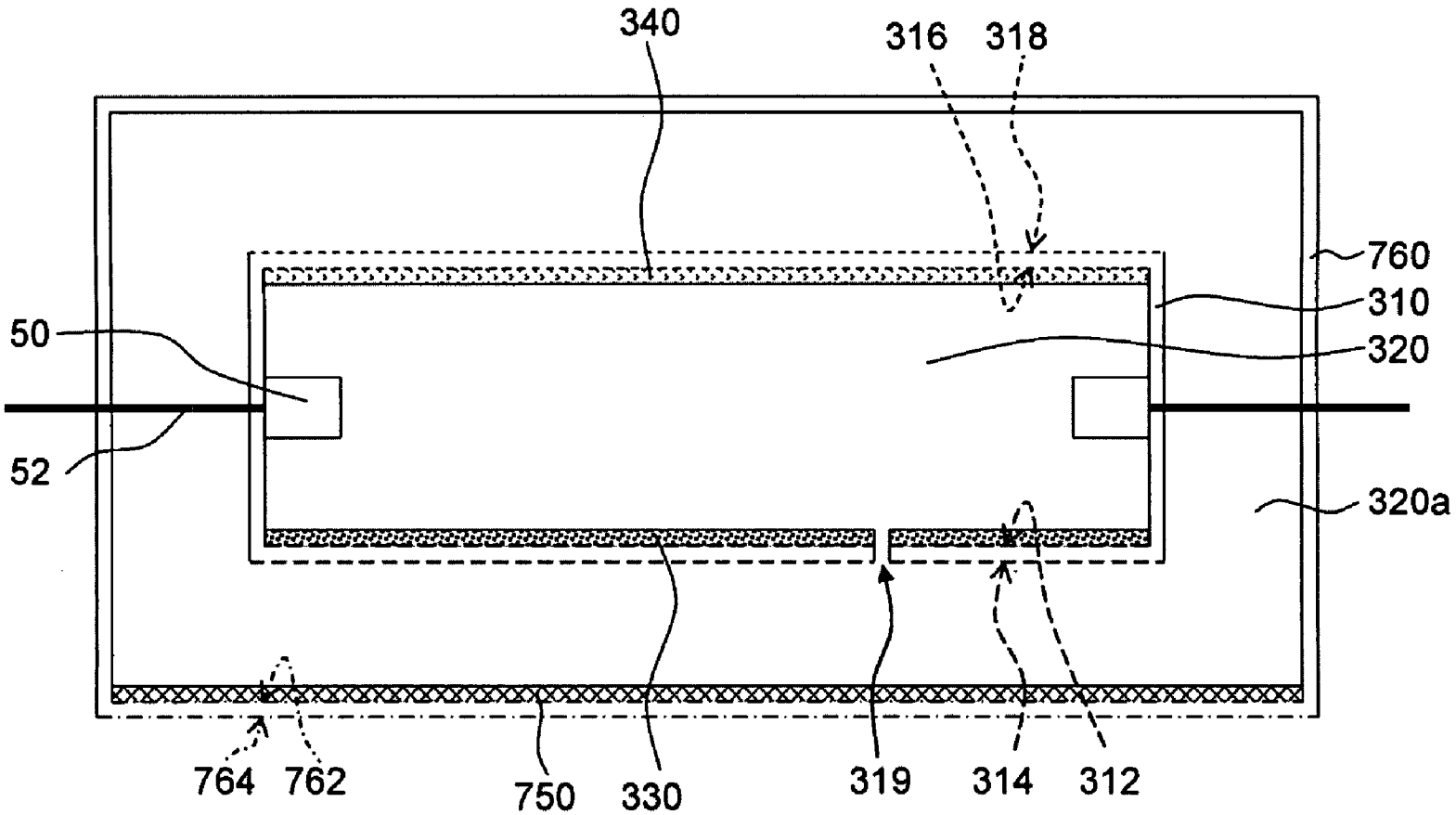
FIG. 7B is one of the sectional views of FIG. 7A at another viewpoint.

FIG. 7B is the sectional view of said illuminating element in FIG. 7A in different angle. Please refer to FIG. 7A and FIG. 7B, said exciting illuminating gas 320 is disposed within said casing 310, and emits an ultraviolet light after a high voltage stimulation via a pole terminal 50 and a transmission line 52. In the present embodiment, said casing 310 further comprise an aperture 319 and said illuminating element 700*a* further comprises an auxiliary exciting illuminating gas 320*a*, wherein said exciting illuminating gas 320*a* is disposed within said casing 310 and said outer mask 760.

To be continued with the aforementioned, when said exciting illuminating gas 320 in said casing 310 steadily leaks, said auxiliary gas 320*a* can permeate said casing 310 via said aperture 319 for supplement said exciting illuminating gas 320.

In the present embodiment, said illuminating element 700*a* can further comprise an outer mask 760, but the present invention can further disposed a transparent closed hull inside said casing 310. Hereby another example will be further illustrated and accompanied by the drawings.

Sixth Embodiment

Figure 8A:
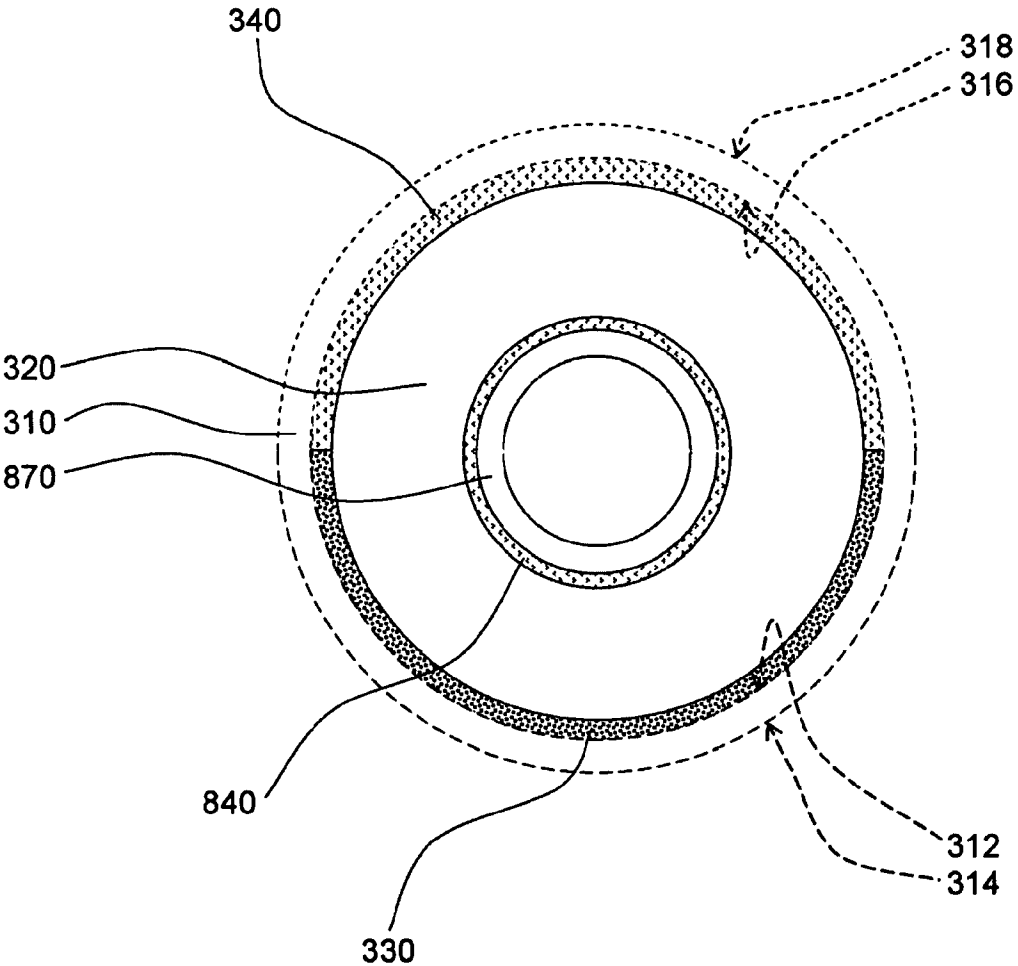
FIG. 8A is one of the sectional views according to the sixth embodiment of the present invention.

FIG. 8A is a sectional view of the illuminating element according to the sixth embodiment of the present invention. Please refer to FIG. 8A, the illuminating element 800*a* of the present embodiment and said illuminating element 300*a* disclosed in previous embodiment are ditto, but their difference is that said illuminating element 800*a* further comprise a transparent closed inner hull 870, and said transparent closed inner hull 870 is disposed inside said casing 310, and said exciting illuminating gas 320 is disposed within said casing 310 and said transparent closed inner hull 870.

The aforesaid already illustrated the six embodiment by the example of said illuminating element 800*a*, one skilled in the art can base upon the concept disclosed in the present embodiment to extend to all illuminating elements disclosed in the first to fifth embodiment and hereby nothing else will be redundantly mentioned.

Please refer to FIG. 8A, said illuminating element 800*a* further comprises a third dielectric optical multi-layer film 840, and said third dielectric optical multi-layer film 840 is disposed over said transparent closed inner hull 870. In the present embodiment, the film 840 is disposed over the outer side of transparent closed inner hull 870 however it can be also disposed over the inner side of transparent closed inner hull 870 according to the actual demand for the design.

Also, because said exciting illuminating gas 320 in said 800*a* of the present embodiment is stimulated to illuminating between said casing 310 and said transparent closed inner hull 870, as a result for said transparent closed inner hull 870, the present invention can also dispose an exciting illuminating gas (not depicted in the drawings) inside said transparent closed inner hull 870 to supplement the consumed gas 320. One skilled in the art can easily be suggested for variations therefore nothing else will be redundantly mentioned thereto.

Also, despite in the previous embodiments, the shapes of said transparent closed casings, said transparent closed outer masks and said transparent closed hulls are all made in the circular tube, however, the present invention does not delimit to the tube shape. The geometric shapes of said transparent closed casings, said transparent closed outer masks and said transparent closed hulls such as square, rectangular, semi-circle, and triangle will not depart from the scope of the present invention. Hereby another embodiment will be illustrated together with the drawings.

Seventh Embodiment

Figure 9B:
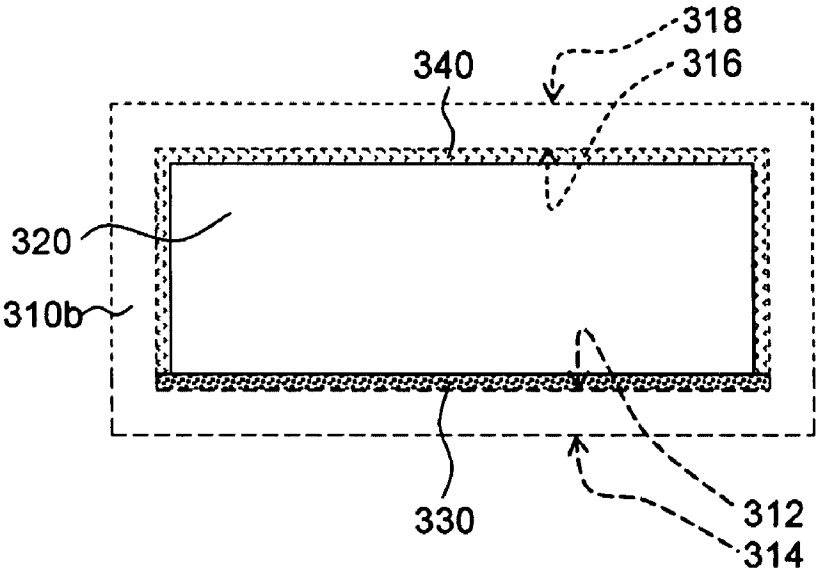
FIGS. 9A~9J are ten sectional views according to the seventh embodiment of the present invention.
Figure 9A:
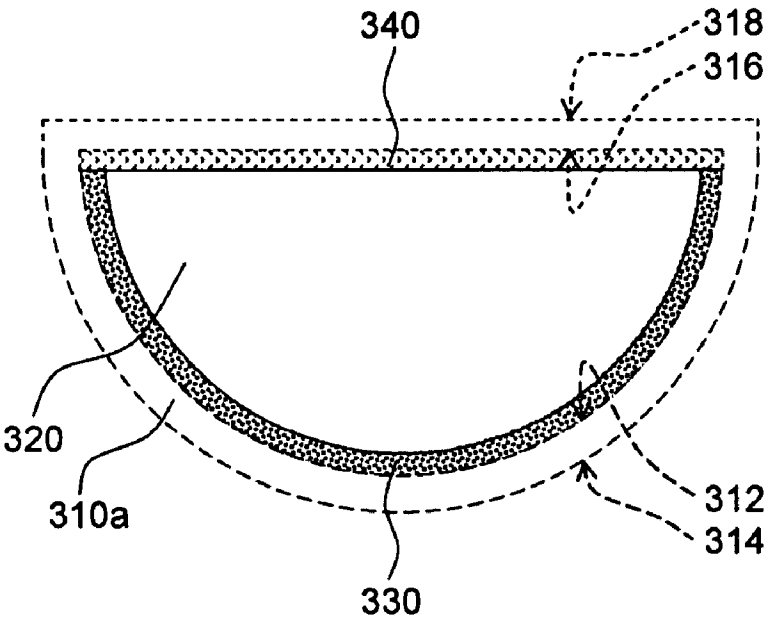
Figure 9C:
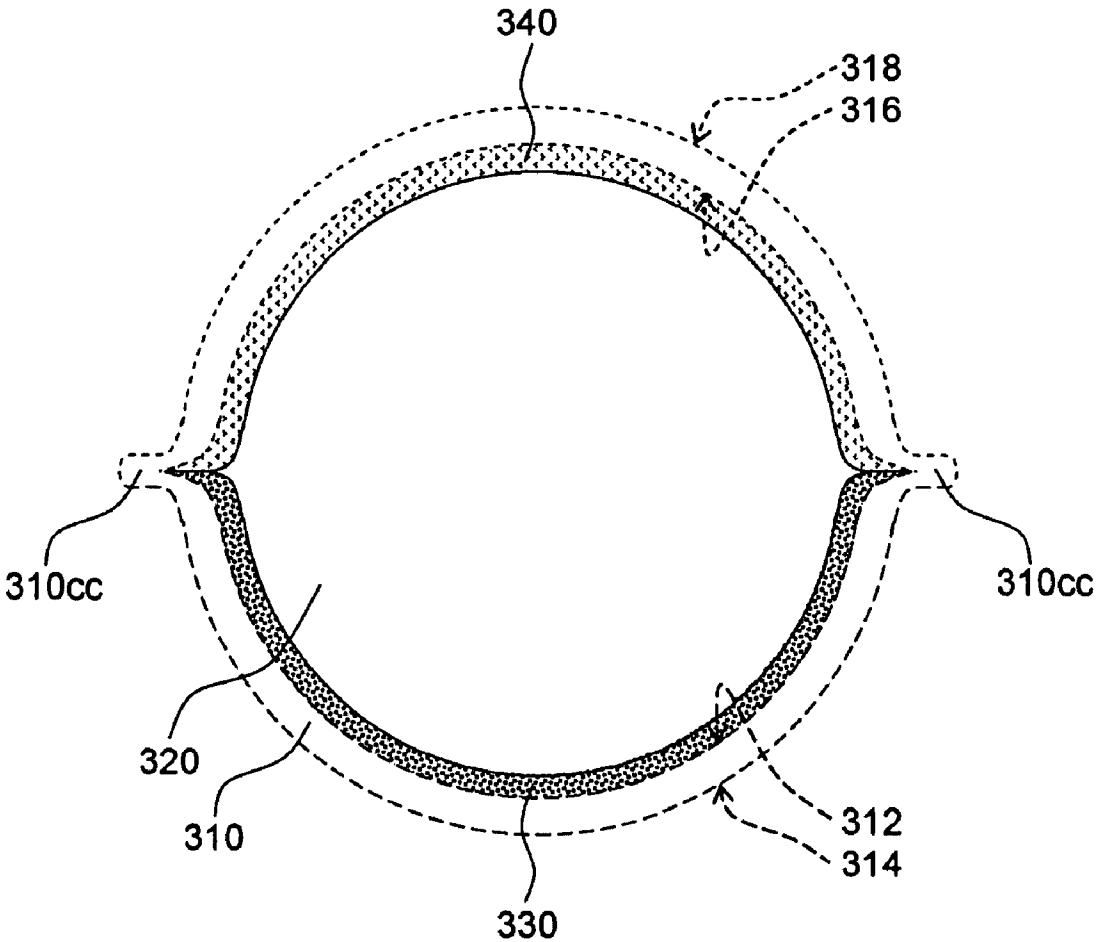

FIGS. 9B~9C are another three sectional views of the illuminating elements according to the seventh embodiment of the present invention. Please refer to FIGS. 9B~9C, illuminating elements 900*a*~900*c* and said illuminating element 300*a* are ditto. Said casing 310*a*~*c* of said illuminating elements 900*a*~*c* differ in shape from said casing 310 of said illuminating element 300*a*. Specifically, the shape of said casing 310*a* is of semi-circular pipe and the shape of said casing 310*b* is square pipe. Also, a transparent closed casing 310*c* further comprises a projecting nose 310*cc*.

Also, in FIG. 9B the area size for said first exciting coating 330 and the area size for said first dielectric multi-layer long-pass filter 340 are different, however, in the present invention there is no any restriction to area sizes for said first exciting coating 330 and said first dielectric multi-layer long-pass filter 340. Besides, said projecting nose 310*cc* is a fusion of a top semi-circle glass tube and a bottom semi-circle glass tube via the coating of film, fluorescent and phosphorescence.

Figure 9D:
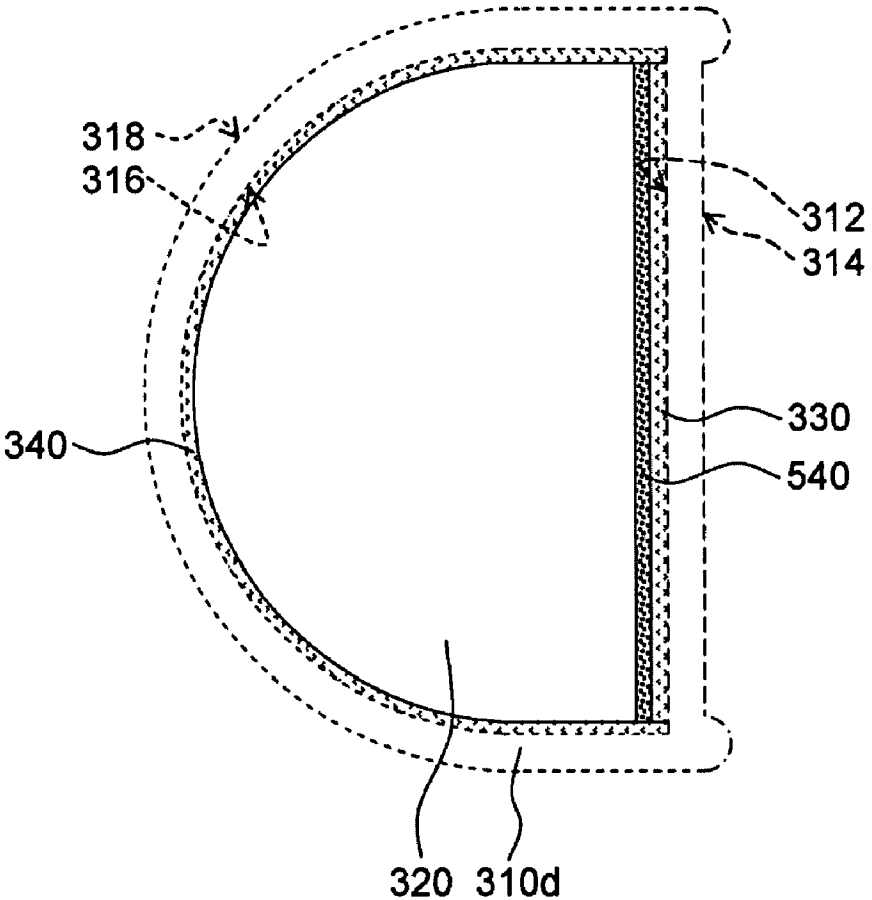
Figure 9E:
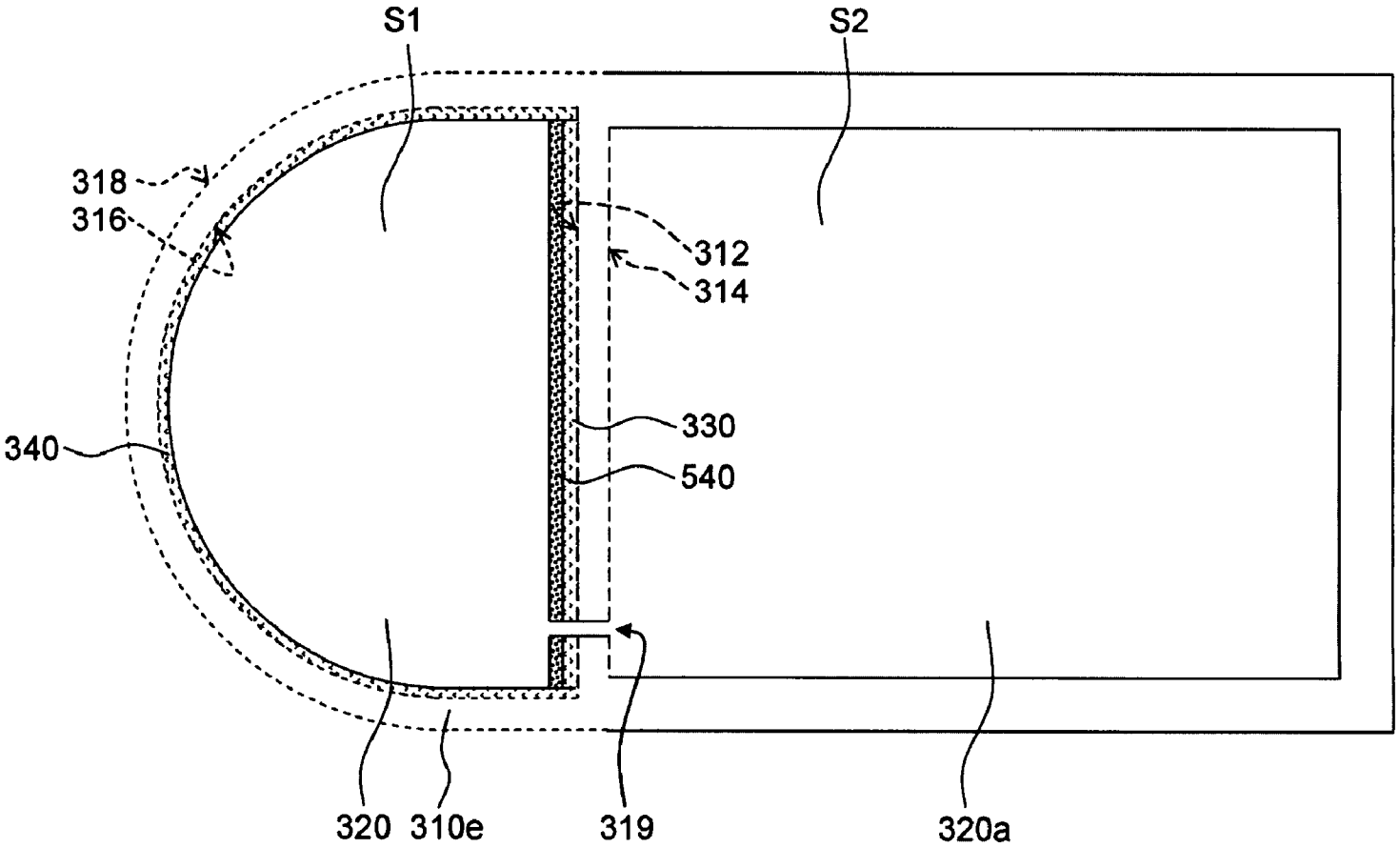
Figure 9F:
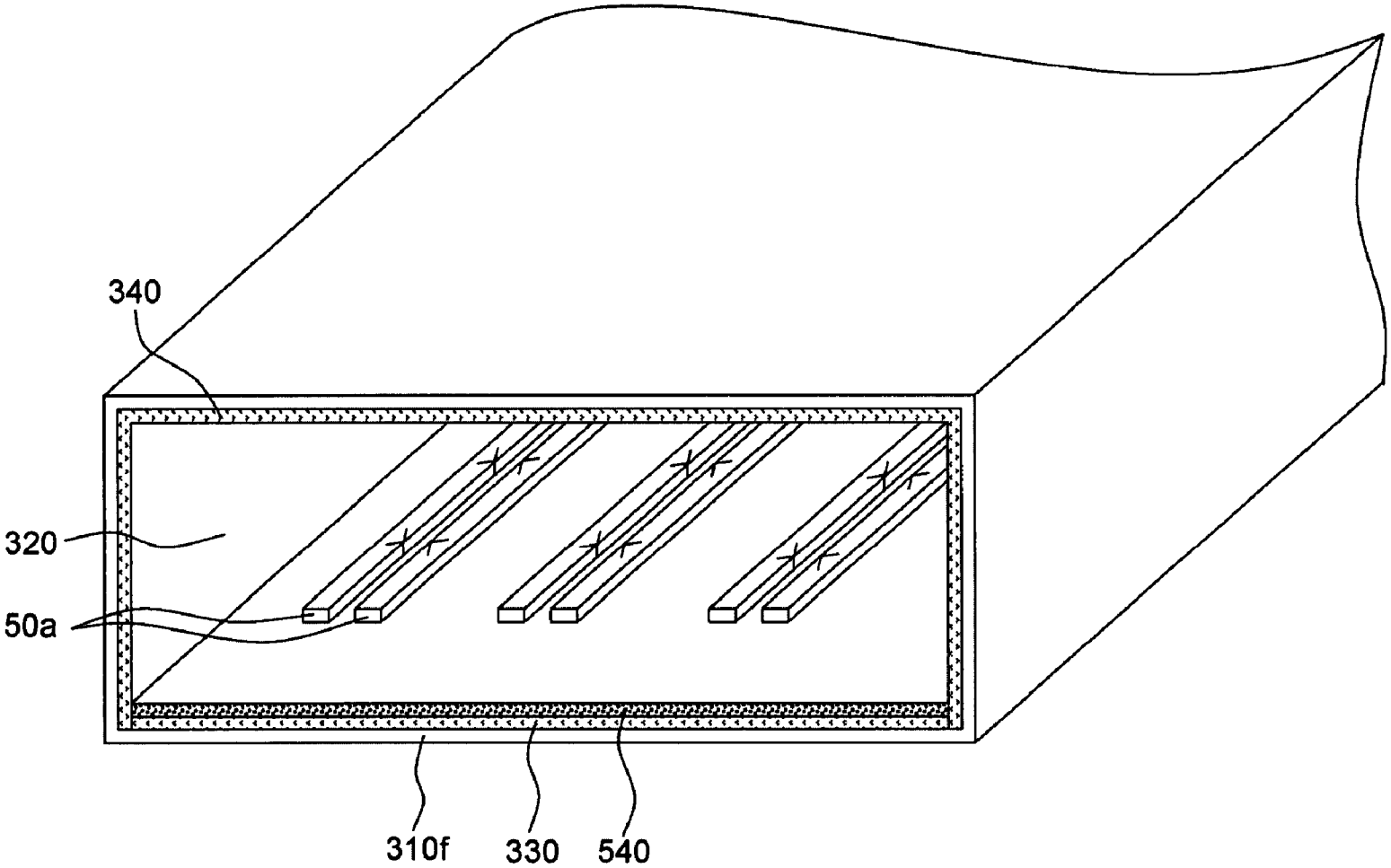

FIGS. 9D~9F are another three sectional views of the illuminating elements according to the seventh embodiment of the present invention. Please refer to FIG. 9D, an illuminating element 900*d* and said illuminating element 500*b* in the previous embodiment are ditto but differ from each other in the shape of said casing 310*d* of said illuminating element 900*d* and of said casing 310 of said illuminating element 500*b*. To be more exactly, said casing 310*d* is a fusion of some semi-circle glass tube and glass stripe.

Please refer to FIG. 9E, an illuminating element 900*e* and said illuminating element 900*d* are ditto but their difference is that said casing 310*e* of said illuminating element 900*e* further comprising a first space S1 and a second space S2, and said first inner side 312 and said first outer side 314 place or serve as a partition between said first space S1 and said space S2, and said exciting illuminating gas 320 is disposed within said space S1. Besides, said space S2 can be a vacuum, supplement of mercurial gas or inert gas.

Similar to said illuminating element 700*a* disclosed in said fifth embodiment (as depicted in FIG. 7B), said casing 310*e* further having an aperture 319 to communicate said space S1 and said space S2, wherein said space S2 of said illuminating element 900*e* can be further supplemented of said auxiliary gas 320*a* to said exciting illuminating gas 320.

Please refer to FIG. 9F, an illuminating element 900*f* and said illuminating element 500*b* in the previous embodiment are ditto, but the shape of the transparent closed casing 310*f* of said illuminating element 900*f* is rectangular. Besides, said illuminating element 900*f* having a stripe poles and thus increase the efficiency for said exciting illuminating gas 320 stimulating ultraviolet light via the parallel arrangement of the stripe poles.

Figure 9G:
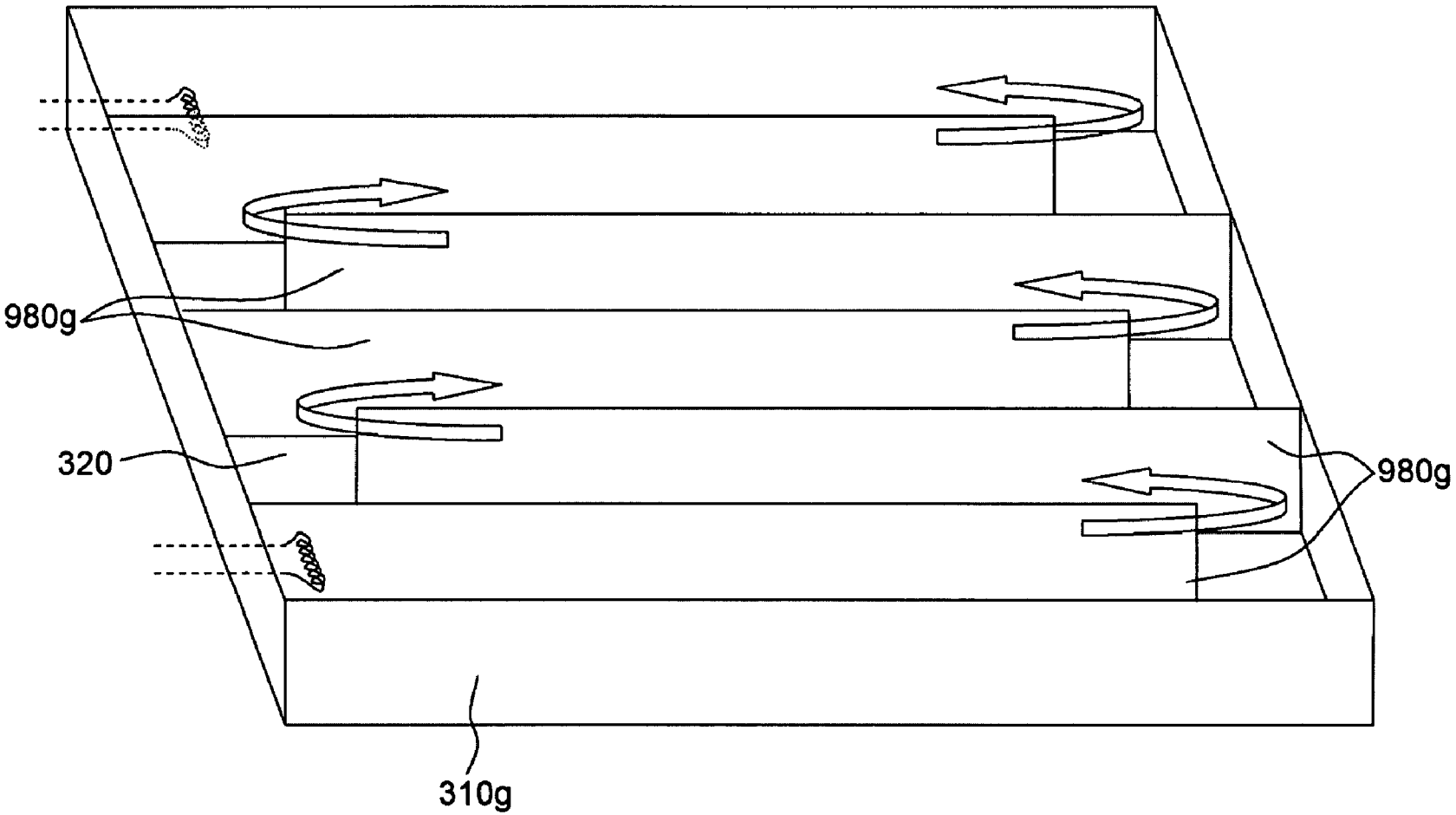
Figure 9H:
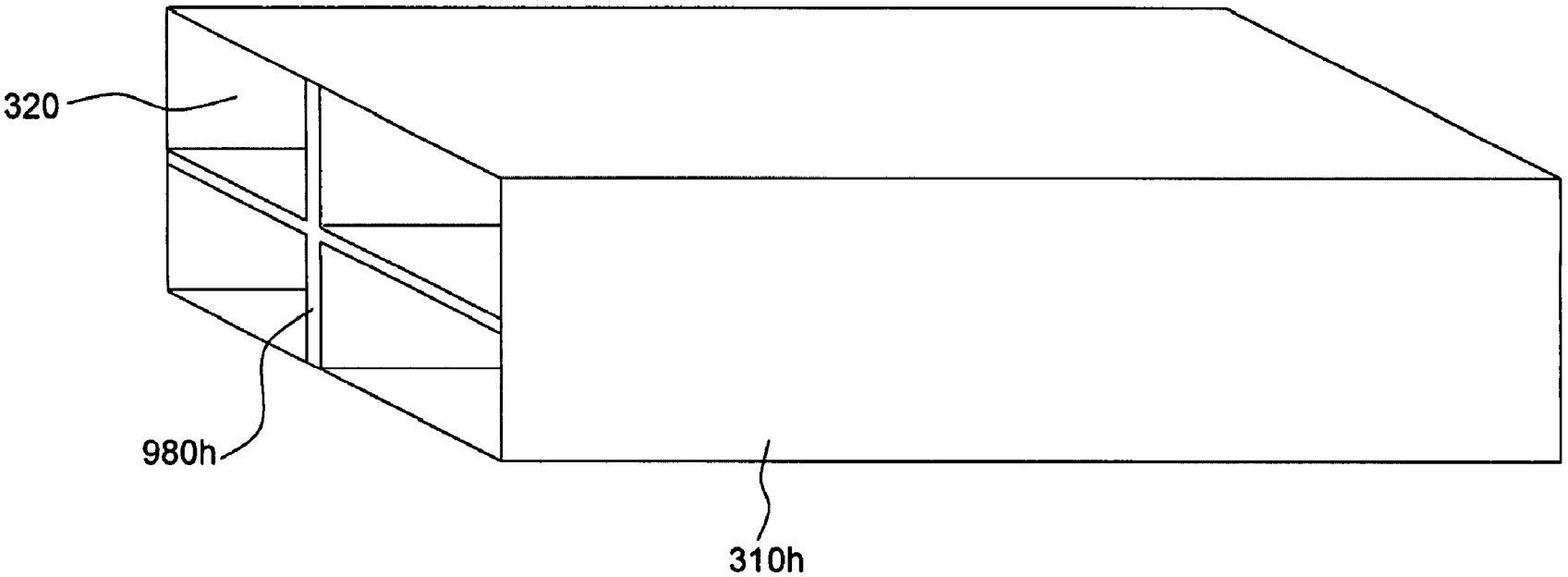
Figure 9I:
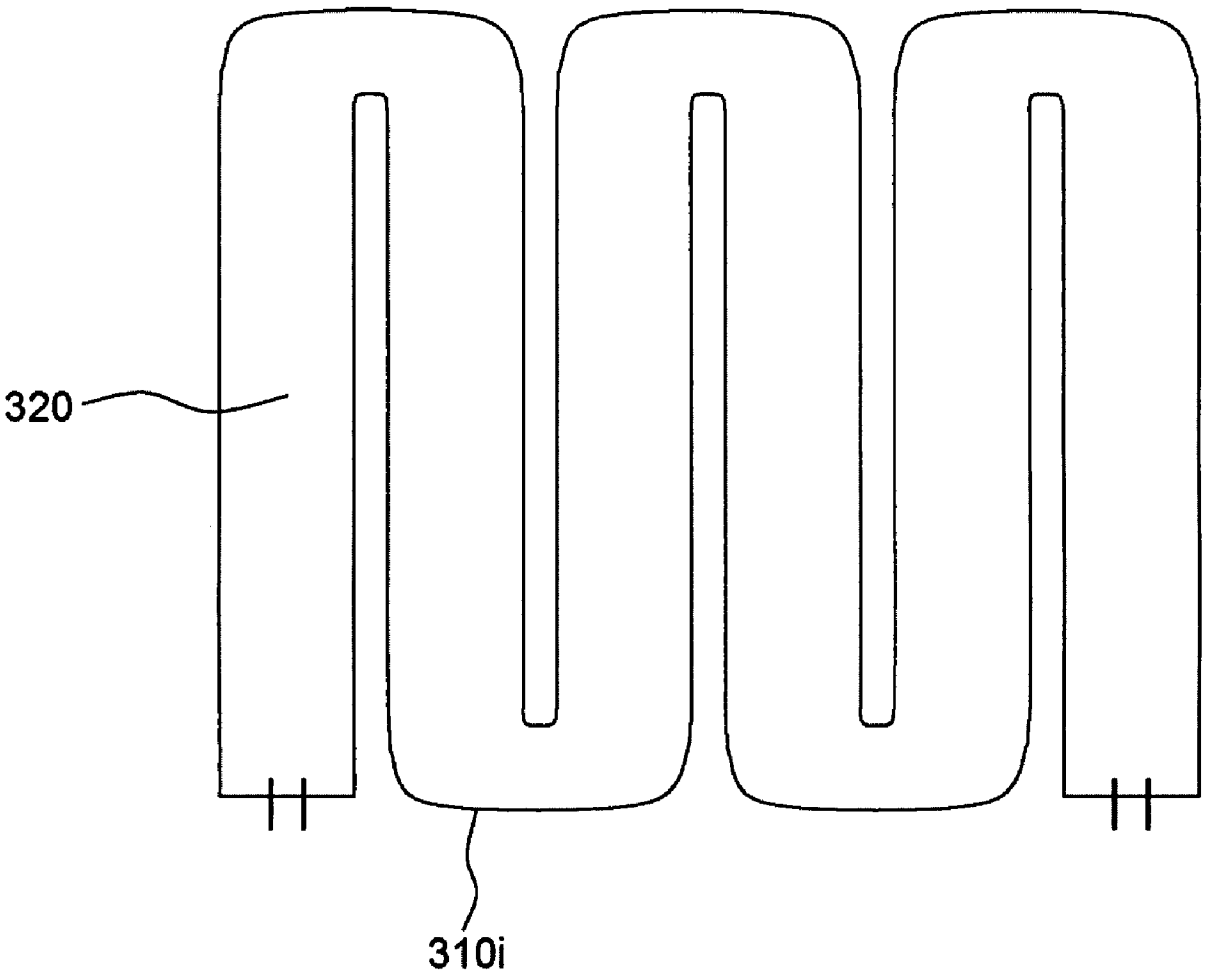

FIGS. 9G~9I are another two 3-D sectional views of the illuminating elements according to the seventh embodiment of the present invention. Please refer to FIG. 9G, the shape of a transparent closed casing 310*g* of said illuminating element 90*g* is also rectangular, and said illuminating element 900*g* further comprising at least a transparent partition plate 980*g*, and said casing 310*g* is partitioned to a plurality of connected spaces by said plate 980*g*. In such a way, the electronic discharge direction can be effectively guided and the efficiency of ultraviolet light stimulated by said exciting illuminating gas 320 can be enhanced.

In addition, said plate 980*g* can be made of an ordinary glass, or a quartz glass, or a material can be penetrated by ultraviolet light. Further more, said plate 980*g* in the present invention can be further coated by exciting coating thus said illuminating efficiency can be further enhanced.

Please refer to FIG. 9H, an illuminating element 900*h* and said illuminating element 900*g* are ditto, but the transparent partition plate 980*h* on a transparent closed casing 310*h* is of cross shape which differs from the conducting discharge direction of said illuminating element 900*g*. Beside, please refer to FIG. 9I; the shape of a transparent closed casing 310*i* on an illuminating element 900*i* can be of serpent in order to directly utilize the shape of said casing 310*i* to lead the discharge direction.

Figure 9J:
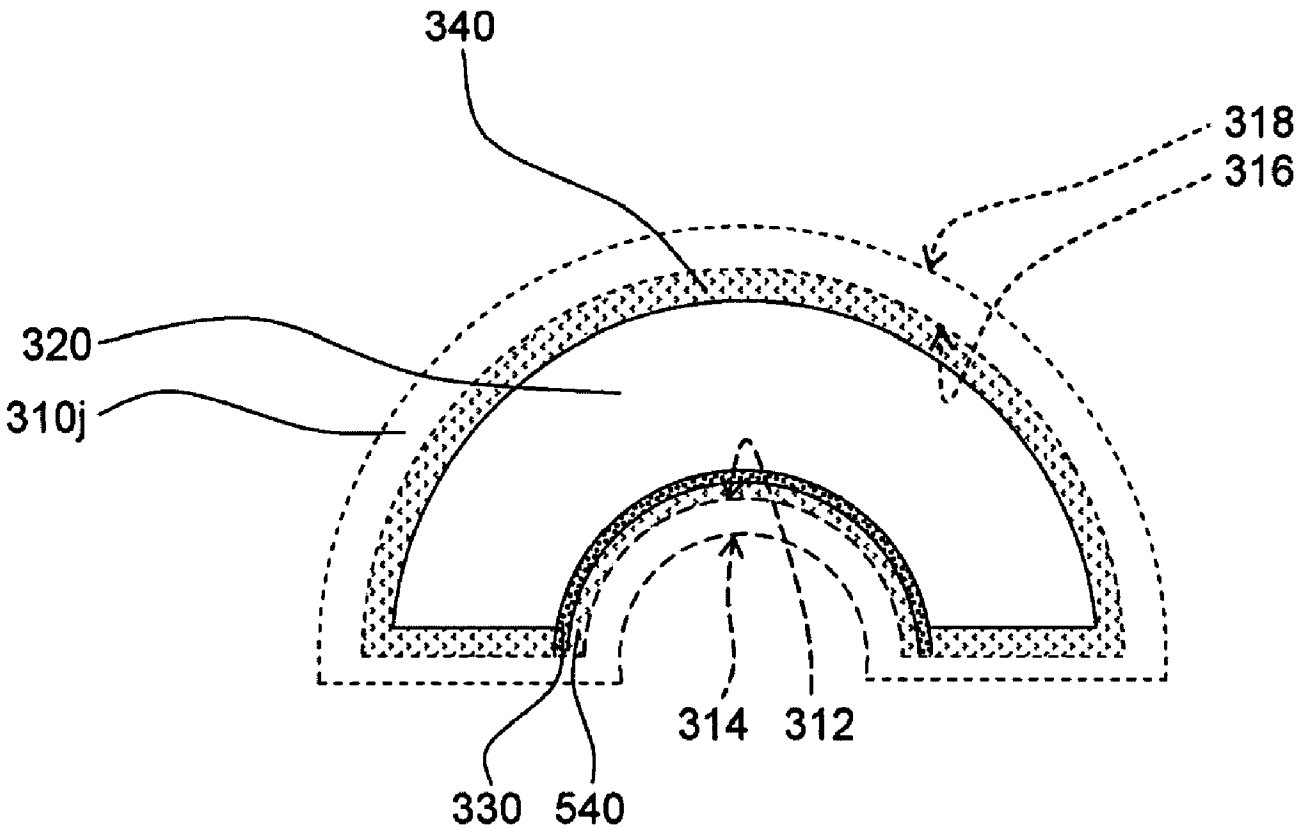

FIG. 9J is another sectional views of the illuminating element according to the seventh embodiment of the present invention. Please refer to FIG. 9J, an illuminating element 900*j* and said illuminating element 500*b* (as depicted in FIG. 5B) are ditto but a transparent closed casing 310*j* of said illuminating element 900*j* and said casing 310 of said illuminating element 500*b* are different in shape. To be more exactly, said casing 310*j* is a fusion of two semi-circle glass tubes in different radius.

The aforementioned elements 900*a*~900*c* are only exemplarily demonstrate said casing 310*a*~310*c* can be of the different shape. One skilled in the ordinary art can vary the shape based upon the aforesaid without departing the scope or view of the present invention. Further more, one skilled in the art can further apply the variation of shape to said transparent closed outer masks and said transparent closed hull without further redundant explanation.

In addition, all of the illuminating elements in the previous embodiments are emitting visible light in the specially designated direction, however, the present invention can enable the visible light to illuminate the exterior side omni-directionally and another embodiments will be further demonstrated with accompanied drawings thereto.

Eighth Embodiment

Figure 10A:
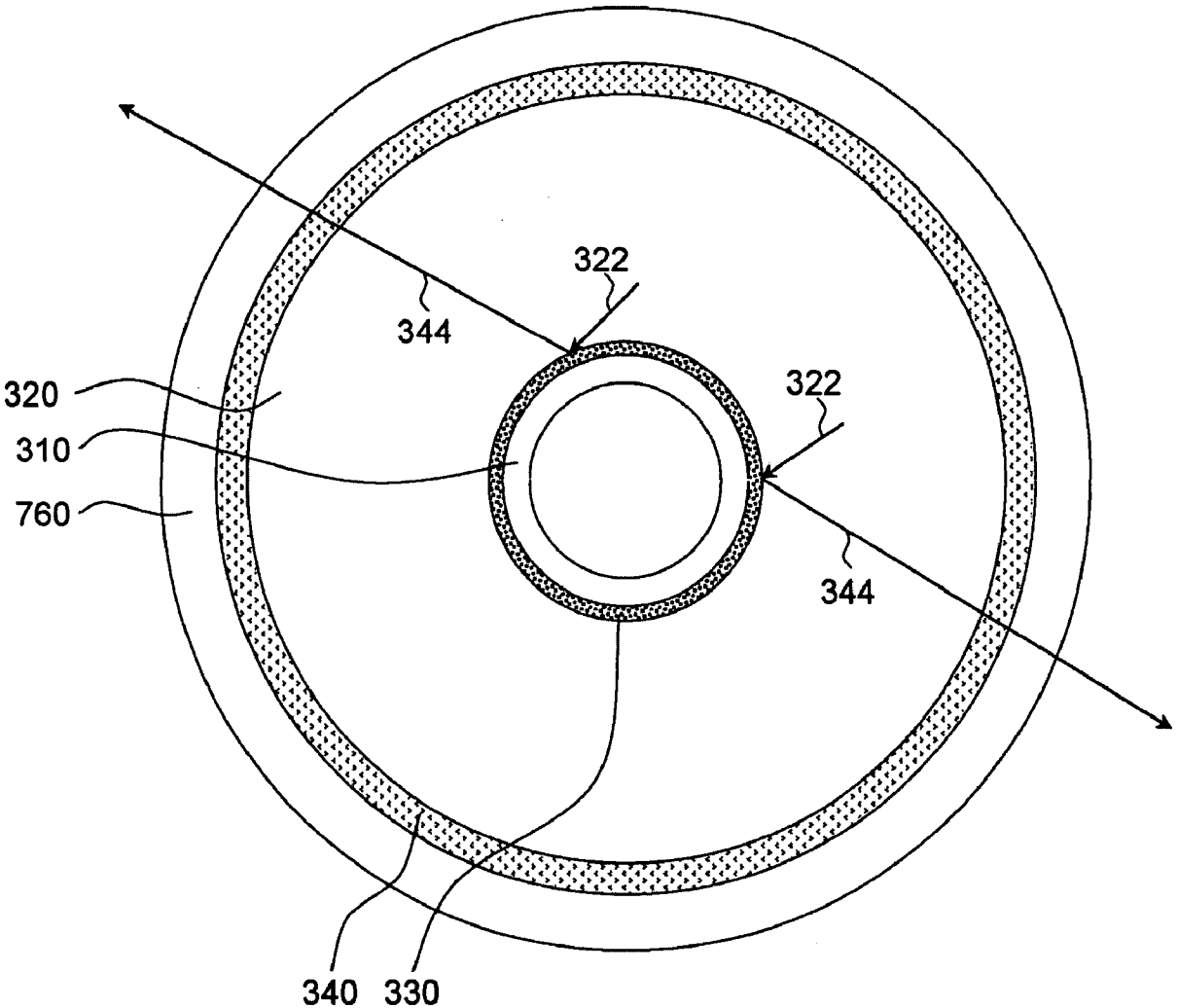
FIGS. 10A~10C, 10E, 10G, 10H are six sectional views according to the eighth embodiment of the present invention.

FIG. 10A is another sectional views of the illuminating element according to the eighth embodiment of the present invention. Please refer to FIG. 10A, the illuminating element 1000*a* in the present embodiment comprises said casing 310, said exciting illuminating gas 320, said first exciting coating 330, said first dielectric multi-layer long-pass filter 340 and said outer mask 760, wherein said casing 310 is disposed within said outer mask 760, and said exciting illuminating gas 320 is disposed between said casing 310 and said outer mask 760, and additionally said first exciting coating 330 is disposed over said casing 310, and said first dielectric multi-layer long-pass filter 340 is disposed over said outer mask 760.

Similar to the aforementioned, said exciting illuminating gas 320 can generate said ultraviolet light 322 to illuminating said first exciting coating 330, and said first exciting coating 330 can accordingly absorb said light 322 to provide visible light 324, and visible light 324 can pass said first dielectric multi-layer long-pass filter 340 in omni-direction to illuminate the exterior side.

In the present embodiment, said first exciting coating 330 is disposed over the outer side of said casing 310, and said first dielectric multi-layer long-pass filter 340 is disposed over the inner side of said outer mask 760, however, said first exciting coating 330 is disposed over the inner side of said casing 310, and said first dielectric multi-layer long-pass filter 340 is disposed over the outer side of said outer mask 780, all of said configuration is dependent upon the actual demand for the design.

What is noteworthy is that, one skilled in the art can refer to the aforementioned to apply the concept of all the previous embodiments to the present embodiment. Particularly, in the second and third embodiment, said casing 310 is supplemented to a second dielectric optical multi-layer filter and a first reflecting film, hereby a drawing will be accompanied for further brief illustration.

Figure 10B:
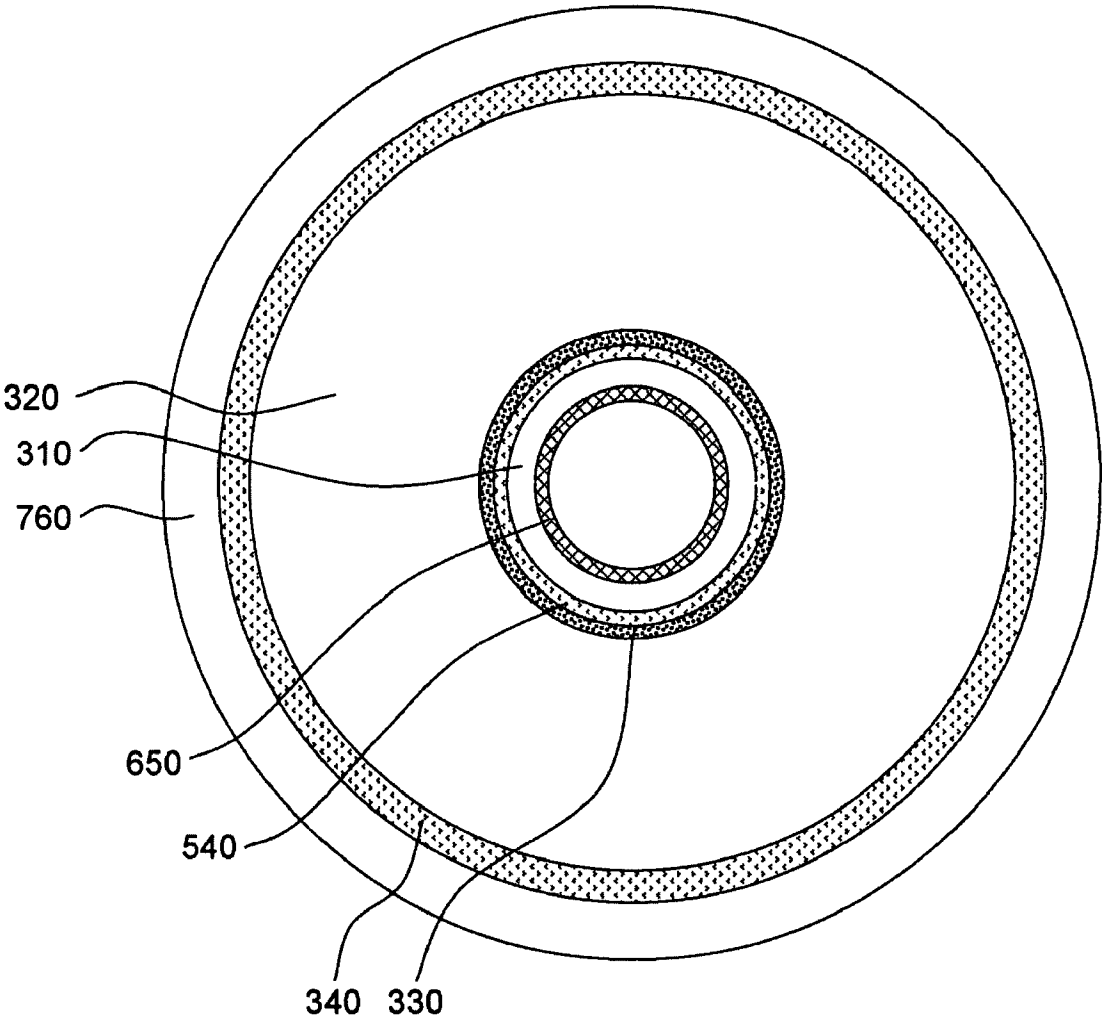

FIG. 10B is another sectional views of the illuminating element according to the eighth embodiment of the present invention. Please refer to FIG. 10A, the illuminating element 1000*b* and said illuminating element 1000*a* are ditto but said illuminating element 1000*b* further comprises said second dielectric optical multi-layer filter 540 and said first reflecting film 650, and said second dielectric optical multi-layer filter 540 and said first reflecting film 650 are both disposed over said casing 310.

Specifically, said second dielectric optical multi-layer filter 540 is disposed between said first exciting coating 330 and said casing 310, and said first reflecting film 650 is disposed over said casing 310.

What is emphasized is that the present invention does not delimit the corresponding disposition of said casing 310 with respect to said first exciting coating 330, said second dielectric optical multi-layer filter 540, and said first reflecting film 650.

Alternatively, the present invention solely delimits that film 330 is closer to said exciting illuminating gas 320 than said second dielectric optical multi-layer filter 540 and said second dielectric optical multi-layer filter 540 is closer to said exciting illuminating gas 320 than said first film 650.

In order to further enhance the stimulating efficiency of said exciting illuminating gas 320, the present embodiment further illustrates a discharge tube to delimit the stimulated ultraviolet light of said exciting illuminating gas 320 from said discharged tube. Hereby the specification will be further illustrated by the drawings.

Figure 10C:
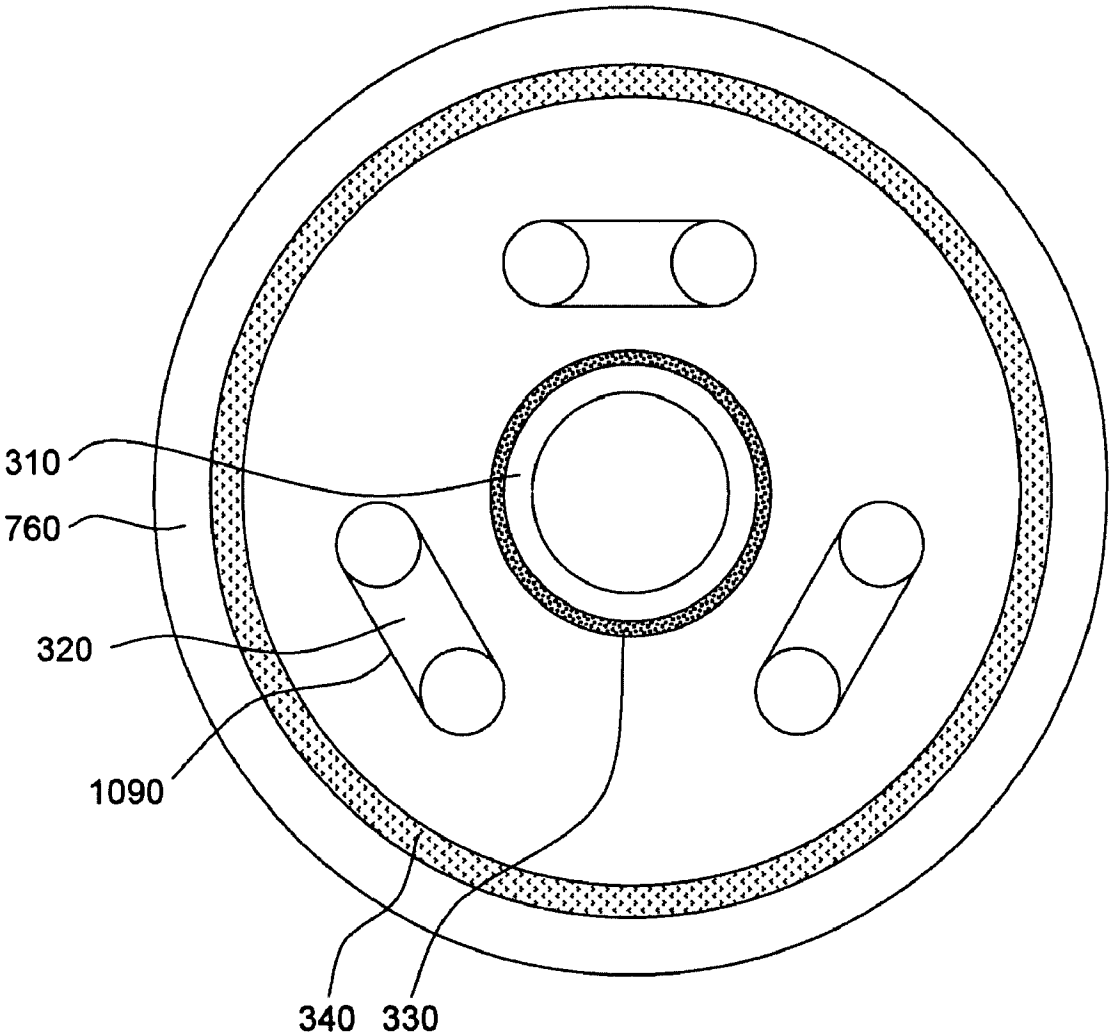
Figure 10D:
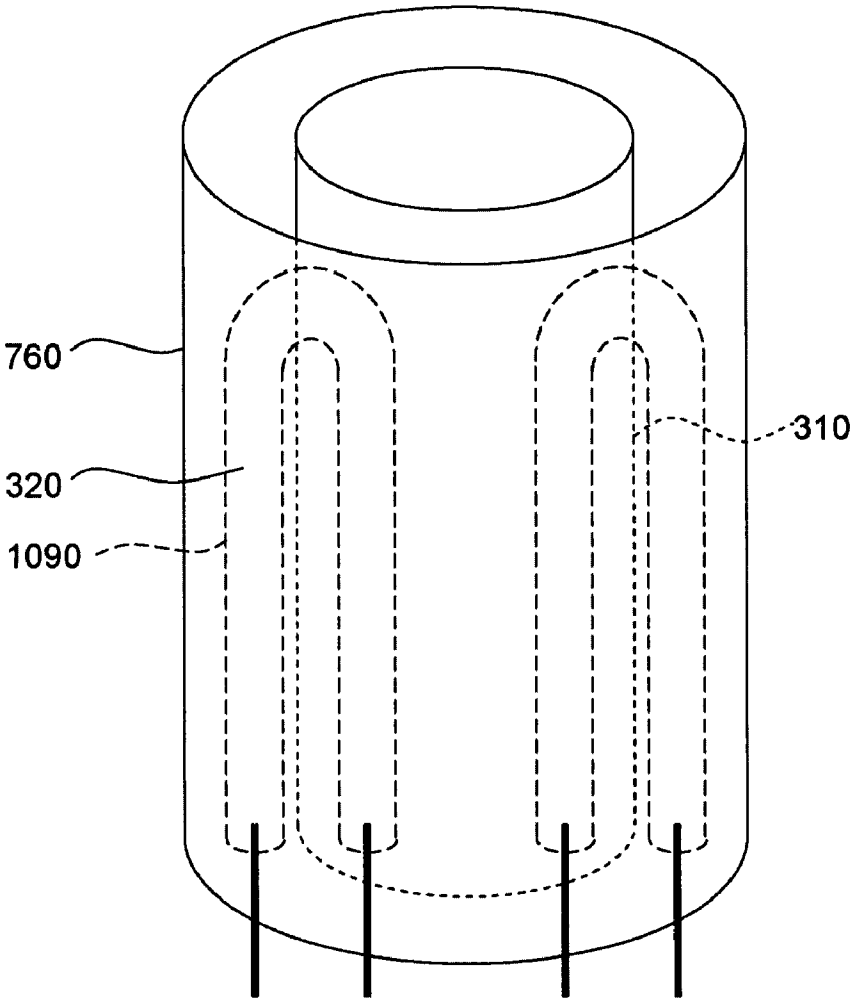

FIG. 10C is another sectional view of the illuminating element according to the eighth embodiment of the present invention, and FIG. 10D is the local 3-D view of the illuminating element for FIG. 10C. Please refer to FIGS. 10C and 10D, an illuminating element 1000*c* in the present embodiment and said illuminating element 1000*a* (as depicted in FIG. 10A) are ditto but said illuminating element 1000*c* further comprises a discharge tube 1090, and said tube 1090 is disposed between said casing 310 and said outer mask 760 and said exciting illuminating gas 320 is disposed within said tube 1090.

In the present embodiment, the total count for said tube 1090 is three and said tubes are symmetrically disposed around said casing 310, however, the present invention does not delimit the counting of said discharge tubes and the disposition of said tube 1090. Additionally, one skilled in the art can easily extend the concept of said tube 1090 to all of the aforesaid illuminating elements in the previous embodiments thus nothing else will be redundantly mentioned.

What is noteworthy is that the present invention does not delimit the shape of said discharge tube 1090; hereby another example will be given accompanied with the corresponding drawing.

Figure 10E:
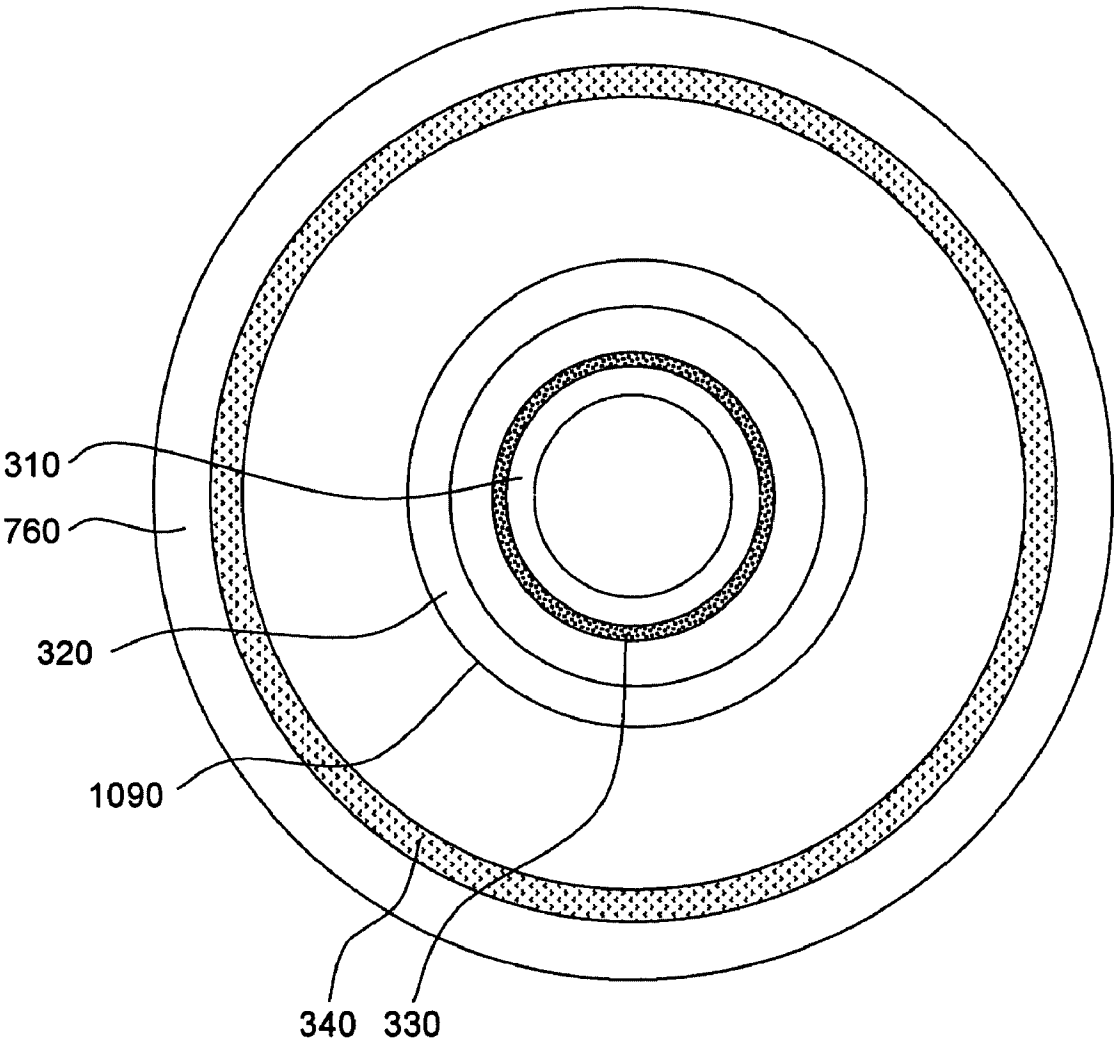
Figure 10F:
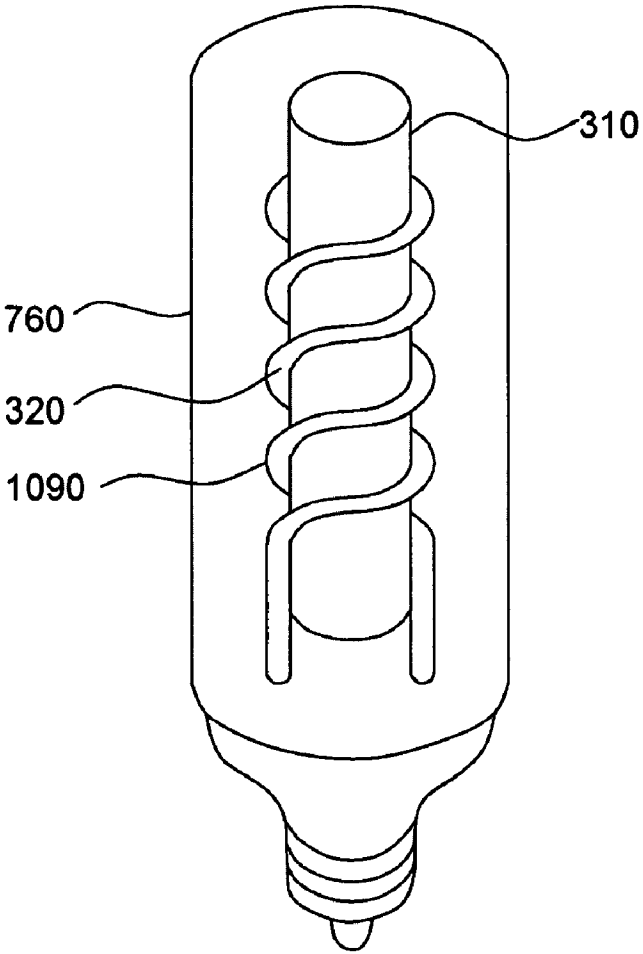

FIG. 10E is another sectional views of the illuminating element according to the eighth embodiment of the present invention, and FIG. 10F is the local 3-D view of the illuminating element for FIG. 10E. Please refer to FIGS. 10E and 10F, an illuminating element 1000*d* in the present embodiment and said illuminating element 1000*c* (as depicted in FIG. 10A) are ditto but the discharge tube 1090' of said illuminating element 1000*d* and said tube 1090 of said illuminating element 1000*c* differ in their shapes. Specifically, said tube 1090' is surrounding said casing 310 spirally.

Please refer to FIG. 10F, even though without further specification, as the present invention suggests, an exciting coating, dielectric optical multi-layer film, or reflecting film can be deliberately disposed over the top or the bottom of said casing 310 without redundantly suggestion.

Figure 10G:
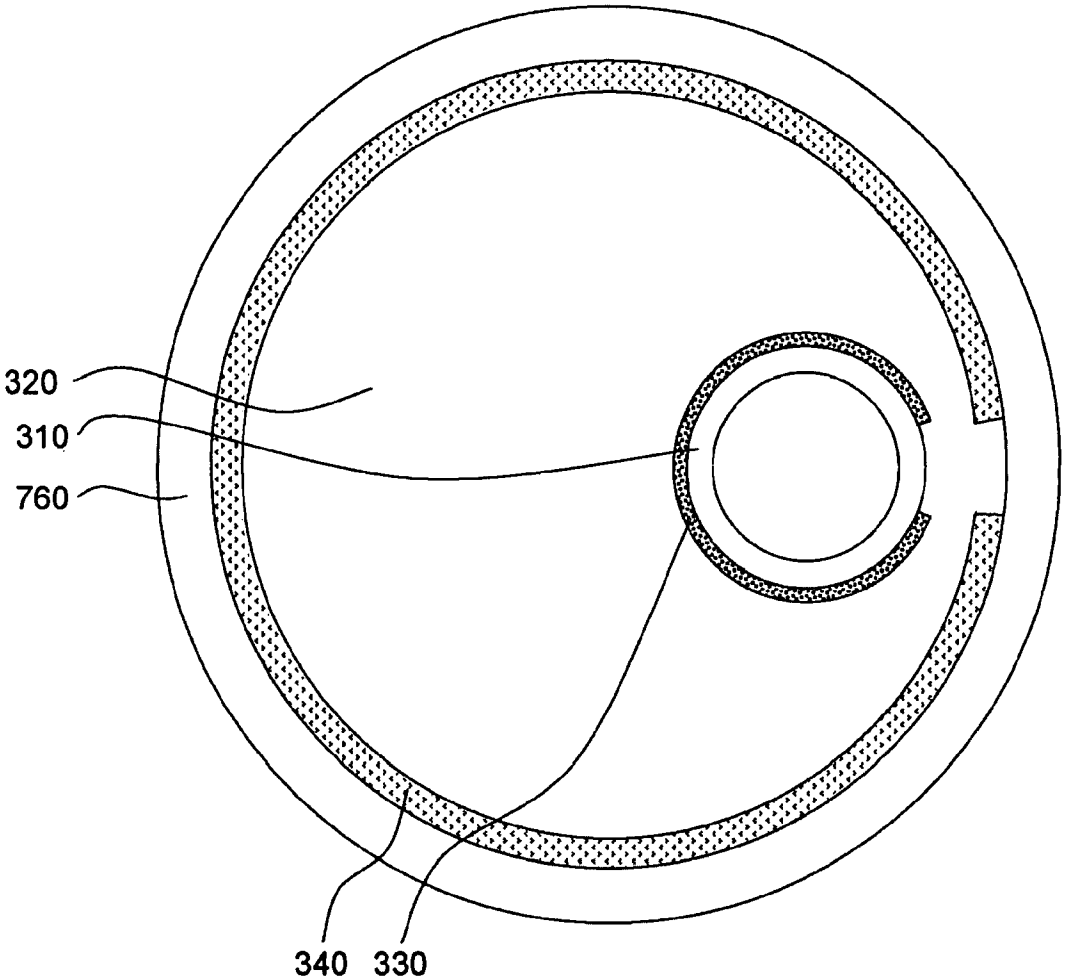
Figure 10H:
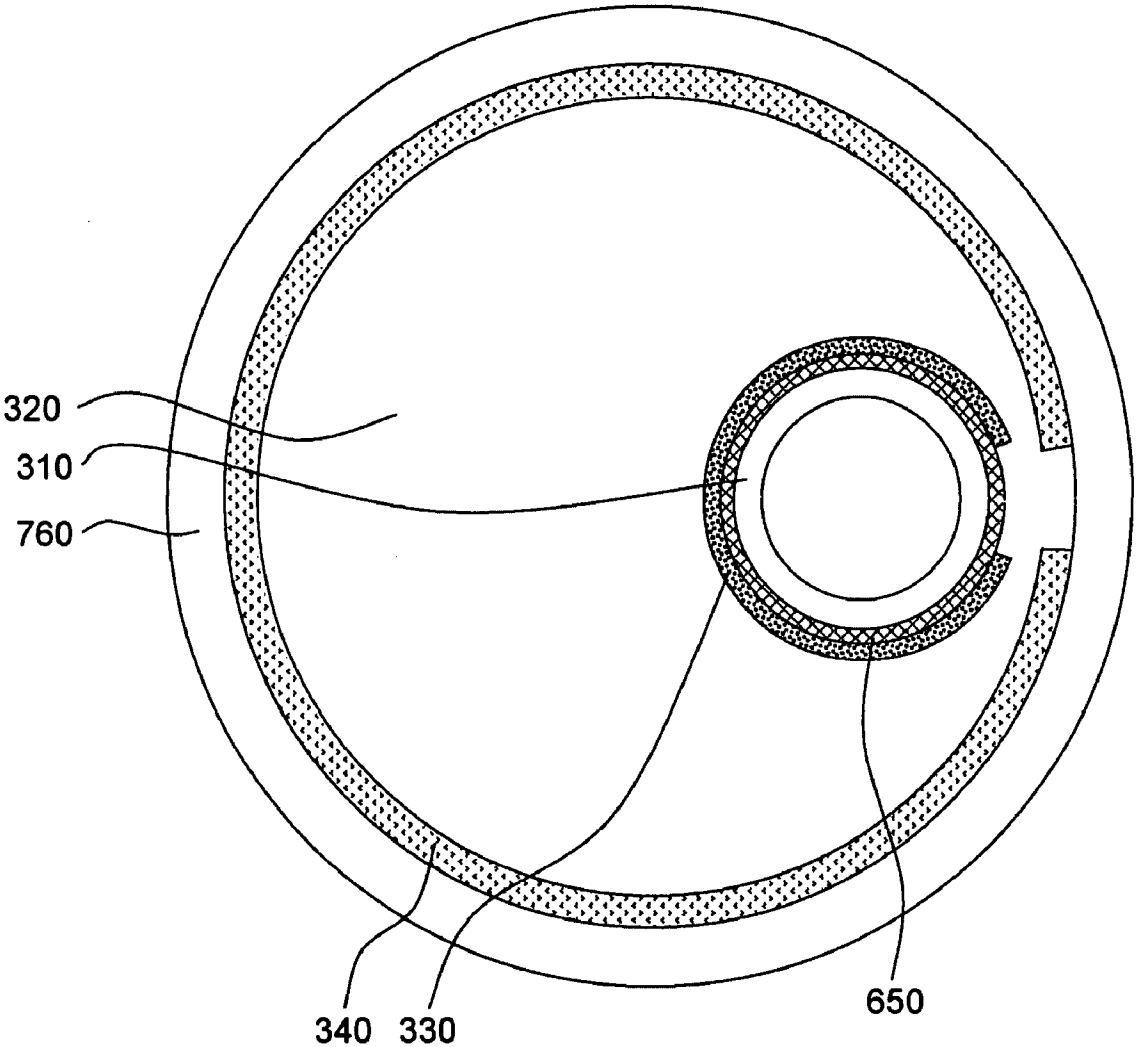

FIGS. 10G~H are another sectional views of the illuminating element according to the eighth embodiment of the present invention, please refer to FIG. 10G, an illuminating element 1000*e* and said illuminating element 1000*a* are ditto (as depicted in FIG. 10A) but said first exciting coating 330 is locally disposed over said casing 310 and said first dielectric multi-layer long-pass filter 340 is locally disposed over said outer mask 760.

Additionally, said casing 310 can be disposed by departing the central axis of said outer mask 760 such that said illuminating element 1000*e* has a better illuminating effect with respect to the specially designated direction.

Please refer to FIG. 10H, an illuminating element 1000*f* and said illuminating element 1000*e* are ditto (as depicted in FIG. 10A) but said illuminating element 1000*f* further comprises a first reflecting film 650, and said first reflecting film 650 is disposed over said casing 310 and between said casing 310 and said first exciting coating 330. What is noteworthy is that one skilled in the art can refer to the aforesaid and apply all of the concept disclosed in the previous embodiments to the present embodiment hereby nothing else will be redundantly mentioned.

Additionally, the present invention further disclosed the disposition of a transparent partition plate inside the transparent closed casing, hereby another example will be illustrated together with the drawing.

Ninth Embodiment

Figure 11A:
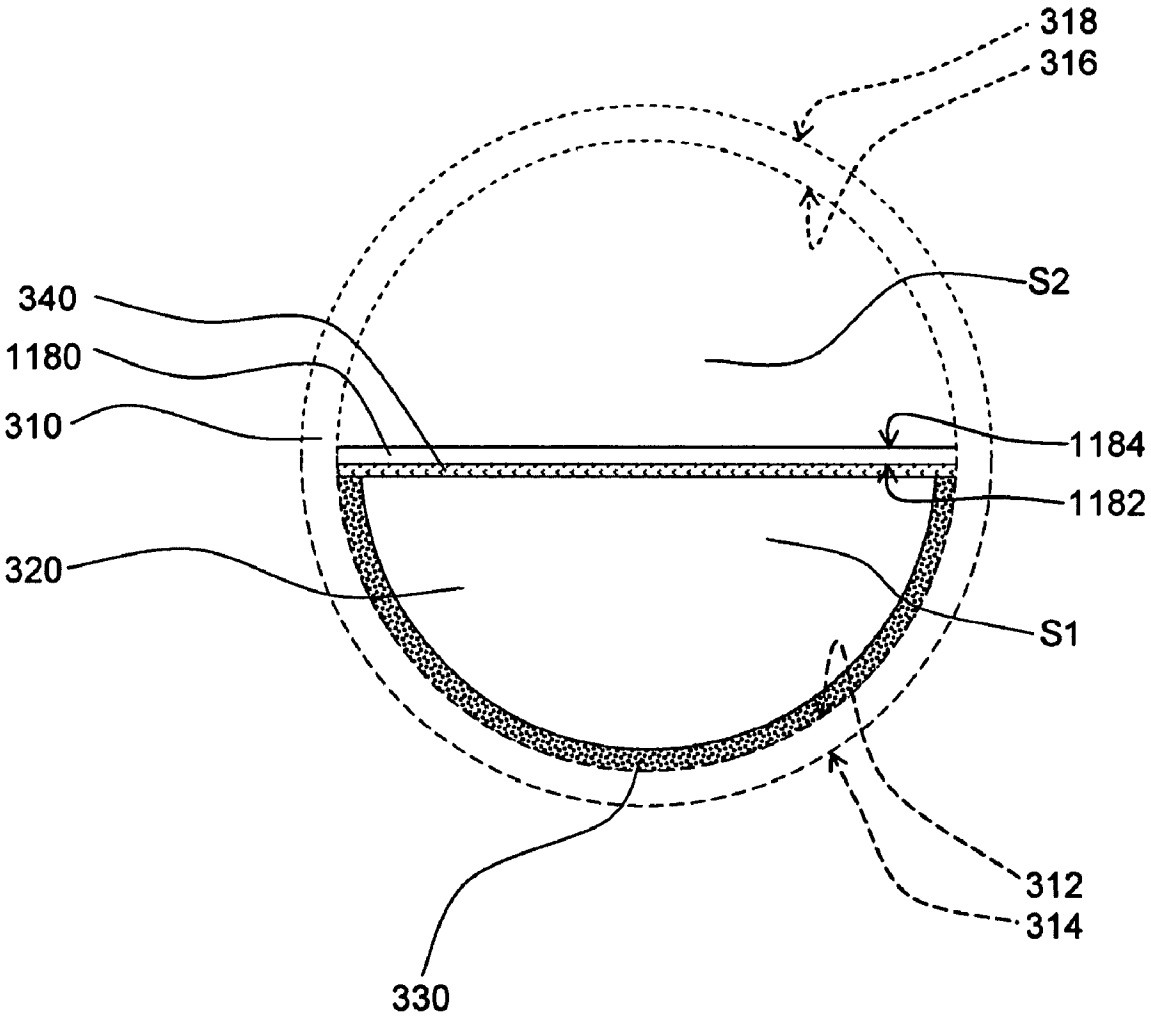
FIG. 11A is one of the sectional views according to the ninth embodiment of the present invention.

FIG. 11A is one of the sectional views of the illuminating elements according to the ninth embodiment of the present invention, please refer to FIG. 11A, an illuminating element 1000*a* further comprises said casing 310, said exciting illuminating gas 320, said first exciting coating 330, said first dielectric multi-layer long-pass filter 340, and a transparent partition plate 1180, and said plate 1180 can be previously coated for the convenience of coating. Said plate 1180 is disposed inside said casing 310, and said plate 1180 further have a first side 1182 and a second side 1184.

To be continued with the aforementioned, said casing 310 comprises correspondingly said first inner side 312 and said outer side 318, wherein said first inner side 312 and said side 1182 sphere said first space S1 and said second inner side 314 and said side 1184 sphere said second space S2.

In addition, said exciting illuminating gas 320 is disposed in said first space S1, and said first exciting coating 330 is disposed over said first inner side 312 and said first dielectric multi-layer long-pass filter 340 is disposed over said first side 1182.

What is noteworthy is, despite the aforesaid suggested said first exciting coating 330 is disposed over said first inner side 312, and said first dielectric multi-layer long-pass filter 340 is disposed over said side 1182, said first exciting coating 330 can be disposed over said first outer side 314 and said first dielectric multi-layer long-pass filter 340 can be as well disposed over said side 1184. One skilled in the art can refer to first embodiment and easily complete the work.

In addition, in the second embodiment, the concept of said second exciting coating 430 (as depicted in FIGS. 4A~4C) disposed over said first dielectric multi-layer long-pass filter 340 or said second inner side 314 can be applied to the present embodiment thus a second exciting coating (not depicted in FIG. 11A) is disposed over said first dielectric multi-layer long-pass filter 340 or said side 1182, wherein said second exciting coating is closer to said exciting illuminating gas 320 than said first dielectric multi-layer long-pass filter 340.

Alternatively, in the predetermined configurations, said second inner side 314 and said second outer side 318 (as depicted in FIGS. 4A~4C) are equivalently corresponding to said side 1182 and said side 1184 in the present embodiment. Exemplarily, said second dielectric optical multi-layer filter can also be applied to the present embodiment, namely, said second dielectric optical multi-layer filter can also be disposed between said first exciting coating 330 and said first inner side 312. As to other previous embodiments one skilled in the art can easily reason for the present embodiment so nothing else will be redundantly mentioned.

Tenth Embodiment

Figure 12A:
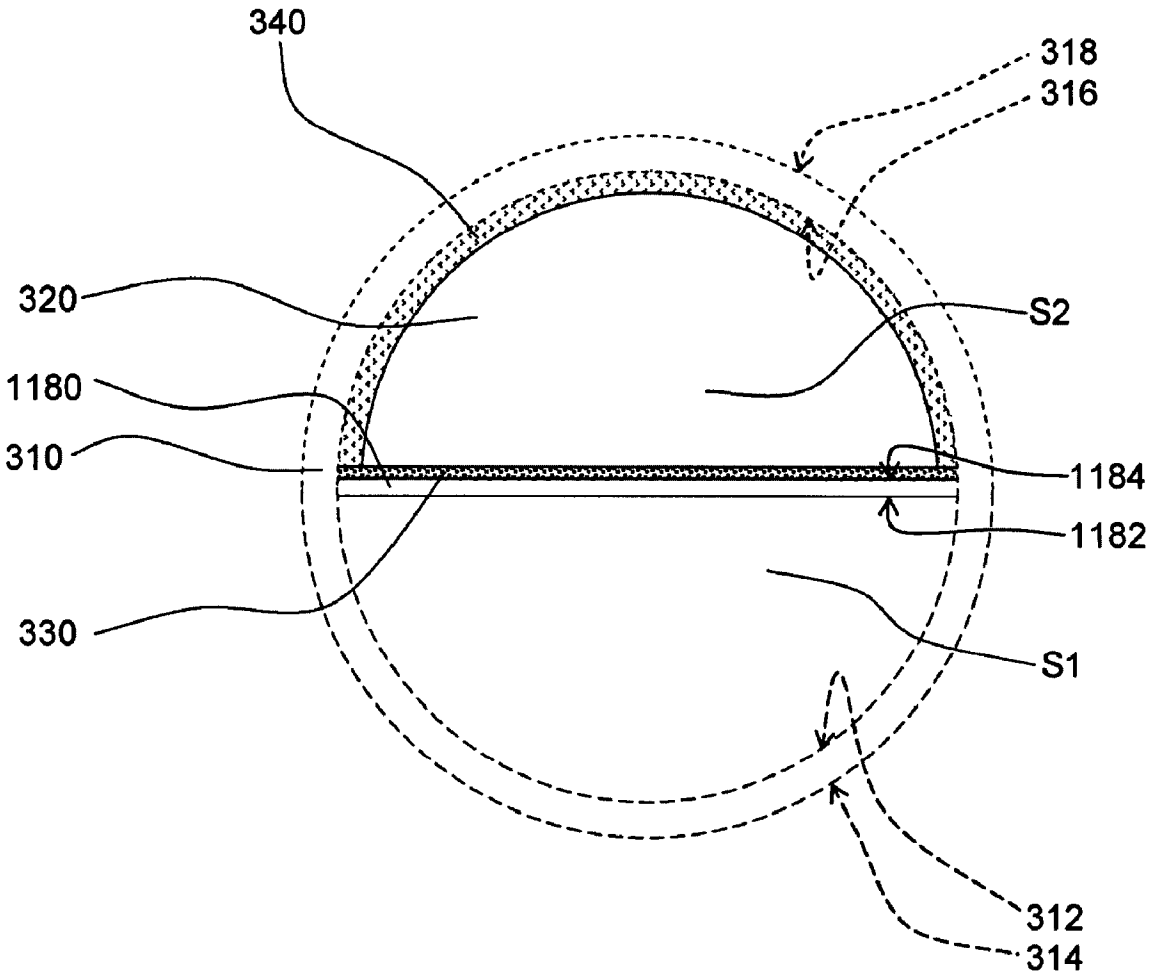
FIG. 12A is one of the sectional views according to the tenth embodiment of the present invention.

FIG. 12A is another sectional view of the illuminating element according to the tenth embodiment of the present invention, please refer to FIG. 12A, an illuminating element 1200*a* and said illuminating element 1100*a* of the ninth embodiment are ditto (as depicted in FIG. 11A) but said first exciting coating 330 is disposed over said side 1184 and said first dielectric multi-layer long-pass filter 340 is disposed over said second inner side 314.

Surely, said first exciting coating 330 in the present invention can be also disposed over said side 1182, and said first dielectric multi-layer long-pass filter 340 can as well be disposed over said second outer side 318. One skilled in the art can refer to said first embodiment and easily reason and carry out the concept of all of the previous embodiments together with the present embodiment.

Exemplarily, in the third embodiment, the concept for said second dielectric optical multi-layer filter 540 (as depicted in FIGS. 5A~5C) being disposed over said first exciting coating 330 or said first outer side 314 can be applied to the present embodiment, namely said second dielectric optical multi-layer filter (not depicted in FIG. 11B) is disposed over said first exciting coating 330 and said side 1182, wherein said first exciting coating 330 is closer to said exciting illuminating gas 320 than said second dielectric optical multi-layer filter.

Alternatively, in the predetermined configurations, said first inner side 312 and said first outer side 314 (as depicted in FIGS. 5A~5C) are equivalently corresponding to said side 1184 and said first side 1182 in the present embodiment. As to other embodiments, one skilled in the art can be easily suggested thus nothing else will be redundantly mentioned.

Additionally, despite in the previous two embodiments the shape of said transparent partition plates are of slice, the present invention does not delimit the shape of said transparent partition plate. Hereby another embodiment will be given and illustrated together with the drawings.

Eleventh Embodiment

Figure 13B:
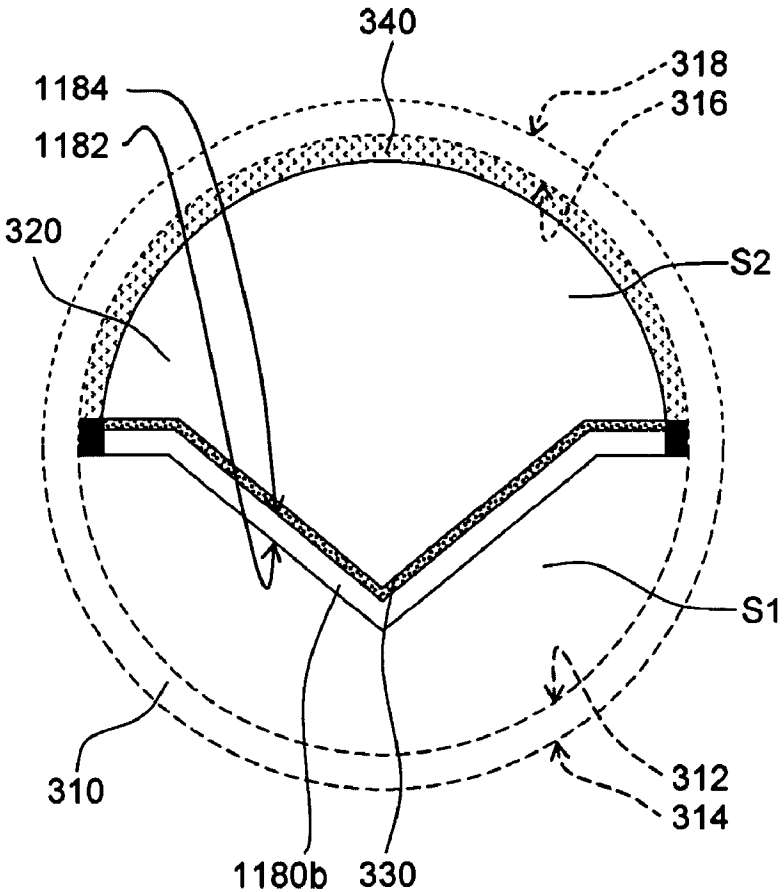
FIGS. 13A~13E are five of the sectional views according to the eleventh embodiment of the present invention.
Figure 13A:
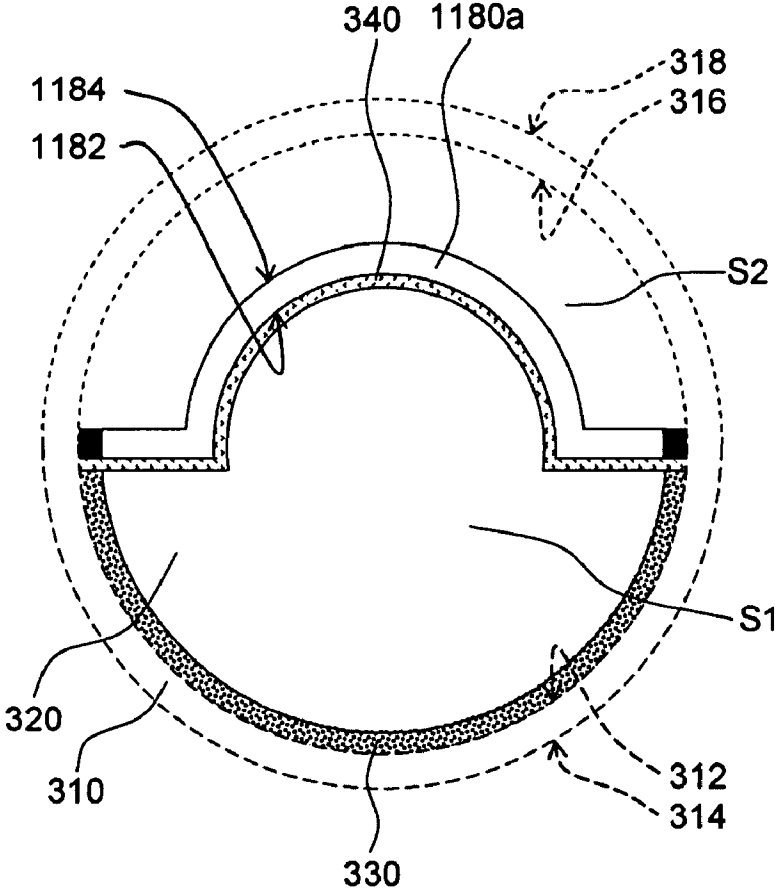
Figure 13D:
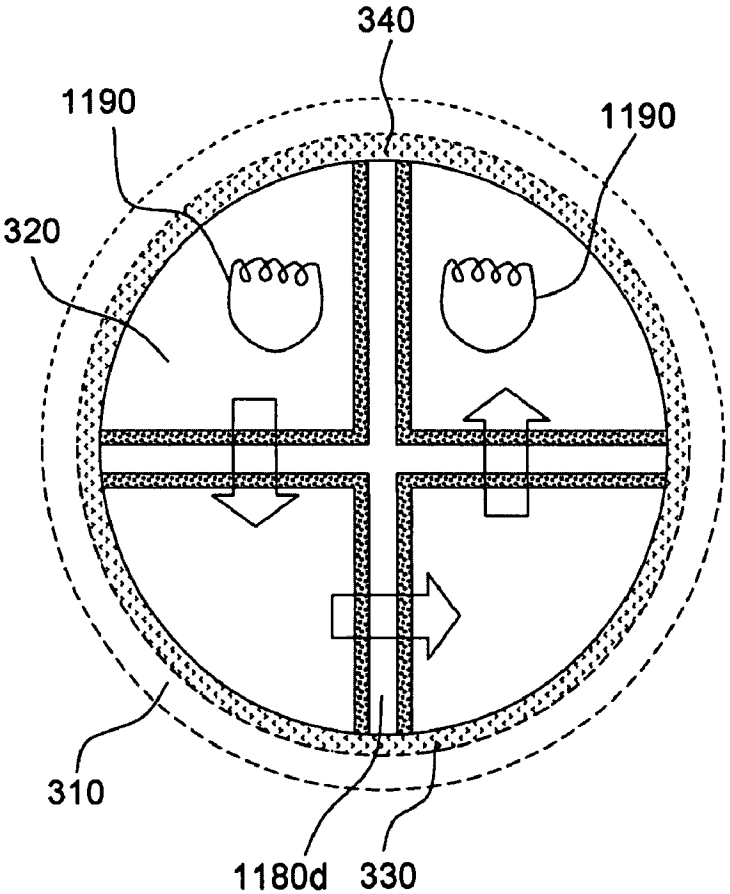
Figure 13C:
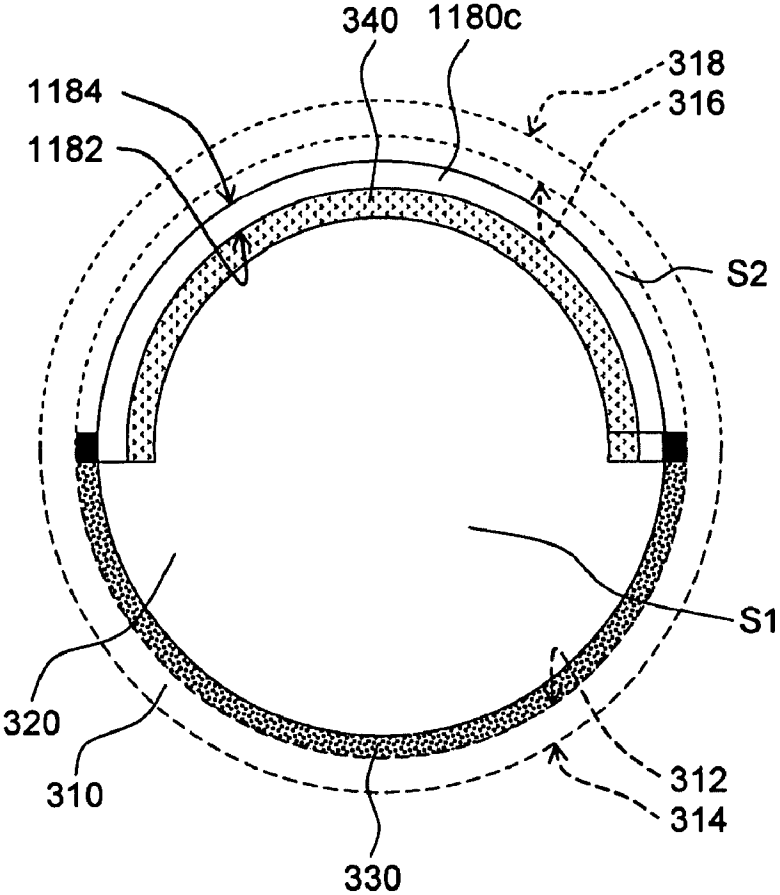

FIGS. 13A~13C are another sectional views of the illuminating element according to the eleventh embodiment of the present invention, please refer to FIGS. 13A~13C, an illuminating element 1300*a*, 1300*b*, 1300*c* and said illuminating element 1100*a*, 1200*a* of the previous embodiments are ditto (as depicted in FIGS. 11A and 12A) but the transparent partition plates 1180*a*, 1180*b*, and 1180*c* differ from said transparent partition plate 1180 in shape. Specifically, said partition plate 1180*a* is of saddle, and sad transparent partition plate 1180*b* is of V sign and said transparent partition plate 1180*c* is of semi-circular.

Figure 13E:
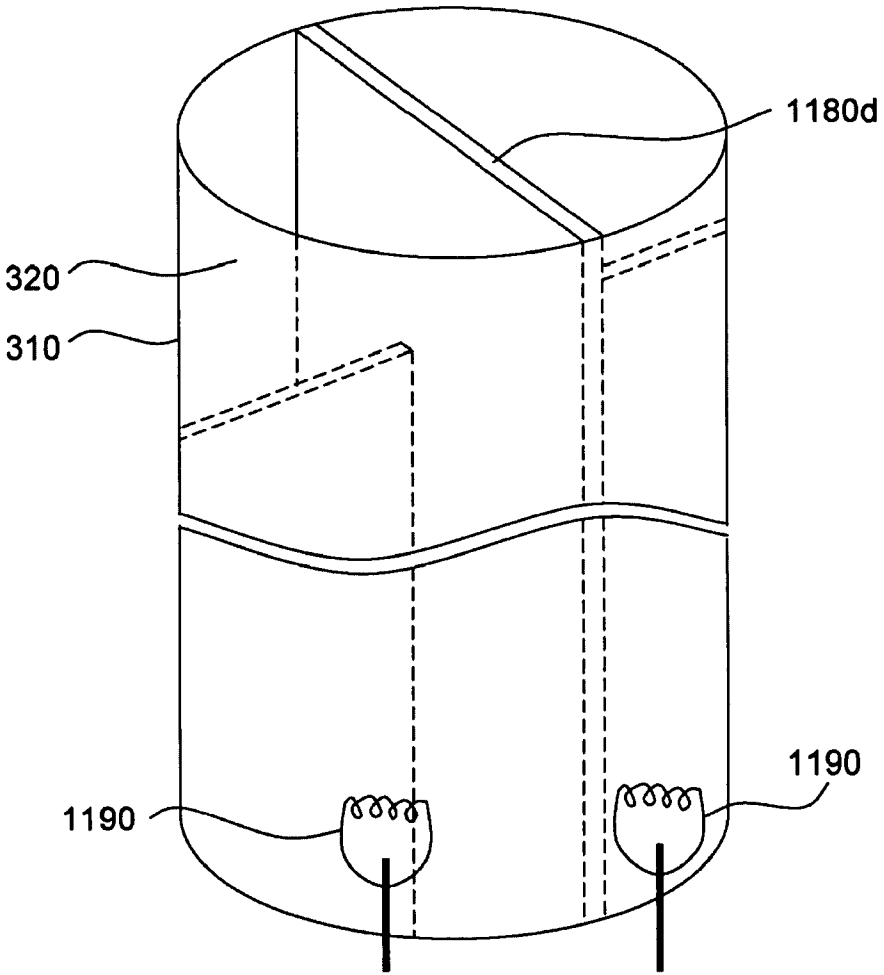

FIG. 13D is another sectional view of the illuminating element according to the eleventh embodiment of the present invention, and FIG. 13E is the local 3-D view of the illuminating element according to FIG. 13D. Please refer to FIG. 13D and FIG. 13E, the transparent partition plate 1180*d* of the illuminating element 1300*d* in the present embodiment is crisscross and said partition plate 1180*d* partitioned the space inside said casing 310 to be four interconnected spaces. To electrify two lower poles 1190, the electrified direction will follow as disclosed in FIG. 13D thus said exciting illuminating gas 320 will be further stimulated.

Additionally, without departing the scope and spirit of the present invention the shape of the transparent partition plate may be varied by the skilled person according to the teachings from the previous embodiments.

Twelfth Embodiment

Figure 14A:
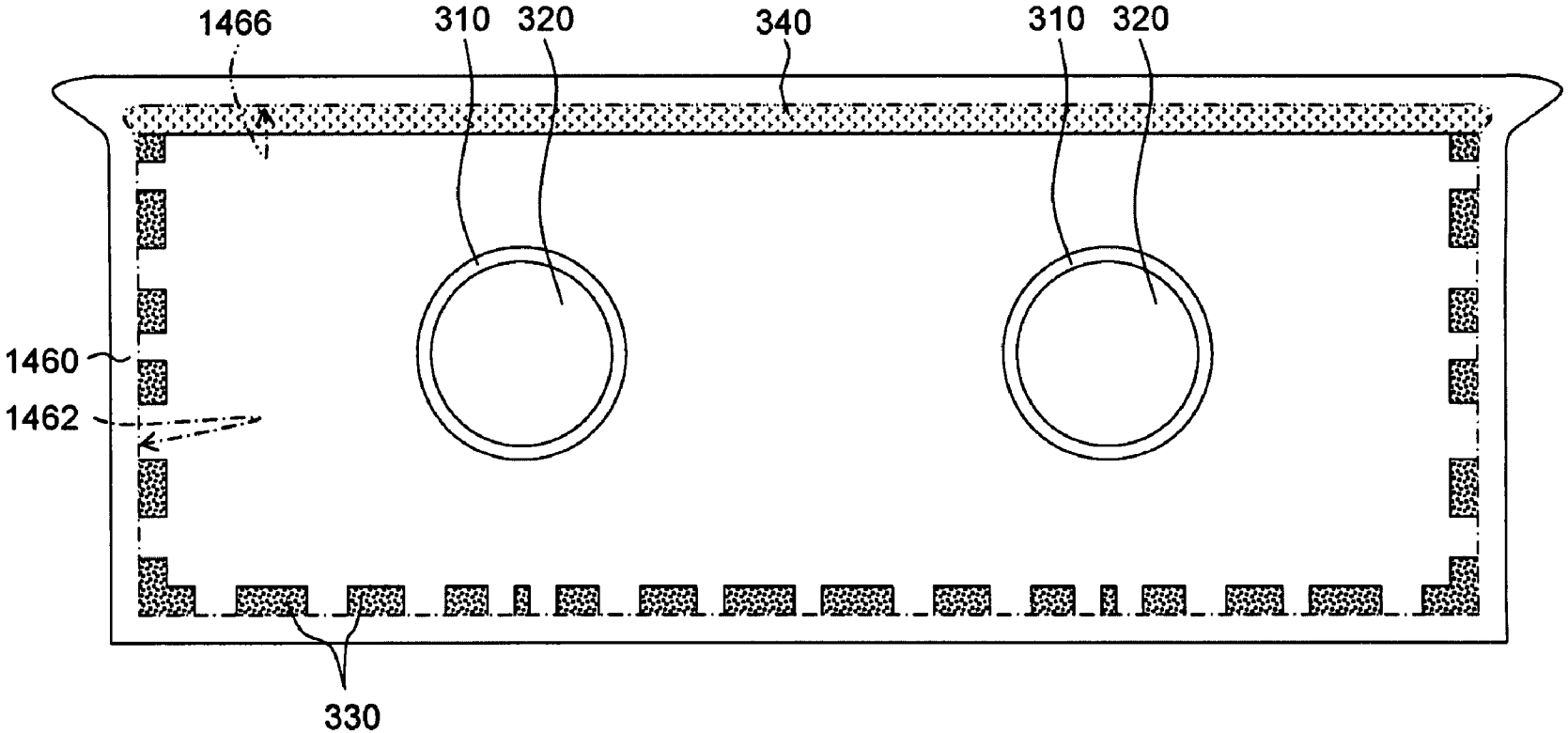
FIGS. 14A~14G are seven of the sectional views according to the twelfth embodiment of the present invention.

FIG. 14A is another sectional view of the illuminating element according to the twelfth embodiment of the present invention, please refer to FIG. 14A, the illuminating element 1400*a* comprises said casing 310, said exciting illuminating gas 320, said first exciting coating 330, said first dielectric multi-layer long-pass filter 340, and said outer mask 1460. Said exciting illuminating gas 320 is disposed inside said casing 310, and said casing 310 is disposed inside said transparent closed outer mask 1460.

Said transparent closed outer mask 146 comprises a third inner side 1452 and a fourth inner side 1466, and said first dielectric multi-layer long-pass filter 340 is disposed over said fourth inner side 1466. The first exciting coating is disposed over said inner side 1462 and appears to be unevenly distributed with respect to the disposition of said casing 310 so as the visible light passing said transparent closed outer mask 1260 is in uniformed strength.

In the present embodiment, the distribution of said first exciting coating 330 could be selected from the group of dot type, mass type or stripe type. In addition, despite the counting of said casing 310 is two in the drawing, the present invention does not delimit the counting of said casing 310, namely the counting of said casing 310 can be one or two or more than two.

What is noteworthy is, without departing the scope and spirit of the present invention skilled person can applied the teachings to the present embodiment and hereby only the third and fourth embodiments are illustrated exemplarily for further explanation.

Figure 14B:
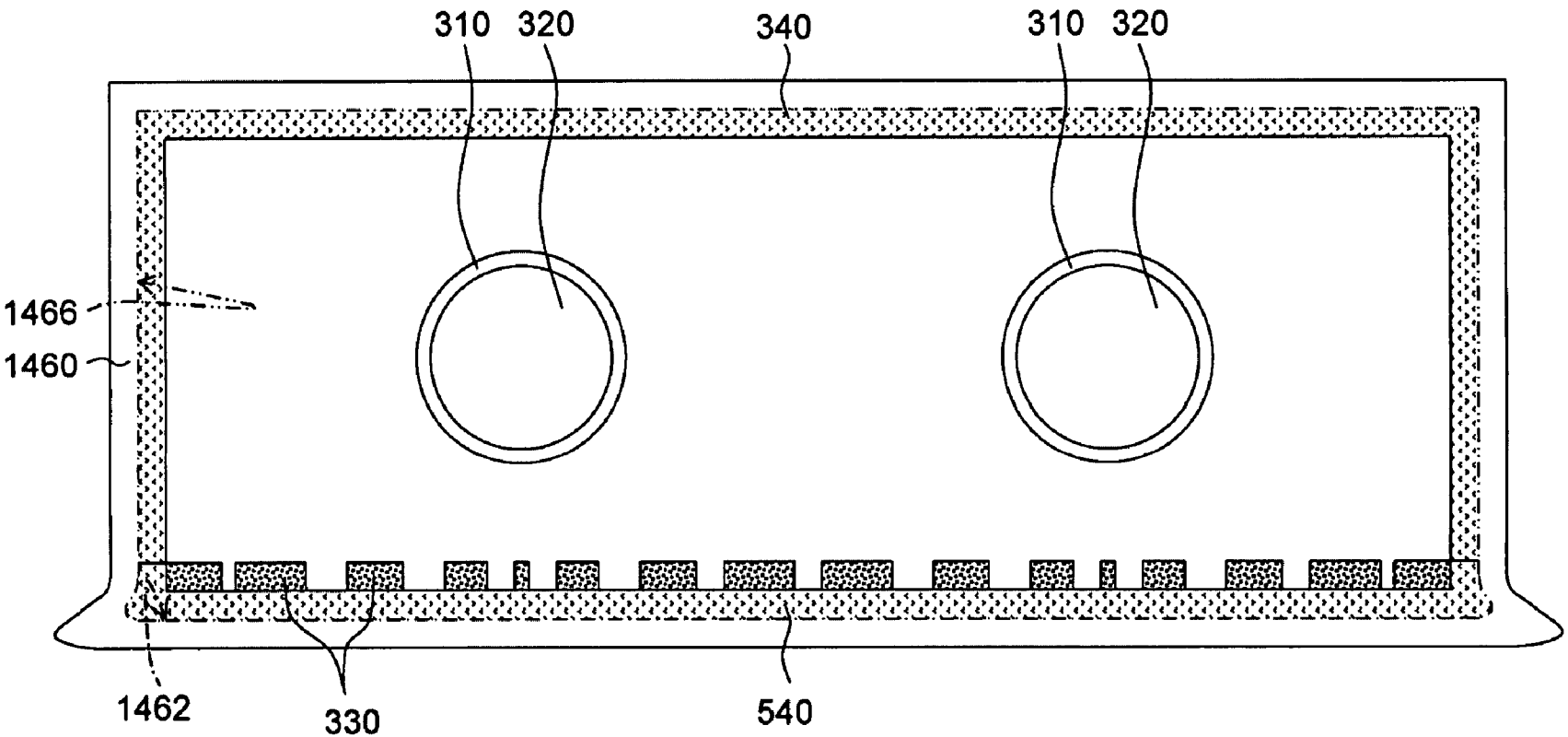
Figure 14C:
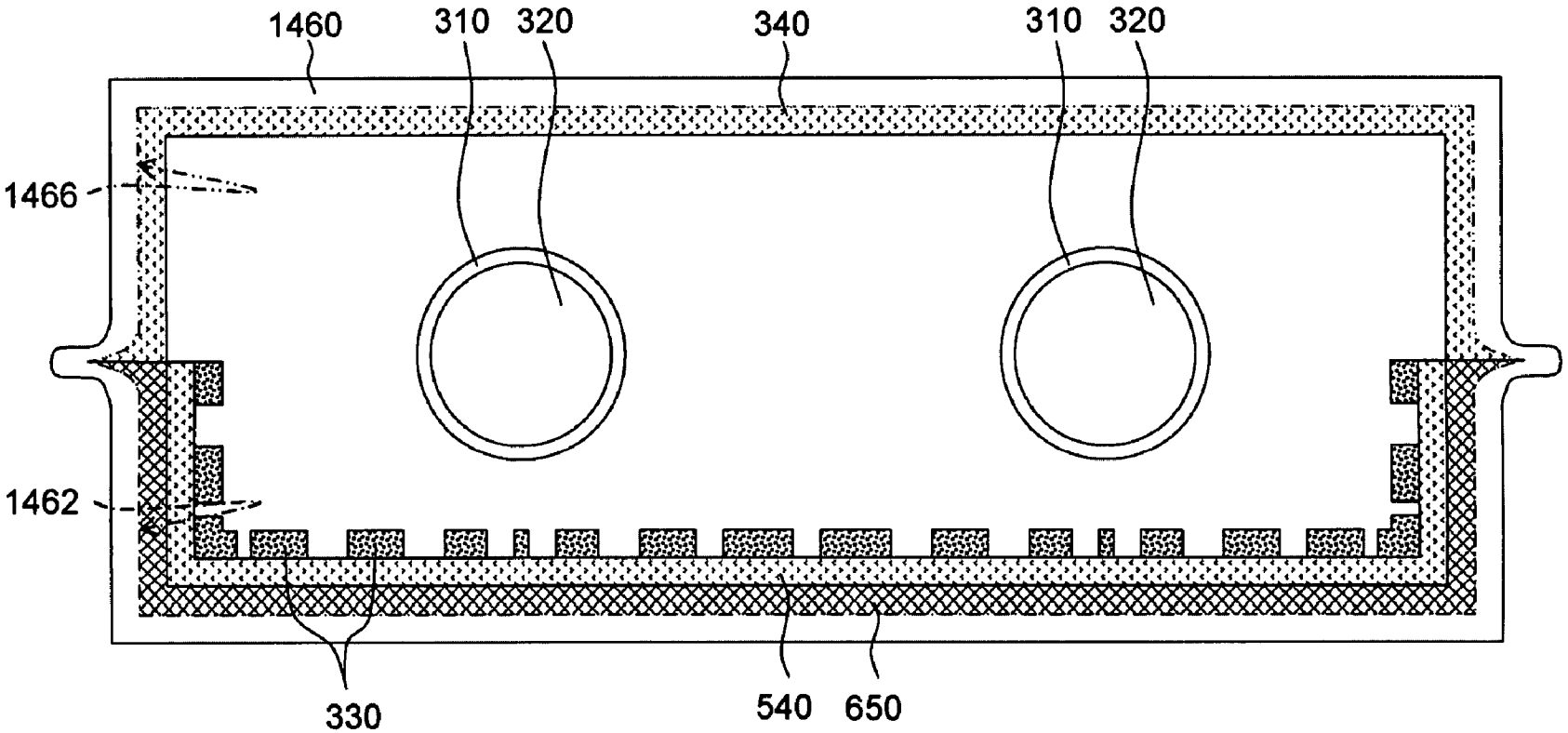

FIGS. 14B~C are another sectional views of the illuminating element according to the twelfth embodiment of the present invention, wherein the illuminating element depicted in the FIG. 14B is an application combined with the third embodiment and the illuminating element depicted in the FIG. 14C is an application combined simultaneously with the third embodiment and the fourth embodiment.

Please refer to FIGS. 14B~C, in FIG. 14B an illuminating element 1400*b* and the illuminating element 1400*a* are ditto but said illuminating element 1400*b* further comprises said second dielectric optical multi-layer filter 540, and said second dielectric optical multi-layer filter 540 is disposed over said first exciting coating 330, and said first exciting coating 330 is closer to said casing 310 than said second dielectric optical multi-layer filter 540. Specifically, said first exciting coating 330 is disposed between said second dielectric optical multi-layer filter 540 and said third inner side 1462.

In FIG. 14C, the illuminating element 1400*c* and illuminating element 1400*b* (as depicted in FIG. 14B) are ditto but said illuminating 1400*c* further comprises said first reflecting film 650, and said second dielectric optical multi-layer filter 540 is closer to said casing 310 than said first reflecting film 650. Specifically, said second dielectric optical multi-layer filter 540 is disposed between said first reflecting film 650 and said first exciting coating 330. Skilled person can easily reason the corresponding configuration thus nothing else will be redundantly mentioned.

Additionally, said casing 310 further comprises an aperture (not depicted), and said illuminating element 1400*a*~1400*c* further comprises an auxiliary exciting illuminating gas (not depicted) to supplement said exciting illuminating gas 320, wherein said auxiliary gas 320 is disposed between said casing 310 and said transparent closed outer mask 1460.

Figure 14D:
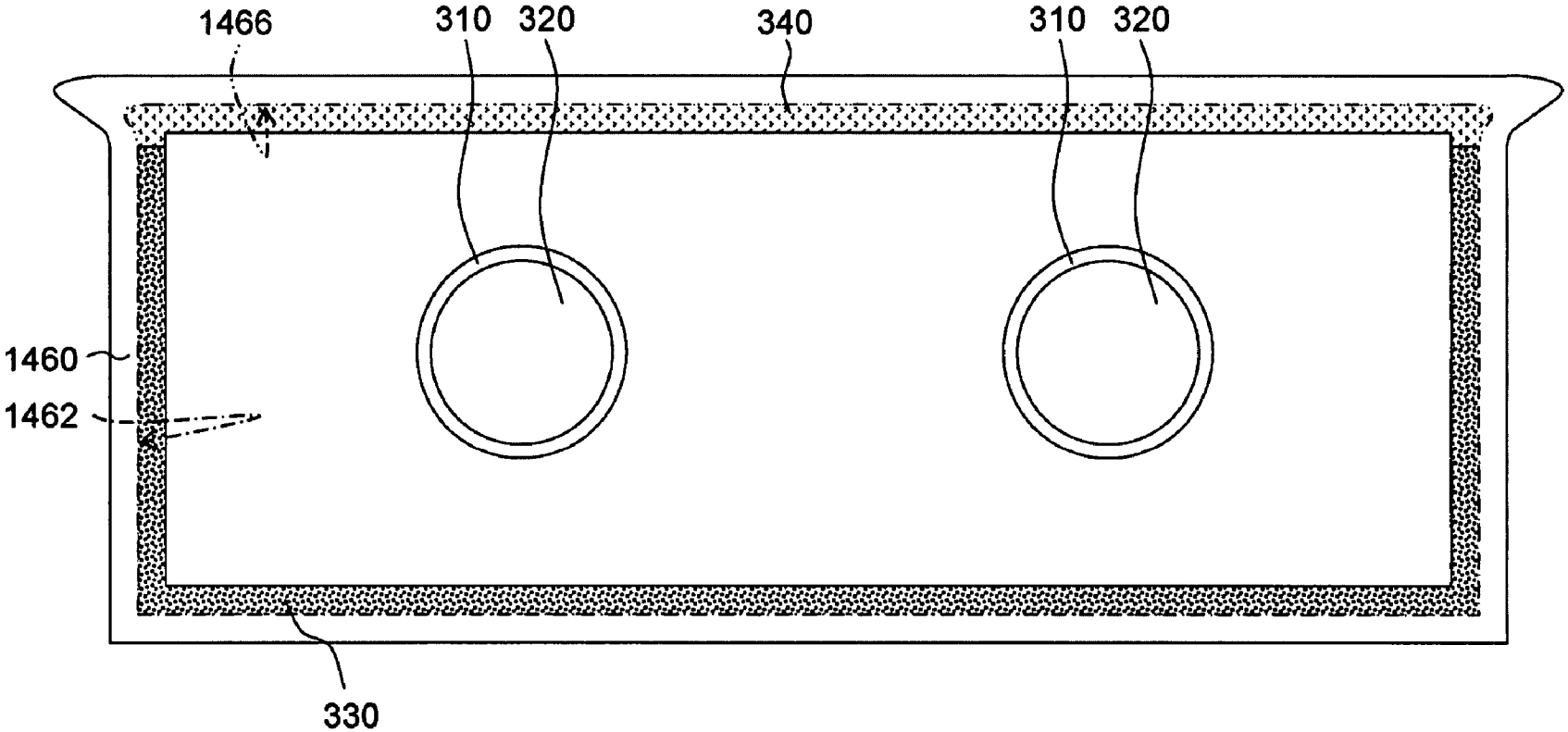

FIG. 14D is another sectional view of the illuminating element according to the twelfth embodiment of the present invention, please refer to FIG. 14D, the illuminating element 1400*a* and the illuminating element 1400*d* are ditto but said first exciting coating 330 is disposed over all said third inner sides 1462.

In addition, despite in the aforementioned the shape of said casing 310 is of tube and the shape of said transparent closed outer mask 1460 is of tank, the present invention does not delimit thereto the shape of said casing 310 and said transparent closed outer mask 1460. Hereby the present invention will illustrate with accompanied drawings.

Figure 14E:
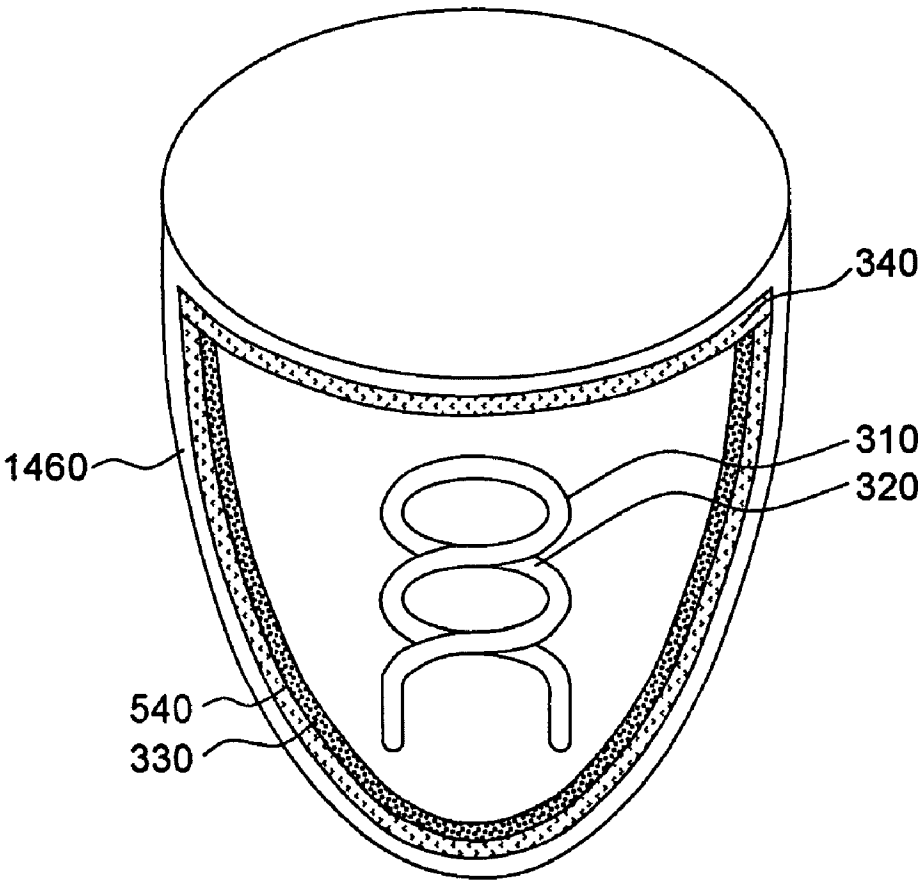
Figure 14F:
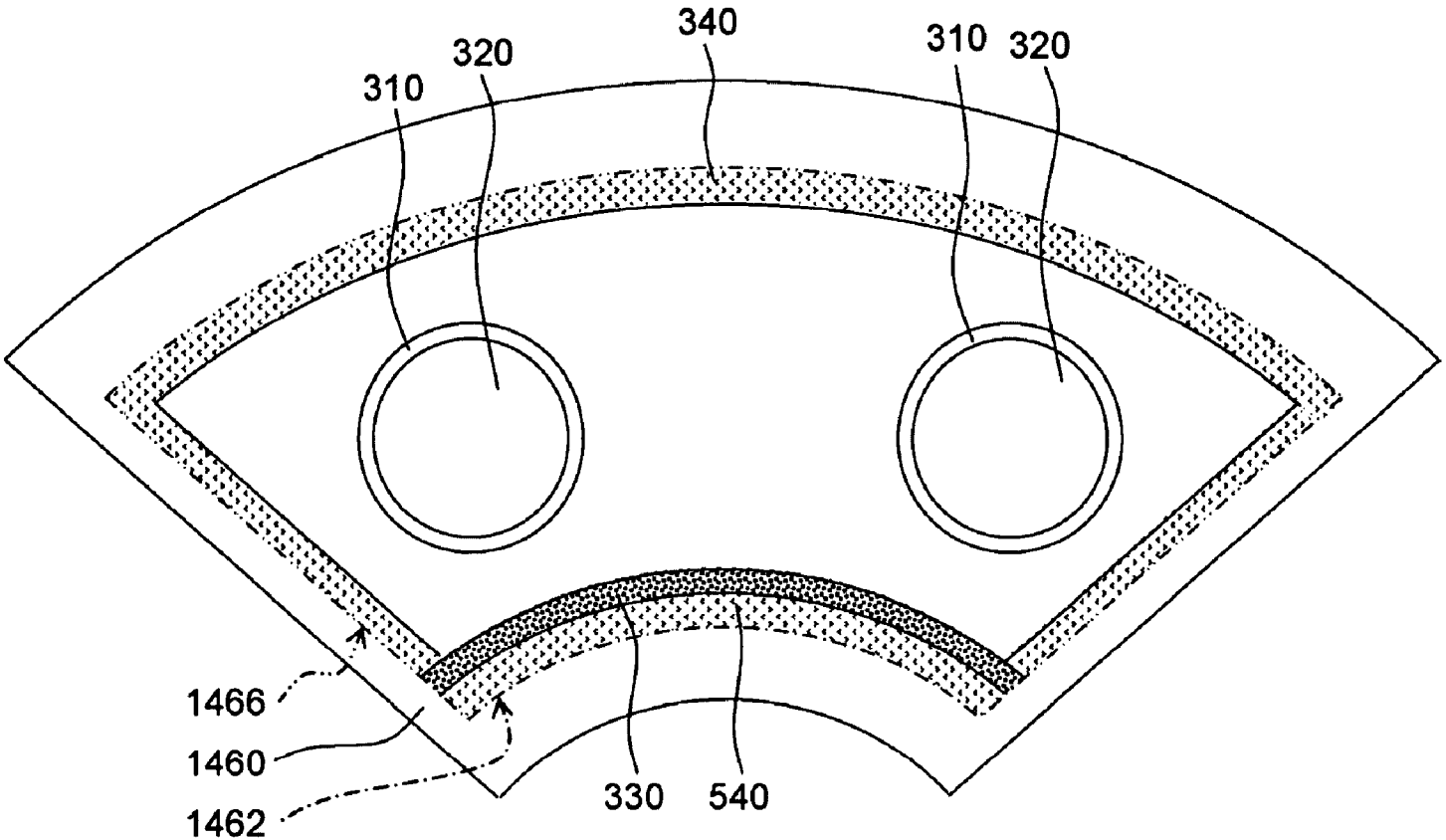
Figure 14G:
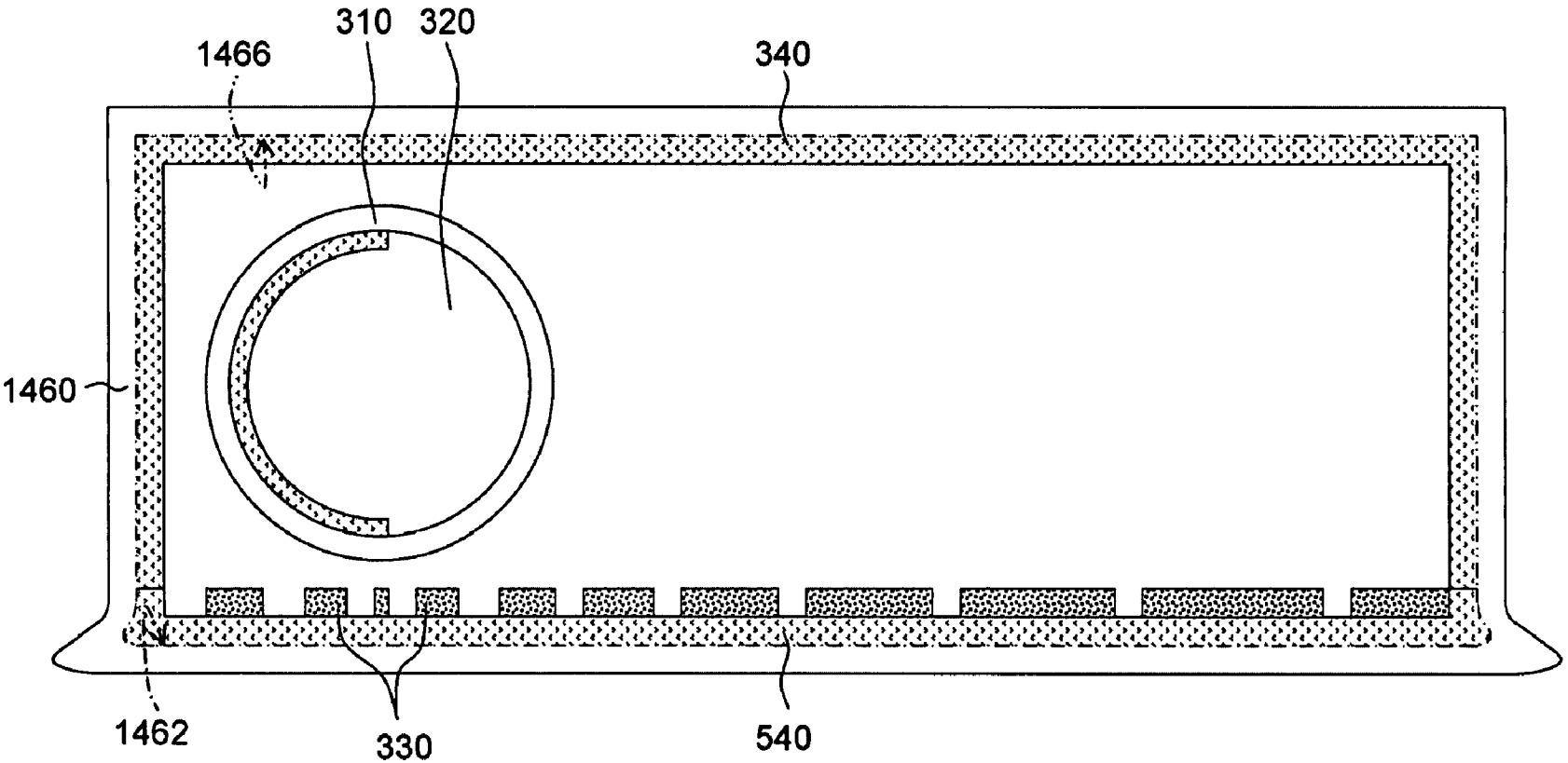

FIGS. 14E~G are three sectional views according to the twelfth embodiment of the present invention. Please refer to FIG. 14E, the illuminating element 1400*b* (as depicted in FIG. 14B) and the illuminating element 1400*e* are ditto but said casing 310 is of spiral shape, and said transparent closed outer mask 1460*e* is of semi-sphere.

Please refer to FIG. 14F, an illuminating element 1400*f* and said illuminating element 1400*d* (as depicted in FIG. 14D) are ditto but said transparent closed outer mask 1460 is composed of double spheres. In addition, said illuminating element 1400*f* further comprises said second dielectric optical multi-layer filter 540, and said second dielectric optical multi-layer filter 540 is disposed over said first exciting coating 330.

Please refer to FIG. 14G, the illuminating element 1400*g* and said illuminating element 1400*b* are ditto but said illuminating element 1400*g* comprises solely a single one of said casing 310, and said casing 310 is disposed in one side with respect to said transparent closed outer mask 1460. Besides, said casing 310 can further comprise a dielectric optical multi-layer film or an aperture (not depicted in the drawing) and the correlated advantages are already mentioned in details thus nothing else will be redundantly mentioned.

Thirteenth Embodiment

Figure 15A:
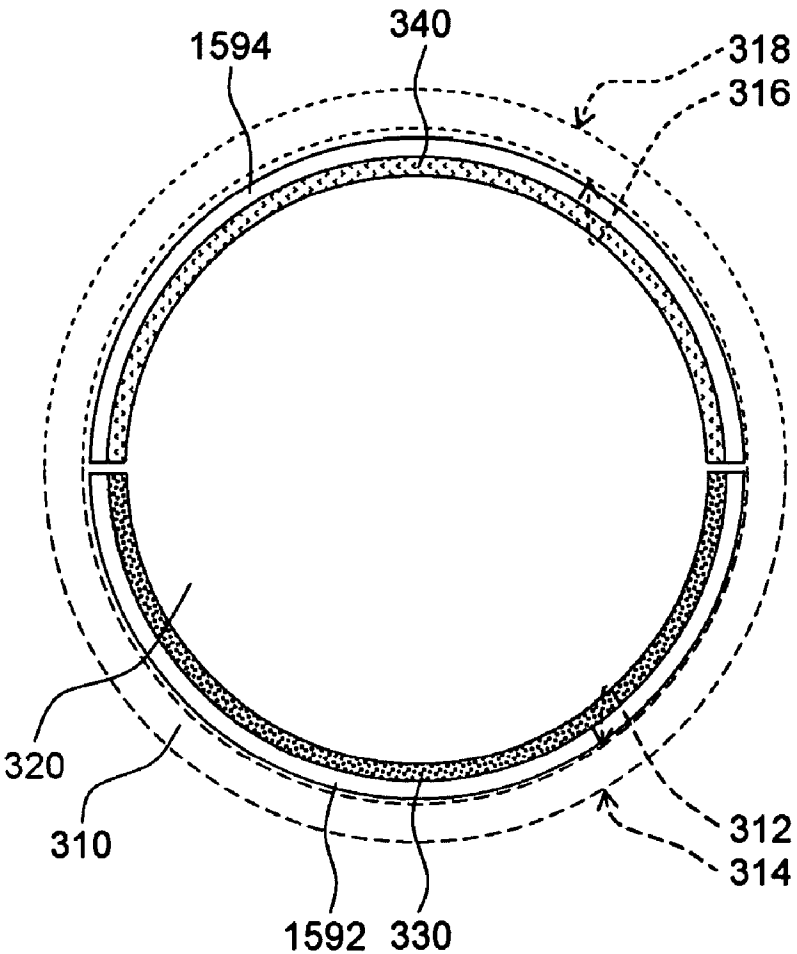
FIG. 15A is one of the sectional views according to the thirteenth embodiment of the present invention.

FIG. 15A is another sectional view of the illuminating element according to the thirteenth embodiment of the present invention. Please refer to FIG. 15A, the illuminating element 200 disclosed in the present invention comprises said casing 310, said exciting illuminating gas 320, said first exciting coating 330, said first dielectric multi-layer long-pass filter 340, said first transparent partition plate 1592, and said second transparent partition plate 1594, wherein said casing 310 further comprises correspondingly said first inner side 312 and said first outer side 314 and said second inner side 316 and said second outer side 318, and said exciting illuminating gas 320 is disposed inside said casing 310.

To be continued with the aforementioned, said first transparent partition plate 1592 is disposed over said first inner side 312, and said first exciting coating 330 is disposed over said first transparent partition plate 1592, and said first transparent partition plate 1592 is disposed within said first inner side 312 and said first exciting coating 330. Besides, said second transparent partition plate 1592 is disposed over said second inner side 316, and said first dielectric multi-layer long-pass filter 340 is disposed over said second transparent partition plate 1592, and said second transparent partition plate 1592 is disposed between said second inner side 316 and said first dielectric multi-layer long-pass filter 340.

In addition, for all elements disclosed in the present invention there can be further an extra AR film (anti-reflection) in order to enhance the efficiency for the light pass, and said AR can be categorized as UV-AR (ultraviolet AR), Vis-AR (visible light AR), and said UV-AR and Vis-AR are respectively further plated on the light-passing surfaces according to the different demand.

What is noteworthy is that one skilled in the art can refer to the previous embodiments and apply the concept of all of the embodiments to extend to the present embodiment hereby nothing else will be redundantly mentioned.

To sum up the aforementioned, the illuminating elements in the present invention possesses the advantages as the follows:

Firstly, because said dielectric optical multi-layer film can reflect said ultraviolet light back to the transparent closed hull to illuminate the stimulated light film to emit visible light, the illuminating efficiency and energy utilization of the illuminating elements can be greatly enhanced.

Secondly, because the stimulated light film is for superficially illuminating thus its corresponding illuminating element possesses a better luminance.

The invention being thus aforesaid, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A light illuminating element, comprising:

a transparent closed casing, said casing having a first inner side, a second inner side, a first outer side and a second outer side or a first inner side, a second inner side, a first outer side, a second outer side and at least one transparent partition plate, the first outer side corresponding to the first inner side, and the second outer side corresponding to the second inner side;

an exciting illuminating gas, disposed over said transparent closed casing, and suitable for providing an ultraviolet light with at least one specific wavelength;

an exciting coating, disposed over said first inner side or over the transparent partition plate provided on said first inner side or over said second inner side or over the transparent partition plate provided on said second inner side, or over said first inner side or over the transparent partition plate provided on said first inner side and over said second inner side or over the transparent partition plate provided on said second inner side, or over the transparent partition plate within said transparent closed casing, said exciting coating suitable for absorbing said ultraviolet light with at least one of the specific wavelength to provide a visible light; and a dielectric multi-layer long-pass filter, disposed over said first inner side or over the transparent partition plate provided on said first inner side or over said second inner side or over the transparent partition plate provided on said second inner side, or over said first inner side or over the transparent partition plate provided on said first inner side and over said second inner side or over the transparent partition plate provided on said second inner side, or over said first outer side or said second outer side, or over said first outer side and said second outer side, or over the transparent partition plate within said transparent closed casing on one or two sides, said dielectric multi-layer long-pass filter suitable for reflecting said ultraviolet light with at least one of the specific wavelength and allowing the visible light to pass through, wherein the reflecting angle of said ultraviolet light with at least one of the specific wavelength has a wide angle of incidence, and a range of the reflecting angle of said ultraviolet light with at least one of the specific wavelength is between 0 and 90 degrees, with 0 and 90 degrees included, and wherein said exciting coating is closer to said exciting illuminating gas than said dielectric multi-layer long-pass filter.

2. The element as recited in claim 1, wherein the average reflectance of said dielectric multi-layer long-pass filter reflecting said ultraviolet light with the specific wavelength at least is 95%.

3. The element as recited in claim 1, wherein the angle of transmission of the visible light achieve ±0° to 60° and the transmittance is more than 95%.

4. The element as recited in claim 1, wherein the range of the reflecting angle of said ultraviolet light with the specific wavelength is between 30 and 90 degrees.

5. The element as recited in claim 4, wherein the average reflectance of said dielectric multi-layer long-pass filter reflecting said ultraviolet light with the specific wavelength at least is 95%.

6. The element as recited in claim 1, wherein an anti-reflection film is coated on an opposite side to the dielectric multi-layer long-pass filter for increasing the transmittance of the visible light.

7. The element as recited in claim 1, wherein the principal wavelength of said ultraviolet light with the specific wavelength is 253.7 nm or 253.7 nm and 184.9 nm, or 147 nm, or 147 nm and 173 nm.

8. The element as recited in claim 1, wherein said dielectric multi-layer long-pass filter comprises $HfO_2$, Hafnium Dioxide or $LaF_3$, Lanthanum Trifluoride, $MgF_2$, Magnesium Fluoride, or $Na_3AlF_6$, Sodium Hexafluoroaluminate.

9. The element as recited in claim 1, wherein said exciting coating is constituted of fluorescence or phosphor and can be formed to a flat or straight wall.

10. The element as recited in claim 1, further comprising a visible light reflecting layer, disposed over said first inner side or said first outer side of said transparent closed casing or outside of said first outer side, and said exciting coating is closer to said exciting illuminating gas than said visible light reflecting layer.

11. The element as recited in claim 1, wherein the distribution of said exciting coating is selected from at least one of the group of dot type, piece type or stripe type.

12. A light illuminating element, comprising:

a transparent closed casing, said casing having a first inner side, a second inner side, a first outer side and a second outer side or a first inner side, a second inner side, a first outer side, a second outer side and at least one transparent partition plate, the first outer side corresponding to the first inner side, and the second outer side corresponding to the second inner side;

a transparent closed internal housing, disposed in said transparent closed casing;

an exciting illuminating gas, disposed between said transparent closed casing and said transparent closed internal housing, said exciting illuminating gas is suitable for providing an ultraviolet light with at least one specific wavelength;

an exciting coating, disposed over said first inner side or over the transparent partition plate provided on said first inner side or over said second inner side or over the transparent partition plate provided on said second inner side, or over said first inner side or over the transparent partition plate provided on said first inner side and over said second inner side or over the transparent partition plate provided on said second inner side, or over the transparent partition plate within said transparent closed casing, said exciting coating suitable for absorbing said ultraviolet light with at least one of the specific wavelength to provide a visible light; and a dielectric multi-layer long-pass filter, disposed over said first inner side or over the transparent partition plate provided on said first inner side or over said second inner side or over the transparent partition plate provided on said second inner side, or over said first inner side or over the transparent partition plate provided on said first inner side and over said second inner side or over the transparent partition plate provided on said second inner side, or over said first outer side or said second outer side of said transparent closed casing, or over said first outer side and said second outer side of said transparent closed casing, and over said inner side or said outer side of said transparent closed internal housing, or over the transparent partition plate within said transparent closed casing on one or two sides, and said dielectric multi-layer long-pass filter is suitable for reflecting said ultraviolet light with at least one of the specific wavelength and allowing said visible light to pass through, wherein the reflecting angle of said ultraviolet light with at least one of the specific wavelength has a wide angle of incidence, and a range of the reflecting angle of said ultraviolet light with at least one of the specific wavelength is between 0 and 90 degrees, with 0 and 90 degrees included, and wherein said exciting coating is closer to said exciting illuminating gas than said dielectric multi-layer long-pass filter.

13. The element as recited in claim 12, wherein the average reflectance of said dielectric multi-layer long-pass filter reflecting said ultraviolet light with the specific wavelength at least is 95%.

14. The element as recited in claim 12, wherein the angle of transmission of the visible light achieve ±0° to 60° and the transmittance is more than 95%.

15. The element as recited in claim 12, wherein the range of the reflecting angle of said ultraviolet light with the specific wavelength is between 30 and 90 degrees.

16. The element as recited in claim 15, wherein the average reflectance of said dielectric multi-layer long-pass filter reflecting said ultraviolet light with the specific wavelength at least is 95%.

17. The element as recited in claim 12, wherein the principal wavelength of said ultraviolet light with the specific wavelength is 253.7 nm, or 253.7 nm and 184.9 nm, or 147 nm, or 147 nm and 173 nm.

18. The element as recited in claim 12, wherein said dielectric multi-layer long-pass filter comprises $HfO_2$, Hafnium Dioxide or $LaF_3$, Lanthanum Trifluoride, $MgF_2$, Magnesium Fluoride, or $Na_3AlF_6$, Sodium Hexafluoroaluminate.

19. The element as recited in claim 12, wherein said exciting coating is constituted of fluorescence or phosphor film and can be formed to a flat or straight wall.

20. The element as recited in claim 12, further comprising a visible light reflecting layer, disposed over said first inner side or said first outer side of said transparent closed casing or outside of said first outer side, and said exciting coating is closer to said exciting illuminating gas than said visible light reflecting layer.

21. The element as recited in claim 12, wherein the distribution of said exciting coating is selected from at least one of the group of dot type, piece type or stripe type.

22. The element as recited in claim 12, wherein an anti-reflection film is coated on an opposite side to the dielectric multi-layer long-pass filter for increasing the transmittance of the visible light.

23. A light illuminating element, comprising:

a transparent closed outer mask;

a transparent closed casing disposed within said transparent closed outer mask;

an exciting illuminating gas, disposed in said transparent closed casing, wherein said exciting illuminating gas is suitable for providing an ultraviolet light with at least one specific wavelength;

an exciting coating, disposed over at least one inner side of said transparent closed outer mask, said exciting coating is suitable for absorbing said ultraviolet light with at least one of the specific wavelength to provide a visible light; and a dielectric multi-layer long-pass filter, disposed over at least one inner side of said transparent closed outer mask and preferably over all inner sides of said transparent closed outer mask, said dielectric multi-layer long-pass filter suitable for reflecting said ultraviolet light with at least one of the specific wavelength and allowing said visible light to pass through, wherein the reflecting angle of said ultraviolet light with at least one of the specific wavelength has a wide angle of incidence, and a range of the reflecting angle of said ultraviolet light with at least one of the specific wavelength is between 0 and 90 degrees, with 0 and 90 degrees included.

24. The element as recited in claim 23, wherein the average reflectance of said dielectric multi-layer long-pass filter reflecting said ultraviolet light with the specific waveband at least is 95%.

25. The element as recited in claim 23, wherein the angle of transmission of the visible light achieve ±0° to 60° and the transmittance is more than 95%.

26. The element as recited in claim 23, wherein the range of the reflecting angle of said ultraviolet light with the specific wavelength is between 30 and 90 degrees.

27. The element as recited in claim 26, wherein the average reflectance of said dielectric multi-layer long-pass filter reflecting said ultraviolet light with the specific wavelength at least is 95%.

28. The element as recited in claim 23, further comprising a visible light reflecting film, disposed over said inner side or said outer side of said transparent closed outer mask or outside of said outer side, and said exciting coating is closer to said exciting illuminating gas than said visible light reflecting film.

29. The element as recited in claim 23, wherein the principal wavelength of said ultraviolet light with the specific waveband is 253.7 nm, or 253.7 nm and 184.9 nm, or 147 nm, or 147 nm and 173 nm.

30. The element as recited in claim 23, wherein said dielectric multi-layer long-pass filter comprises $HfO_2$, Hafnium Dioxide or $LaF_3$, Lanthanum Trifluoride, $MgF_2$, Magnesium Fluoride, or $Na_3AlF_6$, Sodium Hexafluoroaluminate.

31. The element as recited in claim 23, wherein said exciting coating is constituted of fluorescence or phosphor film and can be formed to a flat or straight wall.

32. The element as recited in claim 23, wherein the distribution of said exciting coating is selected from at least one of the group of dot type, piece type or stripe type, and said exciting coating distributes unequally according to the installation of said transparent closed casing, and said visible light transmits through said transparent closed outer mask in an even strength.

33. The element as recited in claim 23, an anti-reflection film is coated on an opposite side to the dielectric multi-layer long-pass filter for increasing the transmittance of the visible light.

* * * * *

UNITED STATES PATENT AND TRADEMARK OFFICE

CERTIFICATE OF CORRECTION

PATENT NO. : 7,919,913 B2
APPLICATION NO. : 12/046971
DATED : April 5, 2011
INVENTOR(S) : Jenn-Wei Mii It is certified that error appears in the above-identified patent and that said Letters Patent is hereby corrected as shown below:

Title page, item [76] inventor: should read as follows:

Jenn-Wei Mii

Signed and Sealed this
Seventeenth Day of May, 2011

David J. Kappos

David J. Kappos
*Director of the United States Patent and Trademark Office*